US006450776B1

(12) United States Patent
Taneya et al.

(10) Patent No.: US 6,450,776 B1
(45) **Date of Patent: *Sep. 17, 2002**

(54) LIQUID DISCHARGING HEAD AND LIQUID DISCHARGING METHOD

(75) Inventors: Yoichi Taneya, Yokohama; Hiroyuki Ishinaga, Tokyo; Hiroyuki Sugiyama, Sagamihara; Sadayuki Sugama, Tsukuba; Satoshi Shimazu, Yokohama, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/362,224

(22) Filed: Jul. 28, 1999

(30) Foreign Application Priority Data

Jul. 28, 1998 (JP) ..... 10-212718
Jul. 26, 1999 (JP) ..... 11-210705

(51) Int. Cl.[7] ..... F04B 19/24

(52) U.S. Cl. ..... 417/207; 417/208; 417/209; 347/65

(58) Field of Search ..... 417/207, 208, 417/209; 347/65

(56) References Cited

U.S. PATENT DOCUMENTS

| | | | | |
|---|---|---|---|---|
| 4,723,129 A | | 2/1988 | Endo et al. | 346/140 R |
| 5,485,186 A | * | 1/1996 | Ishinaga et al. | 347/65 |
| 5,821,962 A | * | 10/1998 | Kudo et al. | 347/65 |
| 5,841,448 A | | 11/1998 | Moriyama et al. | 347/19 |
| 5,943,074 A | * | 8/1999 | Kashino et al. | 347/54 |
| 5,992,984 A | * | 11/1999 | Imanaka et al. | 347/65 |
| 6,070,970 A | * | 6/2000 | Ogasawara et al. | 347/65 |
| 6,074,543 A | * | 6/2000 | Yoshihira et al. | 205/75 |
| 6,095,640 A | * | 8/2000 | Ishinaga et al. | 347/65 |
| 6,109,735 A | * | 8/2000 | Kashino et al. | 347/65 |

FOREIGN PATENT DOCUMENTS

| | | | |
|---|---|---|---|
| DE | 436 047 | 7/1991 | |
| EP | 0 721 841 | 7/1996 | 347/65 |
| EP | 0 721 843 | 7/1996 | 347/65 |
| EP | 0 739 734 | 10/1996 | 347/65 |
| EP | 0 811 495 | 12/1997 | 347/65 |
| EP | 0 816 087 | 1/1998 | 347/65 |
| EP | 0 819 530 | 1/1998 | 347/65 |
| JP | 6-31918 | 2/1994 | |
| JP | 9-48127 | 2/1997 | |
| JP | 9-323420 | 12/1997 | |
| JP | 10-24588 | 1/1998 | |

* cited by examiner

*Primary Examiner*—Charles G. Freay
*Assistant Examiner*—Michael K. Gray
(74) *Attorney, Agent, or Firm*—Fitzpatrick, Cella, Harper & Scinto

(57) ABSTRACT

A liquid discharging head which discharges a liquid through a discharging port utilizing an energy generated by producing air bubble including side walls which are to be brought into contact with a movable member to restrict upstream growth of a bubble, thereby stabilizing liquid discharge.

27 Claims, 34 Drawing Sheets

3H
3J
1
2
3
4
6
10
11
11a
11b
11c
12a
12b
12c
40
66

14H
14J
1
2
3
4
6
7
10
11
11a
11b
11c
12a
40
66

LIQUID DISCHARGING HEAD AND LIQUID DISCHARGING METHOD

BACKGROUND OF THE INVENTION

1. Field of the Invention

The present invention relates to a liquid discharging device which produces a bubble by exerting a heat energy to a liquid and discharges the liquid utilizing the bubble, and more specifically a liquid discharging device which comprises a movable member displaced by utilizing production of a bubble.

A term of "recording" used in this specification means impairment of not only a significant image such as a character or a figure but also of an insignificant image such as a pattern to a recording medium.

2. Related Background Art

This is conventionally known an ink-jet recording method, or the so-called bubble-jet recording method, which produces a bubble by exerting an energy such as heat to liquid ink contained in a flow path of a recording apparatus such as a printer and discharges the ink through a discharging port utilizing a force generated by an abrupt volumetric change caused by the production of the bubble, thereby allowing the ink to adhere to a recording medium so as to form an image. A recording apparatus which uses the bubble-jet recording method generally comprises a discharging port to discharge ink, a flow path communicated with the discharging port and an electrothermal converting element as energy generating means as disclosed by U.S. Pat. No. 4,723,129.

Such a recording method permits not only recording a high quality image at a fast speed and with low noise but also arranging discharging ports to discharge ink at a high density in a head adopted to carry out the method, thereby having a lot of merits such as a capability to record a high resolution image and even a color image easily with a compact apparatus. Accordingly, the bubble-jet recording method has recently been utilized for many kinds of office appliances such as printers, copying machines and facsimiles, and further for industrial systems such as printing machines.

Demands which are mentioned below have recently been stronger as a bubble jet method has been utilized for products in many fields.

There have been proposed driving conditions to provide a liquid discharging method which permits stable production of a bubble for favorable discharge of ink at a fast speed, thereby obtaining a high quality image as well as improvement in a shape of a flow path for a liquid discharging head which refills a discharged liquid into a flow path at a fast speed in terms of high speed recording.

Speaking apart from such a head, Japanese Patent Application Laid-Open No. 6-31918 pays attention to a back wave (a pressure applied in a direction reverse to a direction toward discharging ports) which is produced when a bubble is produced and discloses an invention of a structure to prevent the back wave due to which a liquid discharging energy is lost. In the structure according to this invention, a triangular plate like member is opposed to a heater which produces a bubble. This invention suppresses the back wave with the triangular plate like member temporarily and slightly. However, the patent makes no reference to correlation between growth of the bubble and the triangular member nor has a conception of this correlation, whereby the invention mentioned above poses problems which are below.

The invention disclosed by the patent cannot stabilize a forms of a liquid drops due to a fact that the heater is located at a bottom of a cavity and cannot the communicated linearly with a discharging port and allows the bubble to grow within an entire range from a side to an opposite side of the triangular plate like member due to a fact that the bubble is allowed to grow from surroundings of a vertex portion of a triangle, thereby providing a result that the bubble is grown as usual in a liquid as if the plate like member were not used. Accordingly, existence of the plate like member has not relation to a grown bubble. Inversely, the plate like member is surrounded as a whole by the bubble, and allows a refilling liquid to the heater located in the cavity to produce a turbulent flow at a contraction stage of the bubble and constitutes a cause for accumulation of minute bubbles in the cavity, thereby disturbing a principle itself to discharge the liquid on the basis of growth of the bubble.

On the other hand, EP Publication Laid-Open No. 436047A1 proposes an invention which alternately opens and closes a first valve which shields a section in the vicinity of discharging ports from a bubble producing section, and a second valve which shields the bubble producing section and an ink supplying section (FIGS. 4 through 9 in EP No. 436047A1). However, this invention partitions these three sections into two, thereby allowing ink which follows a liquid drop to remarkably tail at a discharging stage, thereby producing satellite dots in a number prettily larger than that of satellite dots produced by the ordinary discharging method which grows, contracts and breaks a bubble (assumed to be incapable of utilizing an effect of retreat of a meniscus caused by breaking the bubbles). Furthermore, the invention allows discharged liquid drops to be remarkably variable and provides an extremely low discharge response frequency which is not a practically usable level since it is incapable of supplying the liquid to a region in the vicinity of a discharging port until a next bubble is produced through it allows the liquid to be supplied into the bubble producing section as the bubble is broken at a refilling stage.

The applicant has proposed a large number of inventions using movable members (a plate like member which has a free end on a side of discharging ports from a fulcrum or the like) which can effectively contribute to discharge of liquid drops quite differently from the prior art described above. Out of the inventions, Japanese Patent Application Laid-Open No. 9-48127 discloses an invention which restricts an upper limit of displacement of the movable member described above to prevent a behavior of the movable member from being slightly disturbed. Furthermore, Japanese Patent Application Laid-Open No. 9-323420 discloses an invention which enhances a refilling capability by shifting a common upstream liquid chamber toward a free end, or downstream, relative to the movable member utilizing a merit of the movable member described above. These inventions are based on a conceptional premise that growth of bubbles is open at a breath toward a side of discharging ports from a condition where the bubble is enwrapped by the movable member temporally and pay no attention to individual factors of the bubbles as a whole which relate to formation of liquid drops or correlation among these factors.

At a next step, the applicant disclosed an invention which partially opens a bubble producing region from the movable member described above as an invention which pays attention to a growth of bubbles due to propagation of a pressure wave as a factor related to liquid discharge (acoustic wave) in Japanese Patent Application Laid-Open No. 10-24588. However, even this invention pays attention only to the growth of the bubbles at a liquid discharging stage, but not to the individual factors of the bubbles as a whole which relate to the formation of the liquid drops themselves nor correlation among the factors.

Though it is conventionally known that discharge of a liquid is largely influenced by a front portion (edge chutter type) of bubbles produced by film boiling, no one has ever paid attention to this portion which may effectively contribute to formation of liquid drops to be discharged and the inventor et al. eagerly made researches to accomplish an invention which solves these technical problems.

Paying attention to the displacement of the movable member described above and produced bubbles, the inventor et al. obtained useful knowledge which is described below.

Paying attention to "a form of an inter-flow path wall" which is effective also for restriction of growing bubbles as a new structure to restrict the movable member, the inventor et al. conceived to restrict an upper limit of displacement of the movable member for growth of the bubbles using an inter-flow path wall. Obtained knowledge was that a stopper of the movable member which is disposed on the inter-flow path wall makes it possible to broaden a range permissible for minute working together with an image forming area in the presence of bubbles while allowing a required liquid flow.

Speaking concretely, a larger clearance between the movable member and the inter-flow path wall which is located sideways is more desirable to absorb manufacturing variations of the movable member which displaces in the flow path.

Inversely, the larger clearance allows the bubbles to penetrate between the movable member and the interflow path wall which is located sideways as the bubbles grow, whereby the bubbles may grow up to a top surface of the movable member. Accordingly, it is considered that the clearance must be narrow in the end. However, these problems which are conflicting with each other can be solved by imparting a stopper function for the movable member to the inter-flow path wall which is located sideways. Speaking concretely, manufacturing variations of the flow path and the movable member can be absorbed even when the clearance is large (for example, 5 $\mu$m to 8 $\mu$m). The clearance between the movable member and a side stopper 12*b* is gradually narrowed as the movable member displaces along with growth of the bubbles, the stopper starts to restrict passage of the bubbles when the clearance is on the order of 3 $\mu$m and passage of the bubbles can be completely checked in the vicinity of a contact portion between the side stopper 12*b* and a portion of the movable member.

The present invention has been achieved from a viewpoint and the new knowledge which have been described above.

Furthermore, growth of the bubbles was accelerated in a space between the movable member and a bubble producing surface in a direction reverse to that toward discharging ports by ensuring the restriction of the upper limit of the growth of bubbles from a bubble producing surface when the side stopper 12*b* is disposed. This growth of the bubbles may be neglected since it is not a factor which lowers a discharge efficiency, but the inventor et al. made examinations whether or not the growth of the bubbles could be rationally utilized for the displacement of the movable member. As a result, the inventor et al. obtained knowledge that the growth of the bubbles could rationally be utilized by integrating the movable member with a pressure wave receiver which is disposed at a location close to (for example, 20 $\mu$m or shorter) but apart from the bubble producing surface.

Furthermore, checks of the movable member which extends from the fulcrum to the free end clarified that it actually has a movable fulcrum between the free end and the fulcrum. It was judged that the variations were conventionally caused due to design which was made on the basis of a shifting volume of the movable member calculated from a displacement angle $\Theta$ for a distance 1 between the free end and the fulcrum.

Examinations which were made while paying attention to these facts clarified that the variations can be corrected by specifying a spatial volume substantially required for moving the movable member.

Furthermore, the present invention also provides a method to manufacture a liquid discharging head which embodies the knowledge described above.

SUMMARY OF THE INVENTION

A primary object of the present invention is to provide a liquid discharging head for discharging a liquid through a discharging port with an energy generated by producing a bubble comprising an heat generating element which generates a heat energy for producing the bubble in the liquid, a discharging port which discharges the liquid, a liquid flow path which is communicated with the discharging port and has a bubble producing region producing the bubble in the liquid, a movable plate which is disposed in the bubble producing region and displaced as the bubble grows, and a restricting member which restricts displacement of the movable plate within a desired range, wherein the liquid flow path is composed of a substrate which is equipped with the heat generating element and substantially planar, an opposed plate which is opposed to the substrate, and two side walls located between the substrate and the opposed plate, wherein the movable plate has a free end which has a width larger than that of the heat generating element, wherein the free end of the movable plate is opposed to a middle of the bubble producing region formed by the heat generating element, the movable plate is opposed to the substrate and a side end of the movable plate is displaced while it is opposed to the side walls, and wherein the restricting member has a tip restricting portion which is to be brought into substantial contact with the free end of the displaced movable plate, and a side restricting portion which is located beside the bubble producing region and on a side opposite to the substrate with regard to the movable plate, and to be brought into substantial contact at least partially with both sides of the side end of the displaced movable plate so as to keep open the middle of the liquid flow path, whereby the bubble produced from the bubble producing region is restricted by the contact between the movable plate and the side restricting portion.

Another object of the present invention is to provide a liquid discharging head for discharging a liquid through a discharging port with an energy generated by producing a bubble comprising a liquid flow path which comprises an heat generating element which generates a heat energy for producing the air bubble in the liquid, a discharging port which discharges the liquid, a liquid flow path which is communicated with the discharging port and has a bubble producing region producing the air bubble in the liquid, a movable plate which is disposed in the air bubble producing region and displaced as the air bubble grows, and a restricting member which restricts displacement of the movable plate within a desired range, and wherein the movable plate has a convexity which is close to the air bubble producing region and protrudes from the movable plate toward the substrate, the restricting member is disposed in opposition to the air bubble producing region of the liquid flow path which has the air bubble producing region forms a space which is substantially closed except the discharging port when the displaced movable plate is brought into substantial contact with the restricting member.

Still another object of the present invention is to provide a method to discharge a liquid through a discharging port of a liquid discharging head with an energy generated by producing a bubble comprising an heat generating element which generates a heat energy for producing the air bubble in the liquid, the discharging port which discharges the liquid, a liquid flow path which is communicated with the discharging port and has a bubble producing region producing the air bubble in the liquid, a movable plate which is disposed in the air bubble producing region and displaced as the air bubble grows, and a restricting member which restricts displacement of the movable plate within a desired range, wherein the liquid flow path is composed of a substrate which is equipped with the heat generating element and substantially planar, an opposed plate which is opposed to the substrate, and two side walls located between the substrate and the opposed plate, wherein the movable plate has a free end which has a width larger than that of the heat generating element, wherein the free end of the movable plate is opposed to a middle of the air bubble producing region formed by the heat generating element, the movable plate is opposed to the substrate and a side end of the movable plate is displaced while it is opposed to the side walls, wherein the restricting member has a tip restricting portion which is to be brought into substantial contact with the free end of the displaced movable plate, and a side restricting portion which is located beside the air bubble producing region and on a side opposite to the substrate with regard to the movable plate, and to be brought into substantial contact at least partially with both sides of the side end of the displaced movable plate so as to keep open the middle of the liquid flow path, and wherein the method comprises a step to bring the movable plate into contact with the restricting member before maximum growth of the air bubble and bring the side restricting portion into contact with the movable plate to restrict the air bubble produced from the air bubble producing region, whereby the liquid flow path having the air bubble producing region forms a space which is substantially closed except the discharging port.

A further object of the present invention is to provide a method to discharge a liquid through a discharging port of a liquid discharging head with an energy generated by producing a bubble comprising an heat generating element which generates a heat energy for producing the air bubble in the liquid, a discharging port which discharges the liquid, a liquid flow path which is communicated with the discharging port and has a bubble producing region producing the air bubble, a movable plate which is disposed in the air bubble producing region and displaced as the air bubble grows, and a restricting member which restricts displacement of the movable plate within a desired range, wherein the liquid flow path is composed of a substrate which is equipped with the heat generating element and substantially planar, an opposed plate which is opposed to the substrate, and two side walls which are located between the substrate and the opposed plate, wherein the movable plate has a free end which has a width larger than that of the heat generating element, wherein the free end of the movable plate is opposed to a middle of the air bubble producing region formed by the exohermic body, the movable plate is opposed to the substrate and a side end of the movable plate is displaced while it is opposed to the side walls, wherein the restricting member has a tip restricting portion which is to be brought into substantial contact with the free end of the displaced movable plate, and a side restricting portion which is located beside the air bubble producing region and on a side opposite to the substrate with regard to the movable plate, and to be brought into substantial contact at least partially with both sides of the side end of the displaced movable plate so as to keep open the middle of the liquid flow path, and wherein the method comprises a step to make a distance between the movable plate and the side restricting portion shorter than a gap between the movable plate and the side walls as the movable plate comes nearer the side restricting portion after allowing the liquid to flow around the movable plate which is displaced as the air bubble grows, thereby restricting advance of the air bubble toward the movable plate.

BRIEF DESCRIPTION OF THE DRAWINGS

FIGS. 14A, 14B, 14C, 14D, 14E, 14F, 14G, 14H, 141, 14J and 14K are views showing modifications of a side-shooter type head according to FIGS. 12A, 12B and 12C.

DETAILED DESCRIPTION OF THE PREFERRED EMBODIMENTS

[First Embodiment]

Figure 1C:
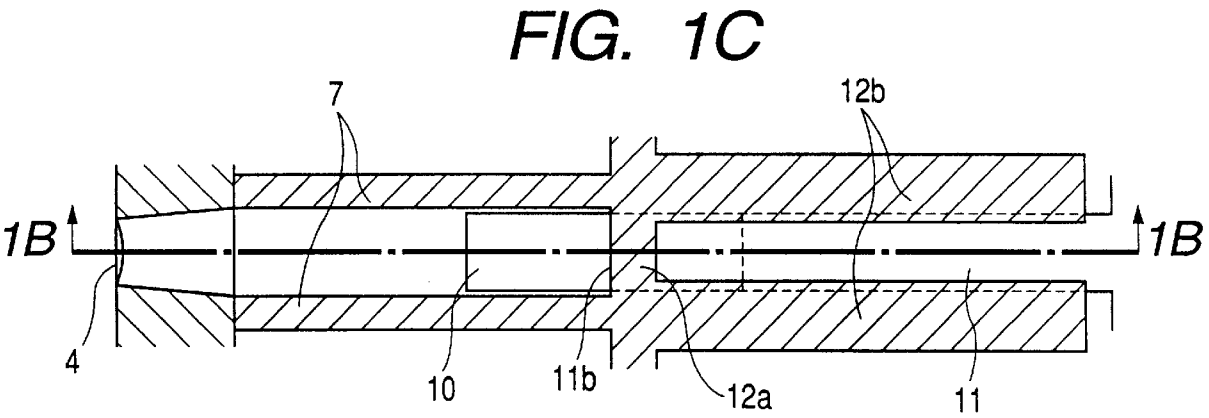
FIGS. 1A, 1B, 1C, 1D, 1E, 1F, 1G, 1H, 1I, 1J and 1K are schematic diagrams showing main members of a liquid discharging head preferred as a first embodiment of the liquid discharging device according to the present invention.
Figure 1B:
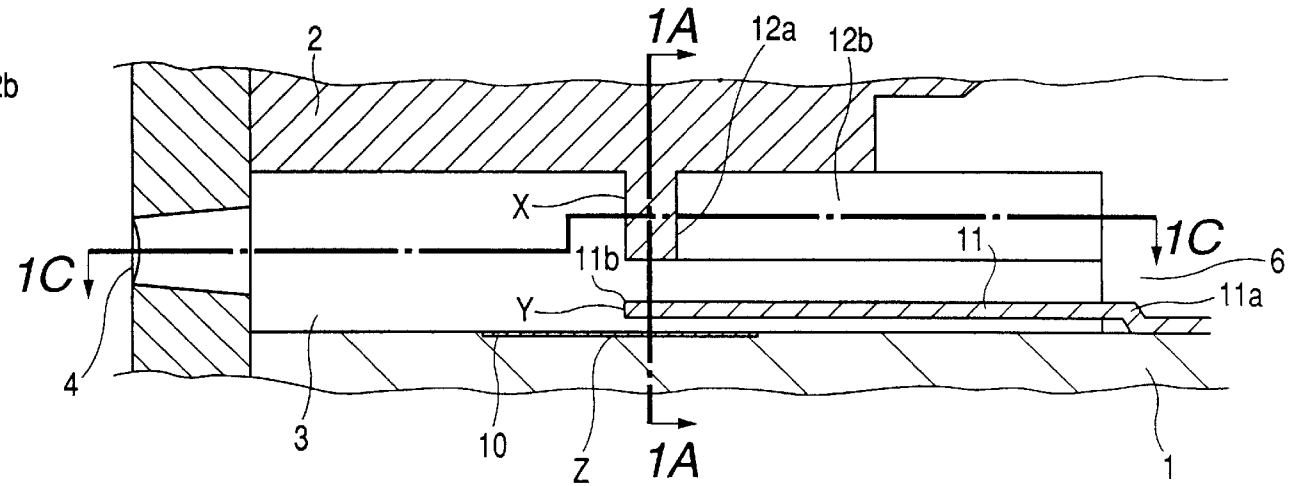
Figure 1A:
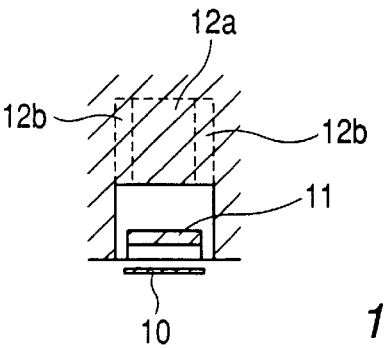

FIGS. 1A to 1K are schematic diagrams showing main members of a liquid discharging head preferred as a first embodiment of the liquid discharging device according to the present invention: FIG. 1B being a sectional view taken in a direction along a flow path, FIG. 1C being a sectional view taken along a 1C—1C line in FIG. 1B, and FIG. 1A being a sectional view taken along a 1A—1A line in FIG. 1B.

First, description will be made of a configuration of the liquid discharging head.

This liquid discharging head comprises an element substrate 1 and a ceiling plate 2 which are fixed to each other in a laminated condition, and a flow path 3 which is disposed between the substrate 1 and the ceiling plate 2. The flow path 3 is an elongated member which is surrounded by the element substrate 1, a side wall 7 and the ceiling plate (opposed plate) 2: the flow path 3 being disposed in a large number in a single recording head. A common liquid chamber 6 which has a large volume is disposed upstream so as to communicate simultaneously with the large number of flow paths 3. That is, the large number of flow paths 3 are branched from the single common liquid chamber 6. The height of the common liquid chamber 6 is far higher than those of the flow paths 3. Attached to the element substrate 1 are exothermic bodies (air bubble producing means) 10 and movable members 11 correspondingly to the large number of flow paths 3.

The movable member 11 is plate-like and supported at an end thereof like a cantilever, fixed to the element substrate 1 upstream (right side in FIG. 1B) an ink flow and movable vertically relative to the element substrate 1 downstream (left side in FIG. 1B) the fulcrum 11*a*. In an initial condition, the movable member 11 is positioned in parallel with the element substrate 1 while reserving a slight gap between the element substrate 1 and the movable member 11.

In the first embodiment, the movable member 11 is disposed so as to locate a free end 11*b* nearly in the middle of the heat generating element 10, a tip stopper 12*a* which restricts an upward movement of the movable member is disposed over the free end of the movable member and a side stopper 12*b* is disposed on both sides of the tip stopper 12*a* so that a clearance between the movable member and a wall of the flow path is shielded when displacement of the movable member is restricted (when the movable member is brought into contact).

The configuration described above makes it possible to separate a front (upstream) function from a rear (downstream) function more securely with a mechanical element dependently on a shape characteristic of a bubble. Since the configuration makes it possible to separate the functions, it provides a design having freedom remarkable higher than that of conventional design which places highest importance on balance in resistance of the like between an upstream flow path and a downstream flow path.

It is preferable that a position Y of the free end 11*b* and an end X of the tip stopper 12*a* are located on a plane perpendicular to the substrate. It is more preferable that X and Y are located on the plane perpendicular to the substrate together with Z which is a center of the heat generating element. When X, Y and Z are located as described above, the functions mentioned above can be separated more effectively.

Furthermore, the flow path is shaped so as to be abruptly raised downstream the tip stopper 12*a*. Since the flow path which has this shape keeps a bubble upstream the air bubble producing region at a sufficient height even when the movable member 11 is restricted by the stopper 12, it does not hinder growth of the air bubble, allows a liquid to flow smoothly toward a discharging port 4 and reduces ununiformity of pressure balance in a direction of height from a lower end to an upper end of the discharging port 4, thereby being capable of discharging the liquid favorably. A flow path having such a configuration is not preferable for a conventional head which does not comprise the movable member 11 since it produces a stagnation in a portion of the flow path which is raised downstream the stopper 12 and is apt to allow the air bubbles to stay in this portion, but the air produces an extremely small influence in the first embodiment wherein the liquid flows to the portion.

Furthermore, the common liquid chamber 6 has a ceiling which is abruptly raised taking the stopper 12 as a boundary. Though resistance to a fluid downstream the air bubble producing region is lower than that upstream the air bubble producing region and a pressure applied to discharge the liquid is hardly directed toward the discharging port when the movable member 11 is not disposed, the first embodiment is configured to positively direct the pressure applied to discharge the liquid toward the discharging port since the movable member 11 substantially prevents the air bubble from moving upsream the air bubble producing region while the air bubble is produced and feeds ink speedily to the air bubble reproducing region since resistance to fluid is low upstream the air bubble producing region while the ink is fed.

In the discharging head having the configuration described above, components which grow the air bubble downstream are not equal to components which grow the air bubble upstream, but the components which grow the air bubble upstream are fewer, thereby suppressing upstream movement of the liquid. The suppression of the upstream movement of the liquid shortens a distance of retreat of a meniscus which is caused after discharging the liquid and a distance of protrusion of the meniscus at a refilling stage. Accordingly, the discharging port suppresses vibrations of the meniscus and discharges the liquid stably at all driving frequencies ranging from a low frequency to a high frequency.

In the first embodiment, the flow path is set in a "linearly communicated condition" wherein the liquid flow is straight from a portion downstream the air bubble to the discharging port. It is more preferable that a propagation direction of a pressure wave which is produced due to production of the air bubble, a flow direction of the liquid flow caused by the production of the air bubble and a discharging direction are aligned so as to obtain an ideal condition where a discharging direction and a discharging speed of a discharged liquid drop 66 are stabilized at an extremely high level. As a definition sufficient to obtain this ideal condition or an approximation thereto, the present invention adopts a configuration wherein the discharging port 4 is connected linearly and directly to the heat generating element 10, a discharging port side (downstream) of the heat generating element which has an influence on the air bubble discharging port in particular, or a condition where the heat generating element, the downstream side of the heat generating element in particular, is observable from outside the discharging port when the liquid is not in the flow path.

Now, discharging operations of the liquid discharging head preferred as the first embodiment will be described in detail.

FIG. 1B shows a condition before an energy such as an electric energy is applied to the heat generating element 10, or a condition before the heat generating element generates heat. Facts which are important here are that the width of the movable member is smaller than the width of the flow path enough to reserve the clearance between the movable member and the wall of the flow path, and that the liquid discharging head comprises the tip stopper 12*a* which is opposed to an upstream half of the air bubble produced due to the heat generated by the heat generating element 10 and restricts the displacement of the movable member 11, and the side stopper 12*b* which is disposed on both the sides of the tip stopper 12*a*. The tip stopper 12*a* and the side stopper 12*b* restrict the upward displacement of the movable member, and the gap among the movable member, the tip stopper 12*a* and the side stopper 12*b* is closed while the upward movement of the movable member is restricted, thereby suppressing the upstream movement of the air bubble producing region.

Figure 1E:
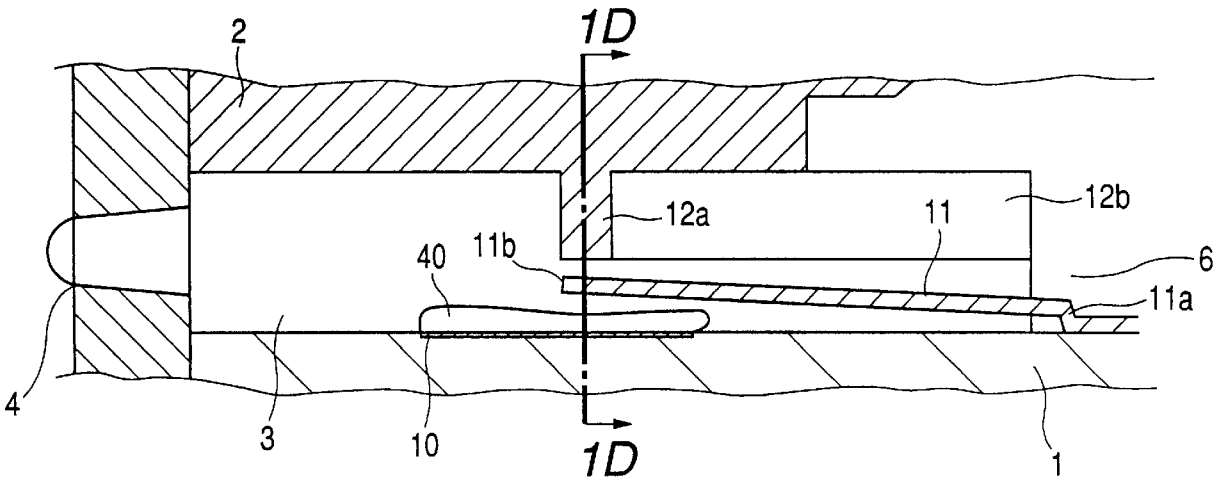

FIG. 1E shows a condition where the liquid filling the air bubble producing region is partially heated by the heat generating element 10, thereby starting production of a bubble 40 by film boiling.

At this stage, a pressure wave is formed due to the production of the air bubble 40 by the film boiling and propagates into the flow path 3, whereby the liquid moves downstream and upstream on both sides of the middle of the air bubble producing region, and the movable member 11 starts displacing upstream due to a liquid flow caused by growth of the air bubble 40. Furthermore, ink moves upstream toward the common liquid chamber while passing between the side stopper 12*b* and the movable member. The clearance between the side stopper 12*b* and the movable member is large at this stage, but it is narrowed as the movable member displaces.

Figure 1G:
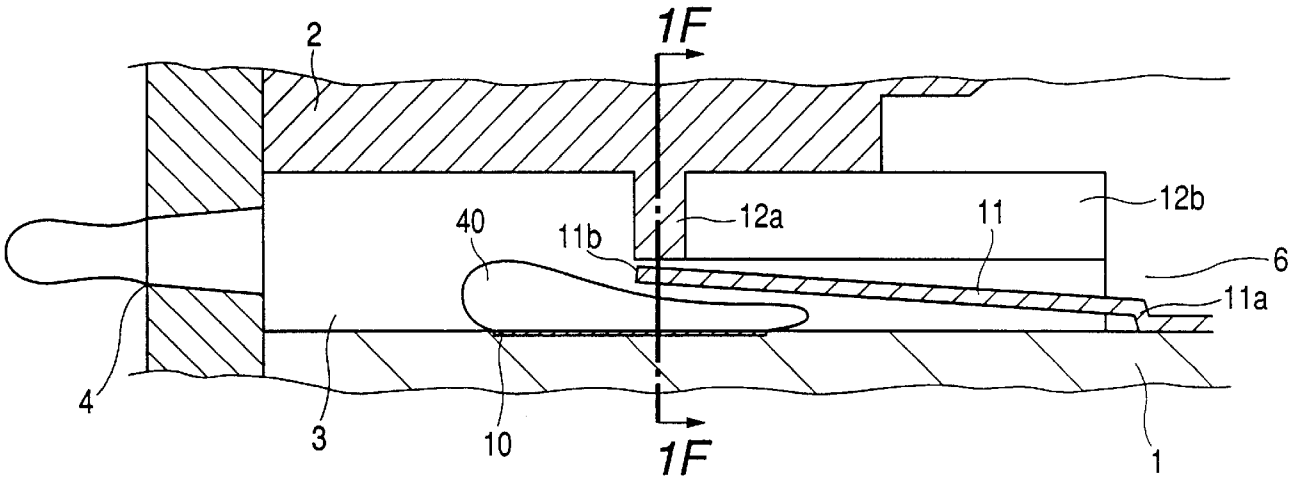
Figure 1D:
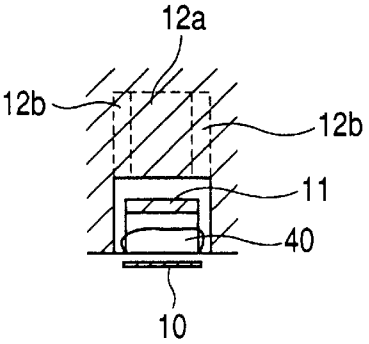
Figure 1F:
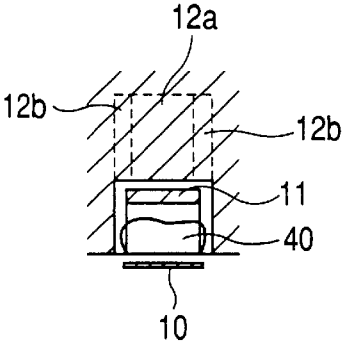

FIG. 1G shows a condition where the movable member displaces for a longer distance until it is close to the tip stopper 12*a* and the side stopper 12*b*. Since the pressure wave produced due to production of the air bubble 40 further propagates, the movable member is close to the tip stopper 12*a* and the side stopper 12*b* upstream the air bubble producing region, and the liquid drop 66 is going to be discharged from the discharging port 4.

At this stage, the clearance among the tip stopper 12*a*, the side stopper 12*b* and the movable member is narrow, thereby rather restricting a liquid flow upstream the air bubble producing region, or toward the common liquid chamber. Accordingly, a large pressure difference is produced between both sides of the movable member, or between a side of the air bubble producing region and a side of the common liquid chamber, whereby the movable member is pressed to the side stopper 12*b* in a closer contact condition. Since the movable member is brought into closer contact with the tip stopper 12*a* and the side stopper 12*b*, the liquid does not leak through the clearance between the movable member and the wall of the flow path even when the clearance is sufficiently wide. This configuration enhances sealing property of the air bubble producing region from the common liquid chamber, thereby preventing a discharging force from being lost due to liquid leak toward the common liquid chamber.

Figure 1I:
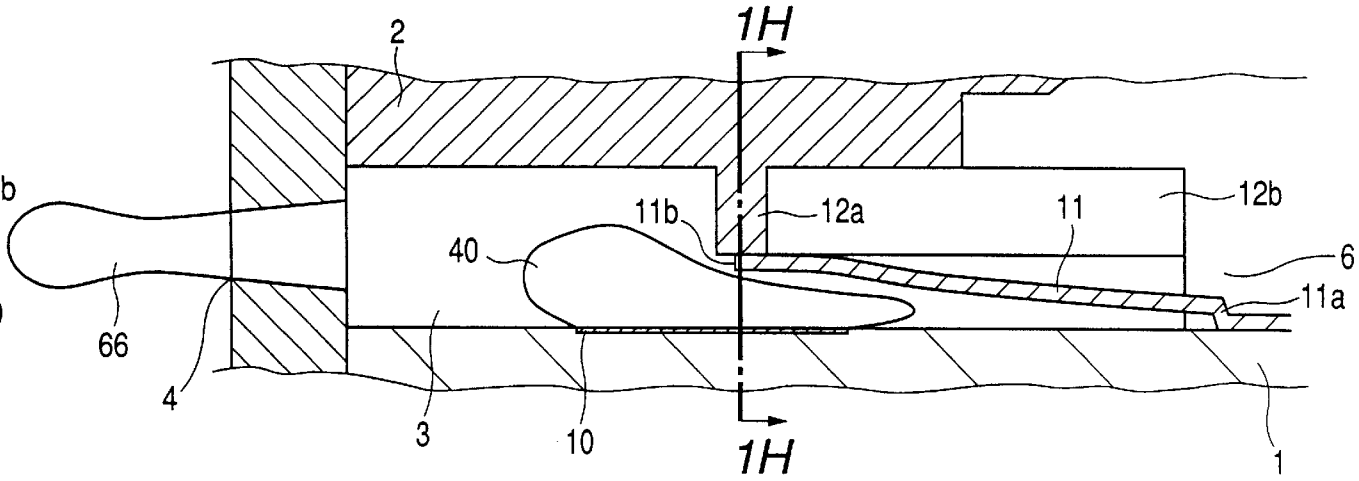
Figure 1H:
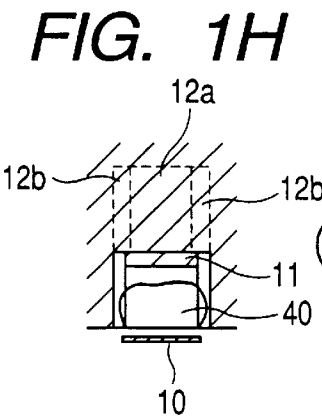

In FIG. 1I where the movable member 11 displaces until it comes close to or into contact with the tip stopper 12*a* and the side stopper 12*b*, the stoppers restrict further upward displacement of the movable member 11, thereby remarkably limiting the upstream liquid flow. Accordingly, upstream growth of the air bubble 40 is limited by the movable member 11. However, the movable member 11 is deformed so as to be slightly convex upward since a force to move the liquid upstream is strong and applies a stress which pulls the movable member 11 upstream. At this stage, the air bubble has a height downstream the heat generating element which is larger than that in a case where the movable member is not used since the movable member restricts growth of the air bubble which is still growing at this stage and the components to grow the air bubble upstream function to grow it downstream.

On the other hand, an upstream portion of the air bubble 40 has a small size in a condition where it curves the movable member 11 to be convex upstream by an inertia force of an upstream liquid flow and allows it only to charge a stress since the displacement of the movable member 11 is restricted by the upper limit tip stopper 12*a* and the side stopper 12*b* as described above. The tip stopper 12*a*, the side stopper 12*b*, the side wall 7 of the flow path, the movable member 11 and the fulcrum 33 function to allow substantially no amount of the upstream portion to penetrate into an upstream region.

Accordingly, the liquid discharging head remarkably restricts an upstream liquid flow, thereby preventing a fluid stroke to an adjacent flow path as well as a back flow and pressure vibrations in a supply path system which higher high speed refilling described later.

Figure 1K:
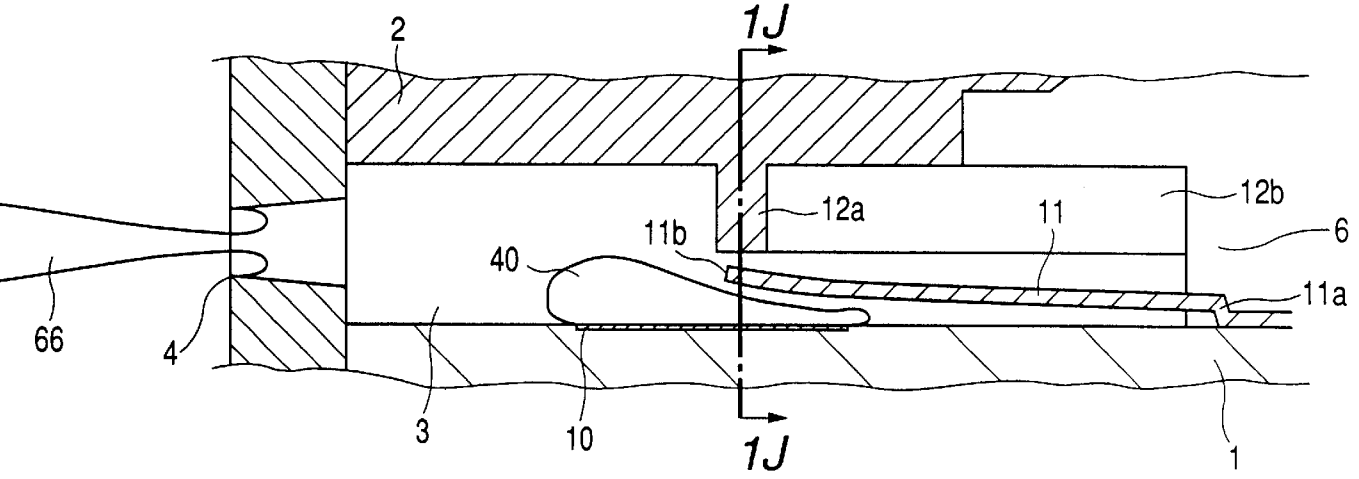
Figure 1J:
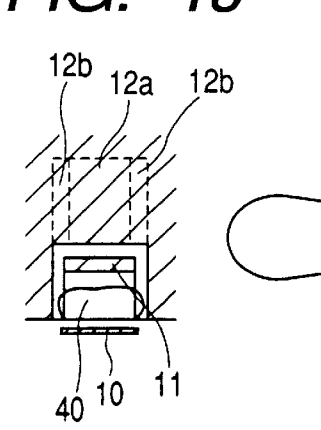
Figure 2C:
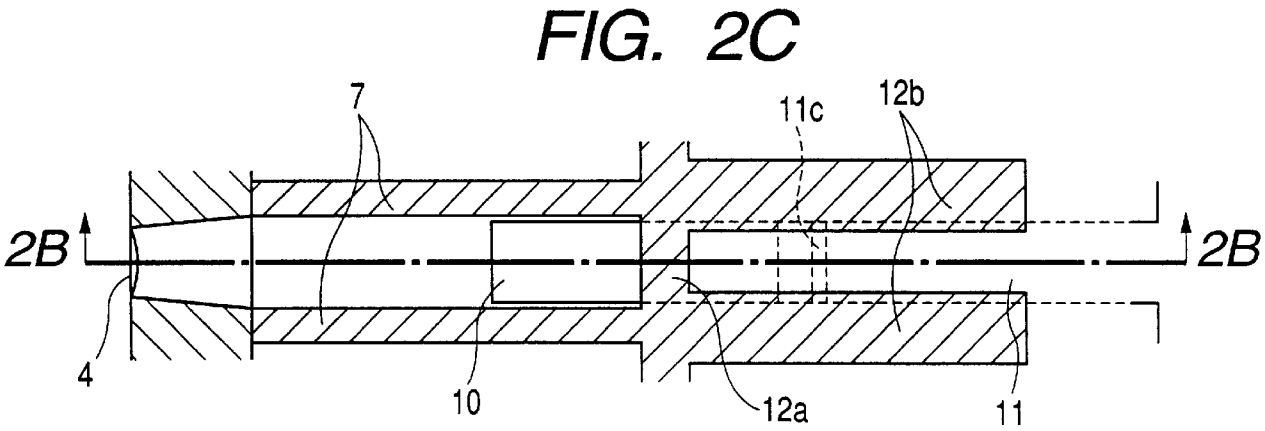
FIGS. 2A, 2B, 2C, 2D, 2E, 2F, 2G, 2H, 2I, 2J and 2K are schematic diagrams showing main members of a liquid discharging head of a second embodiment according to the present invention.
Figure 2B:
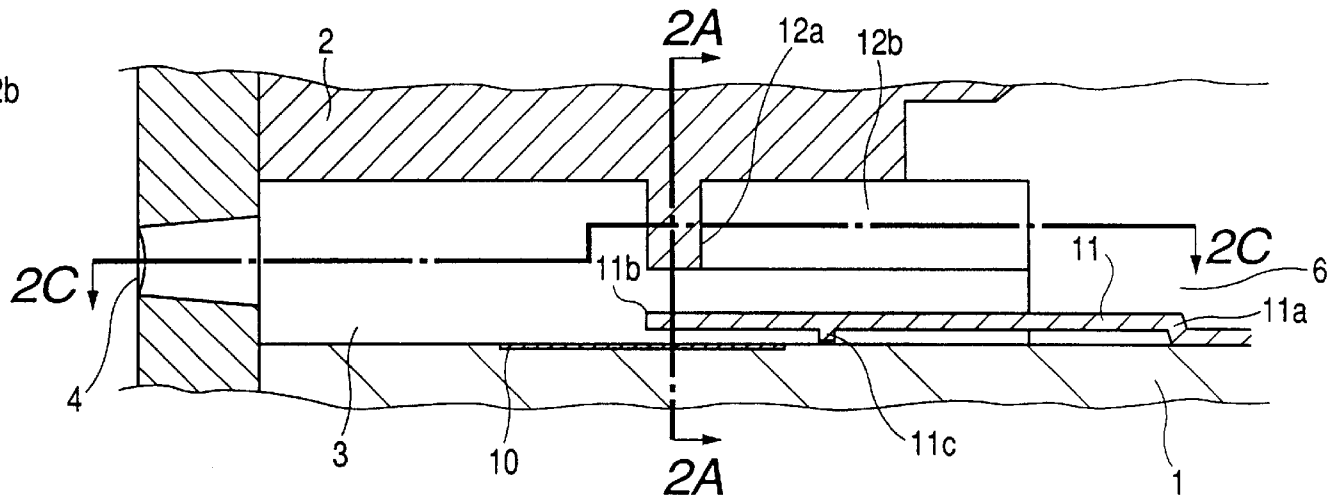
Figure 2A:
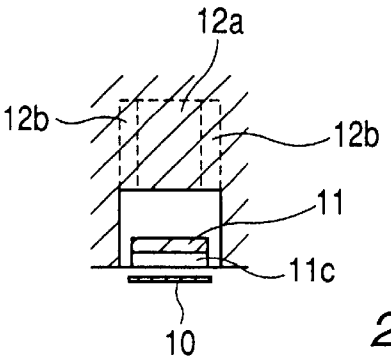
Figure 2E:
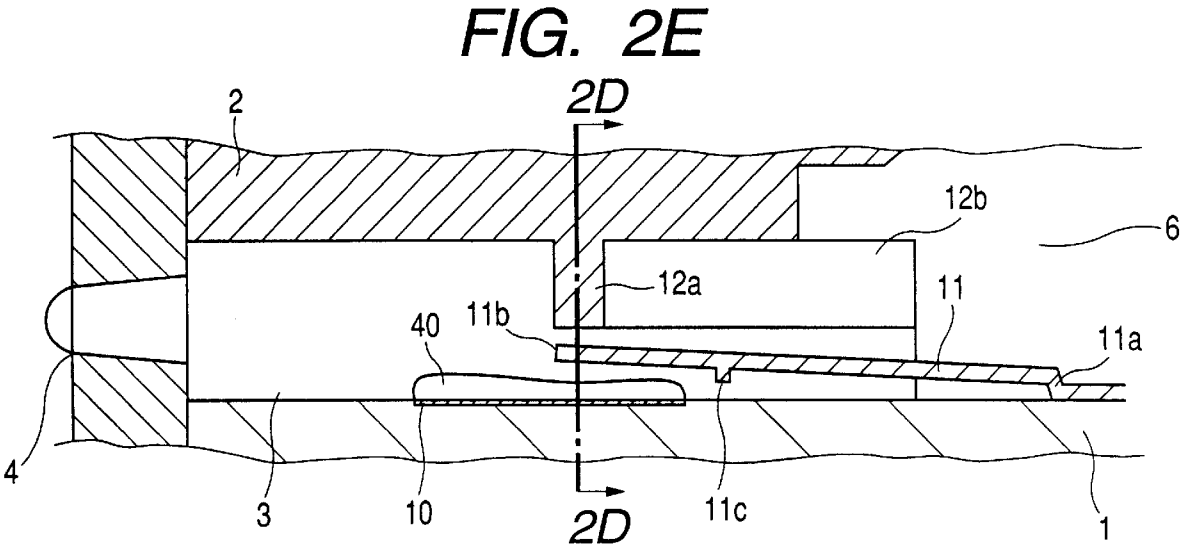
Figure 2D:
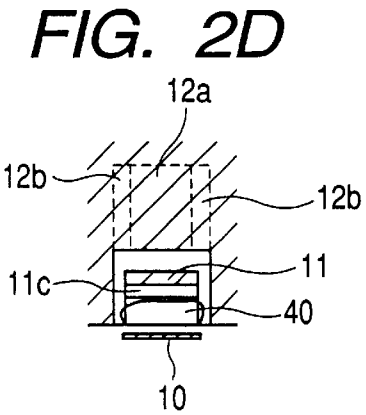
Figure 2G:
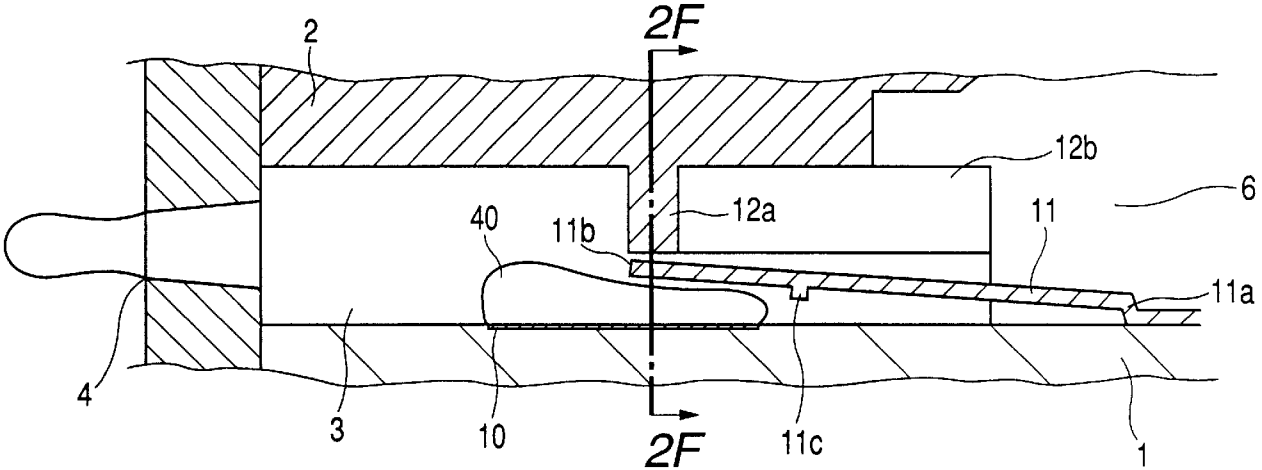
Figure 2F:
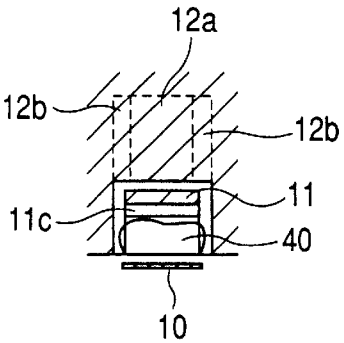
Figure 2I:
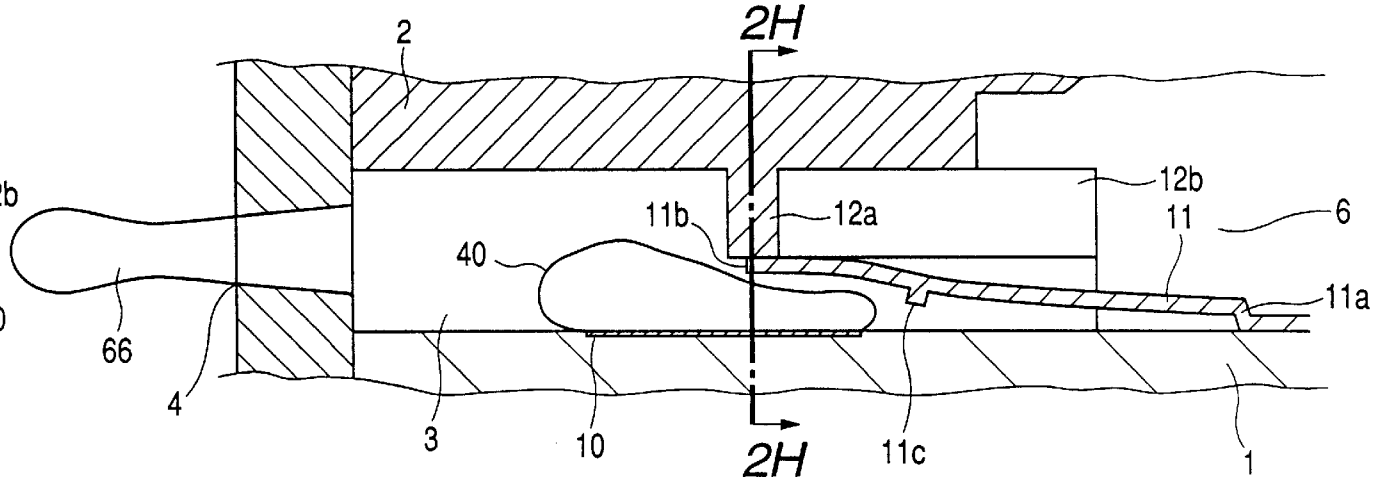
Figure 2H:
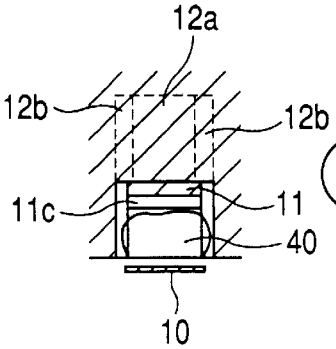
Figure 2K:
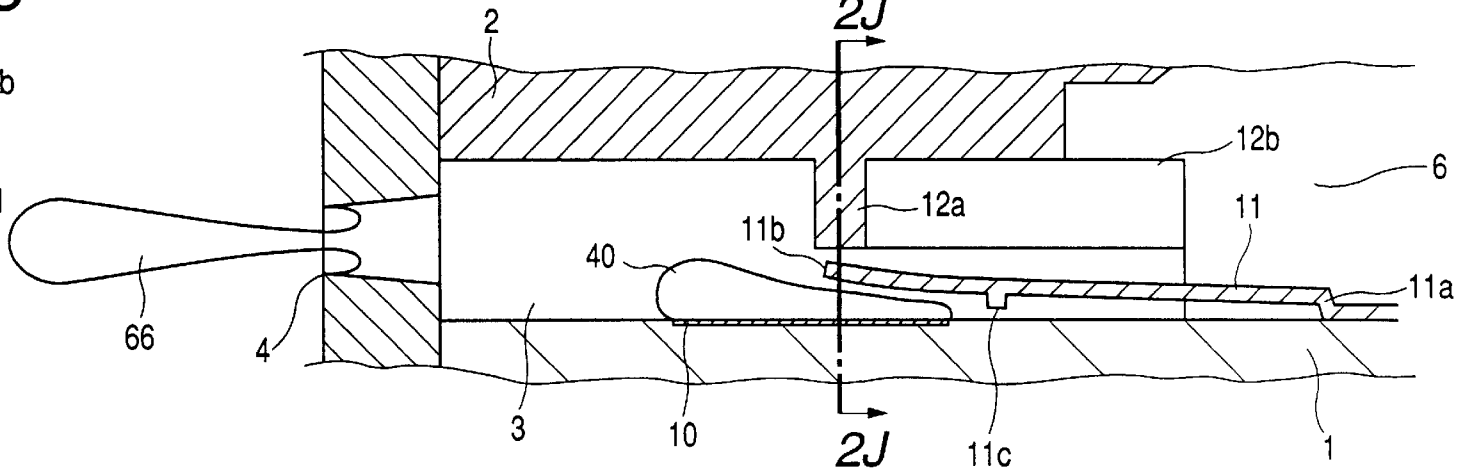
Figure 2J:
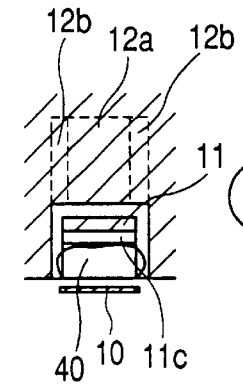
Figure 3C:
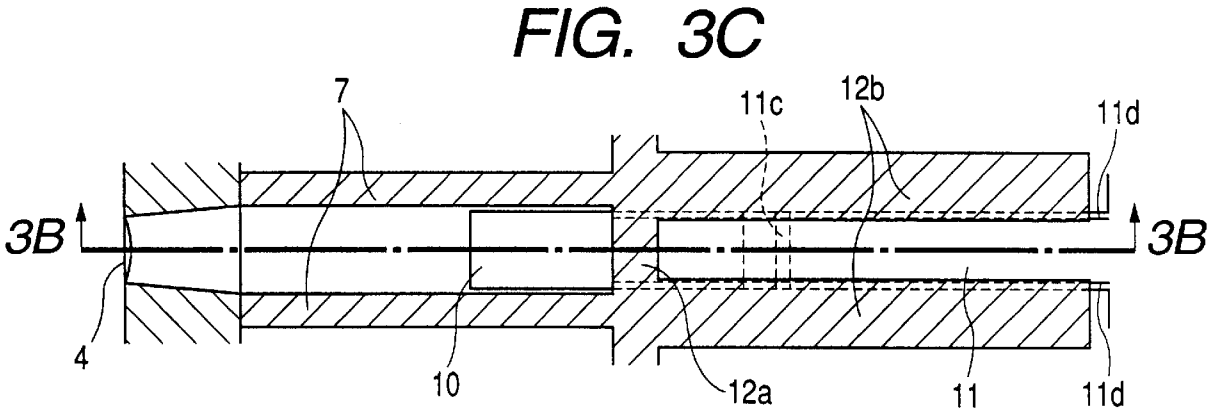
FIGS. 3A, 3B, 3C, 3D, 3E, 3F, 3G, 3H, 3I, 3J and 3K are schematic diagrams showing main members of a liquid discharging head of a third embodiment according to the present invention.
Figure 3B:
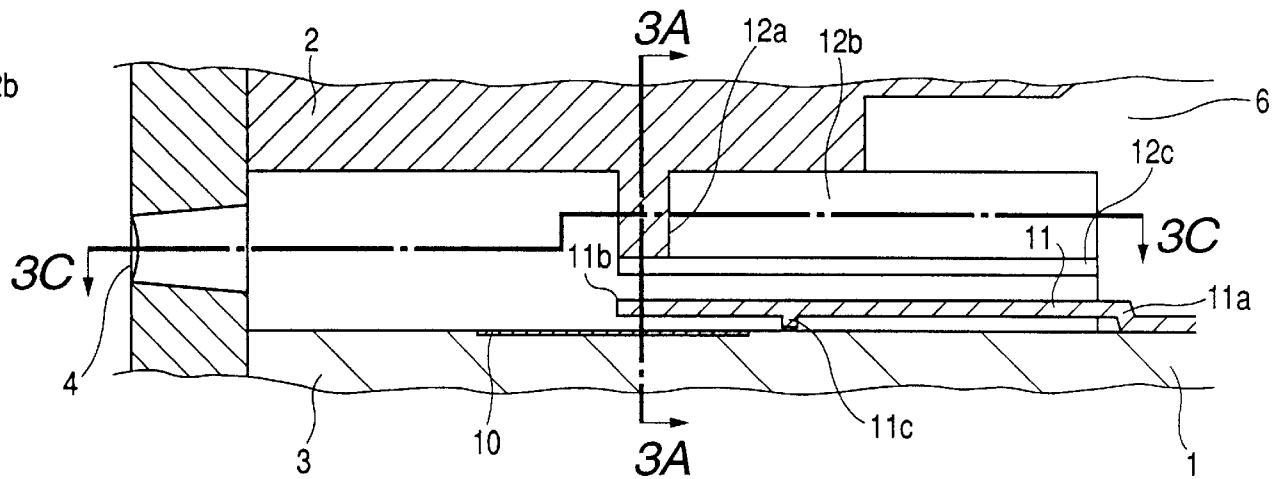
Figure 3A:
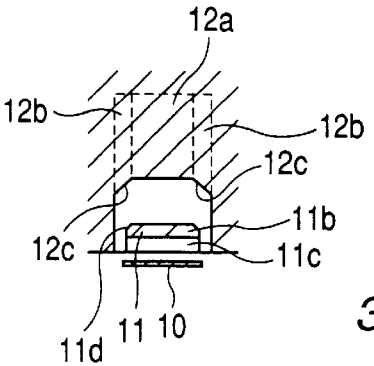
Figure 3E:
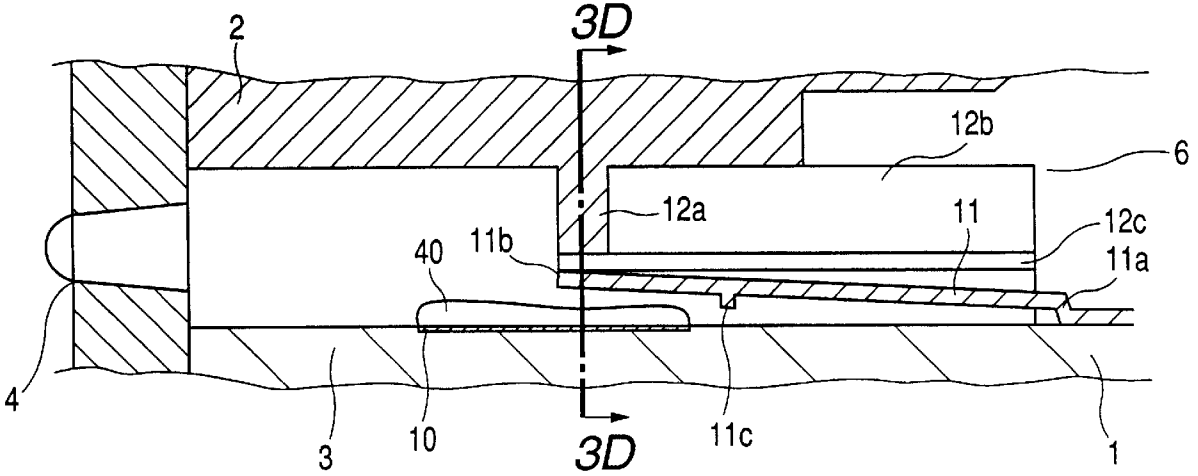
Figure 3G:
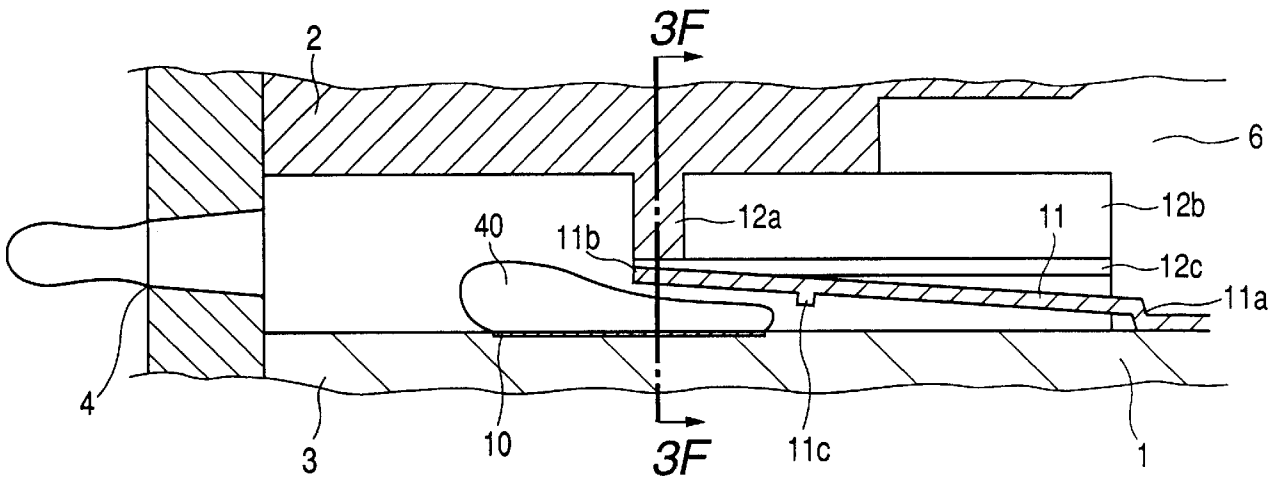
Figure 3D:
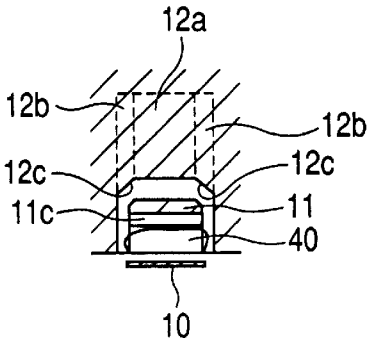
Figure 3F:
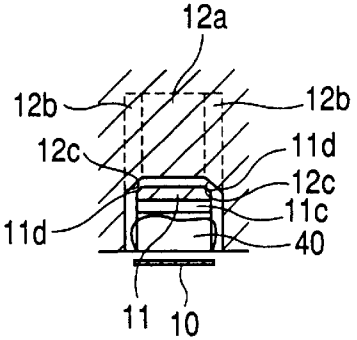
Figures 3H, 3I, 3J, 3K:
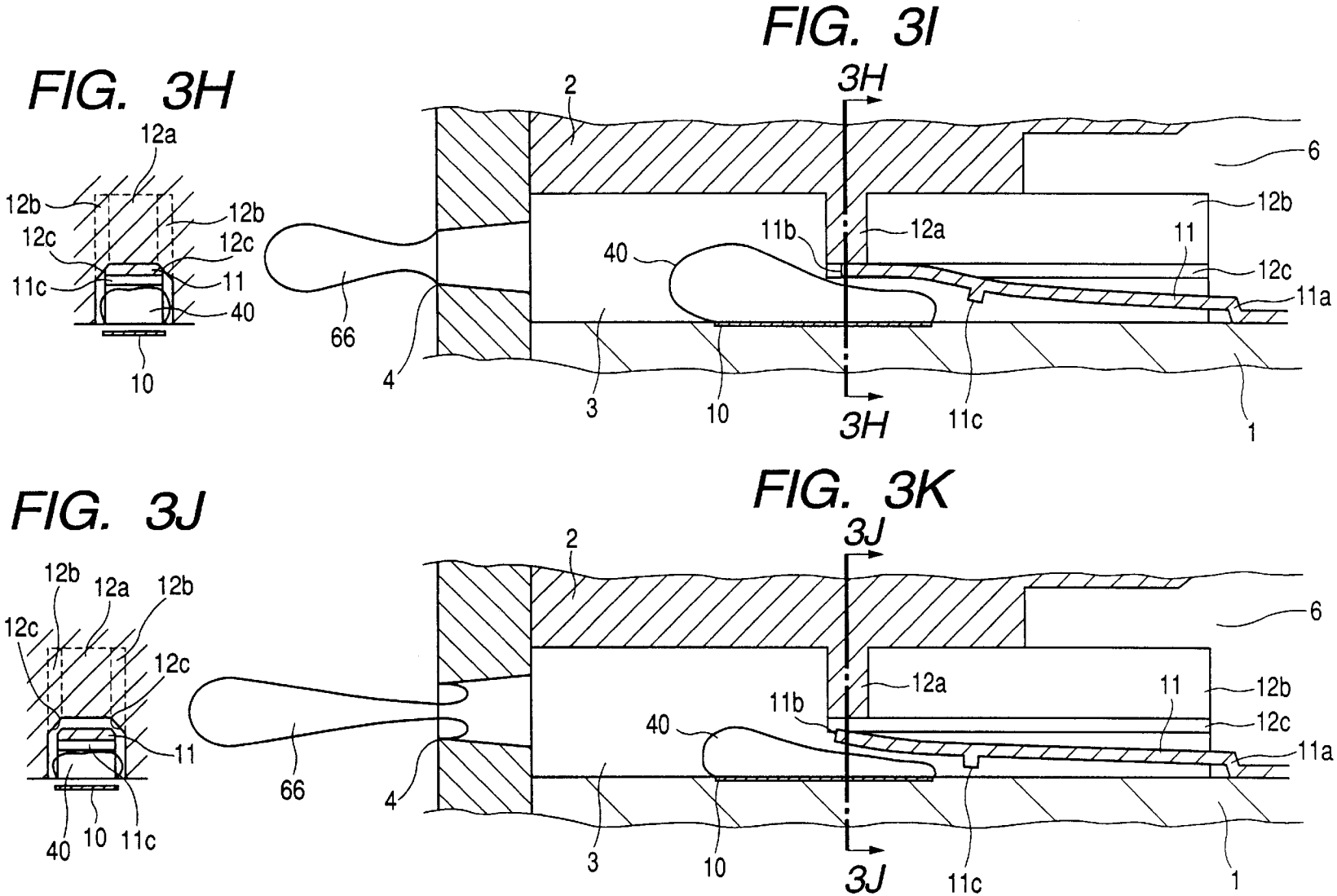
Figure 4C:
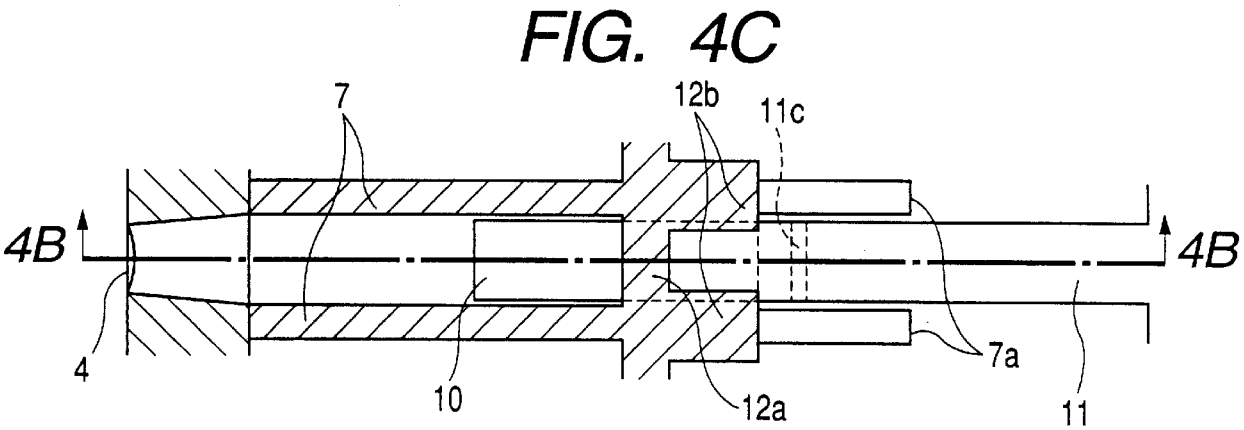
FIGS. 4A, 4B, 4C, 4D, 4E, 4F, 4G, 4H, 4I, 4J and 4K are schematic diagrams showing main members of a liquid discharging head of a fourth embodiment according to the present invention.
Figure 4B:
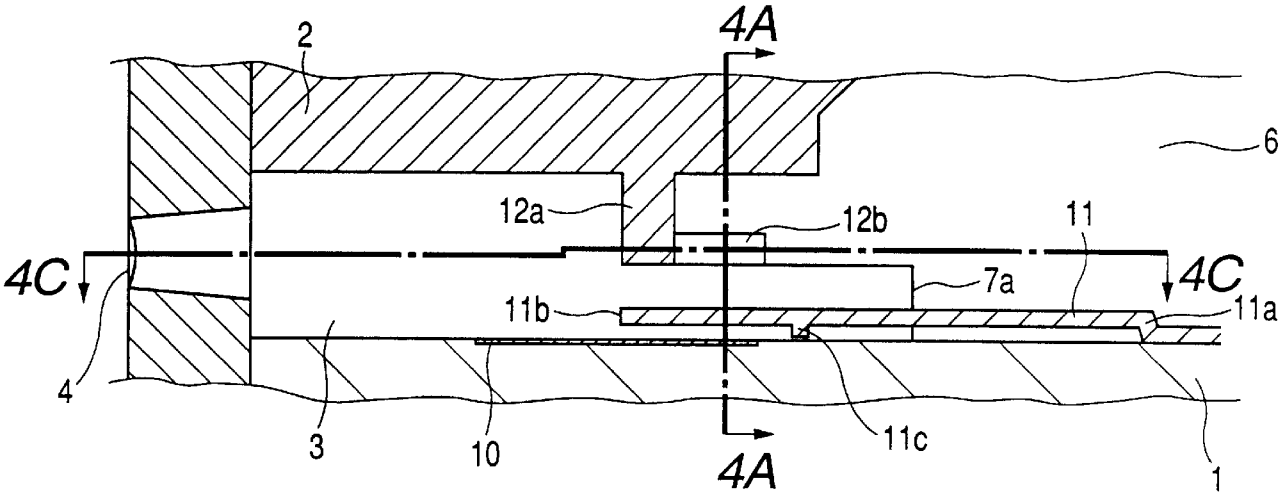
Figure 4A:
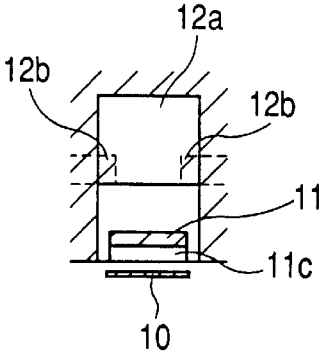
Figure 4E:
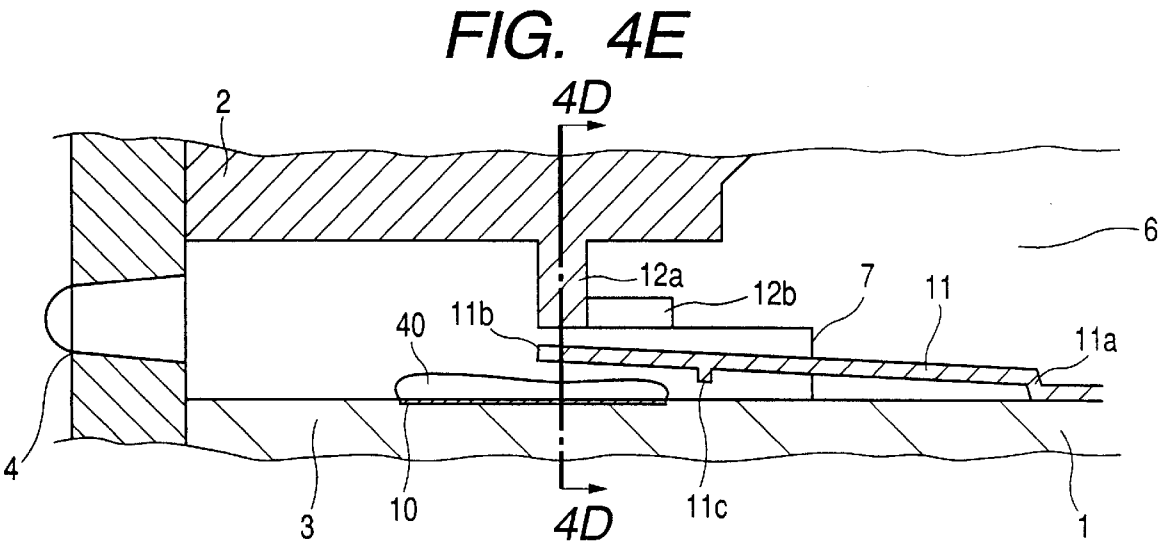
Figure 4G:
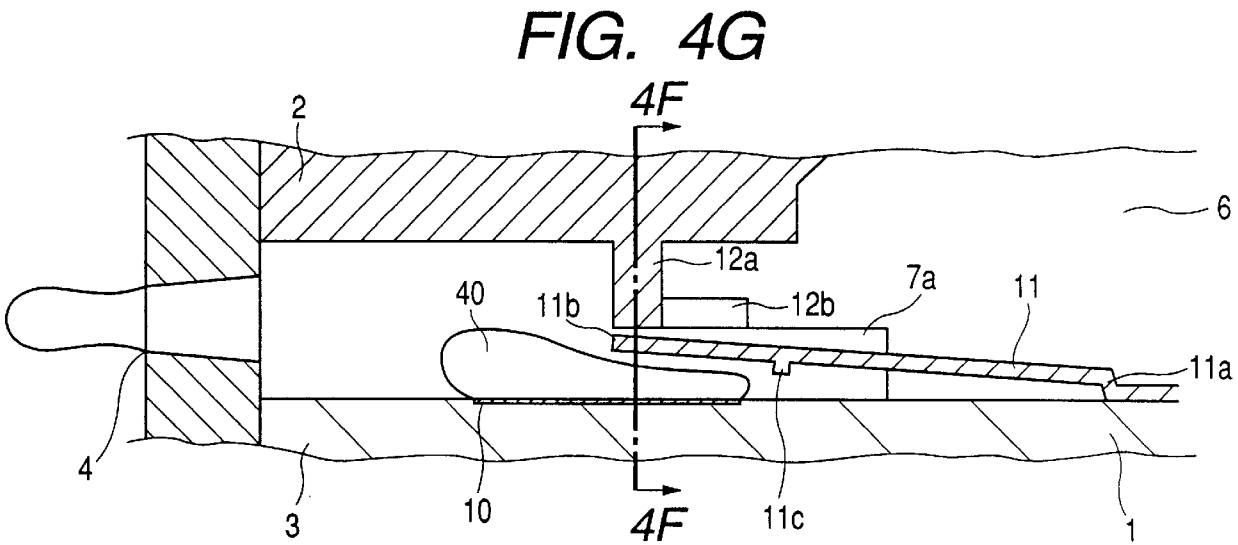
Figure 4D:
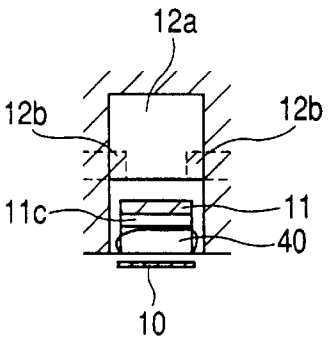
Figure 4F:
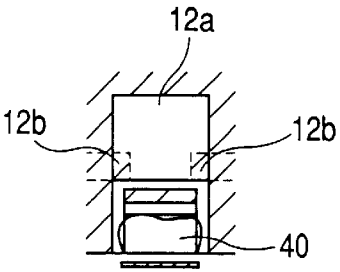
Figure 4I:
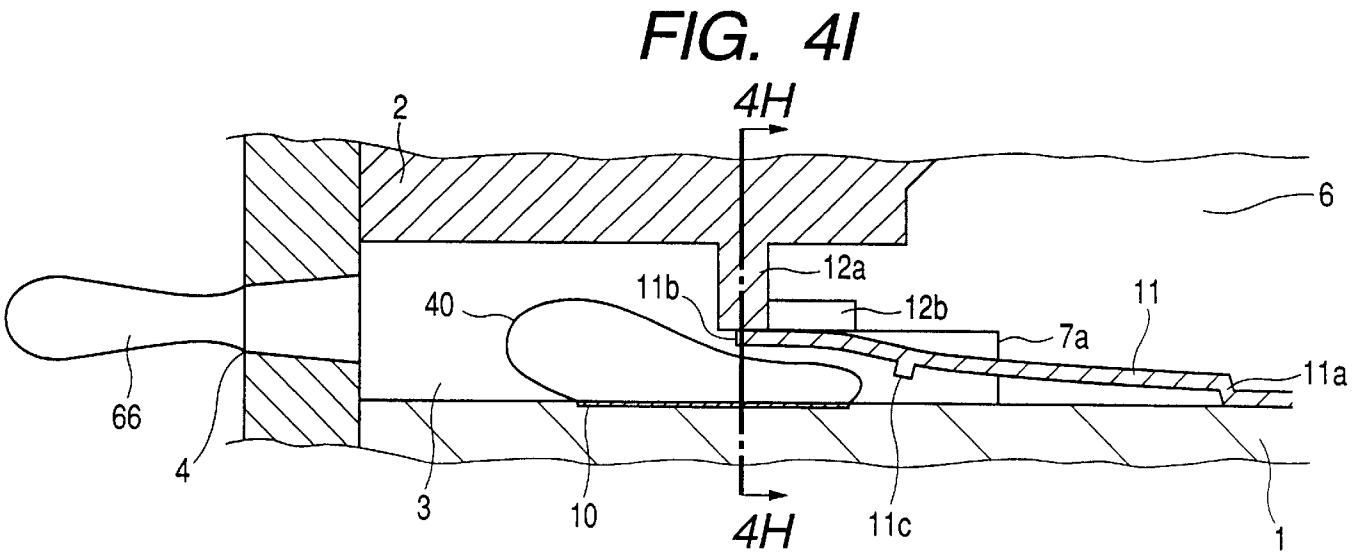
Figure 4H:
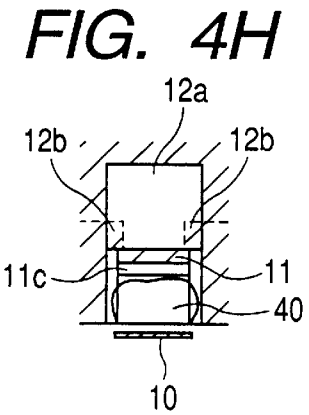
Figure 4K:
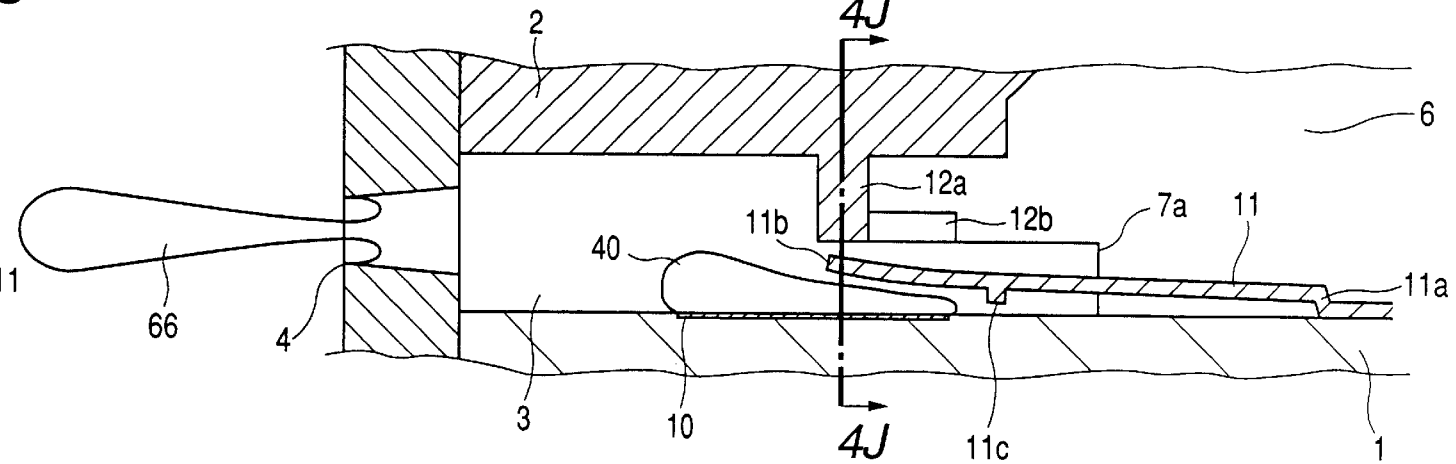
Figure 4J:
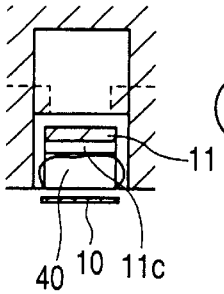

FIG. 1K shows a condition where a negative pressure in the air bubble overcomes the downstream liquid movement in the flow path after the film boiling described above and the air bubble 40 starts contracting.

As the air bubble contracts, the movable member displaces downward at a speed which is accelerated by a stress of itself as a cantilever and a stress charged by the upward convex deformation. Since the downward displacement of the movable member lowers resistance to a downward flow in a flow path region having low resistance, a large liquid flow goes into the flow path 3 by way of the tip stopper 12*a* and the side stopper 12*b*. A liquid in the liquid chamber is induced into the flow path by these operations. The liquid induced into the flow path passes between the stoppers and the movable member which is displaced downward, flows downstream the heat generating element and functions to accelerate breakage of the air bubble which has not been broken completely. After accelerating the breakage of the air bubble, the liquid further flows toward the discharging port and aids return of the meniscus, thereby enhancing a refilling speed.

Furthermore, the liquid flow which has passed into the flow path 3 from among the movable member 11, the tip stopper 12*a* and the side stopper 12*b* has a high flow velocity on a wall surface on a side of the ceiling plate 2 as shown in FIG. 1I, thereby containing an extremely small number of minute bubbles and contributing to discharging stabilization.

Furthermore, a point at which cavitation occurs due to the breakage of the air bubble is deviated downstream the air bubble producing region to lessen damage on the heat generating element. Simultaneously, this deviation lessens adhesion of scorched matters to the heater, thereby enhancing discharging stability.

Though the side stopper 12*b* is disposed in the ceiling plate 2 which is the opposed plate in the configuration described above, this configuration is not limitative and the side stopper 12*b* may be disposed only on the side wall 7.

Now, description will be made of methods to manufacture the liquid discharging head shown in FIGS. 1A to 1K.

The liquid discharging head shown in FIGS. 1A to 1K can be manufactured, for example, by a first or second manufacturing method described below.

(First manufacturing method)

FIGS. 5A to 5C, 6A to 6C, and 7A and 7B are diagrams descriptive of a method to form the movable member 11, the tip stopper 12*a*, the side stopper 12*b* and the side wall 7 of the flow path on the element substrate 1. The movable member 11, the tip stopper 12*a*, the side stopper 12*b* and the side wall 7 of the flow path are formed on the element substrate 1 through steps illustrated in FIGS. 5A to 5C, 6A to 6C, and 7A and 7B.

Figure 5A:
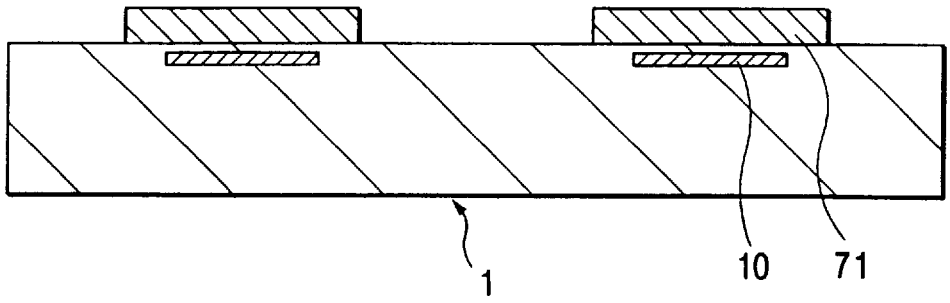
FIGS. 5A, 5B, 5C, 6A, 6B, 6C, 7A and 7B are diagrams descriptive of a method to form the movable member, the tip stopper, the side stopper and the side wall of the flow path on the element substrate.

In FIG. 5A first, a TiW film (not shown) approximately 5000 Å thick is formed over an entire surface of the element substrate 1 on a side of the exsothermic body 10 by a sputtering method as a first protective layer which protects a connecting pad portion for electrical connection to the heat generating element 10. To form a gap reserving member 71, a PSG (phosphosilicate glass) film approximately 5 $\mu$m thick is formed by the sputtering method on a surface of the element substrate 1 which is located on a side of the heat generating element 10. By patterning the formed PSG film through a known photolithography process, the gap reserving member 71 made of the PSG film which is used to reserve a gap between the element substrate 1 and the movable member 11 is formed at a location corresponding to the air bubble producing region between the heat generating element 10 and the movable member 11 shown in FIGS. 1A to 1K.

The gap reserving member 71 functions as an etching stop layer at a stage to form a liquid flow path 3*a* by dry etching using dielectric coupling plasma as described later. The gap reserving member 71 prevents the TiW layer as the pad protective layer on the element substrate 1, a Ta film as a cavitation resistant film and an SiN film as a protective layer on a resistor from being etched by an etching gas which is used to form the liquid flow path 3*a*. Accordingly, the gap reserving member 71 has a width broader than that of the liquid flow path 3*a* in the direction perpendicular to the flow path 3*a* so that the surface of element substrate 1 on the side of the heat generating element 10 and the TiW layer on the element substrate 1 will not be exposed at a stage of the dry etching to form the liquid flow path 3*a*.

Figure 5B:
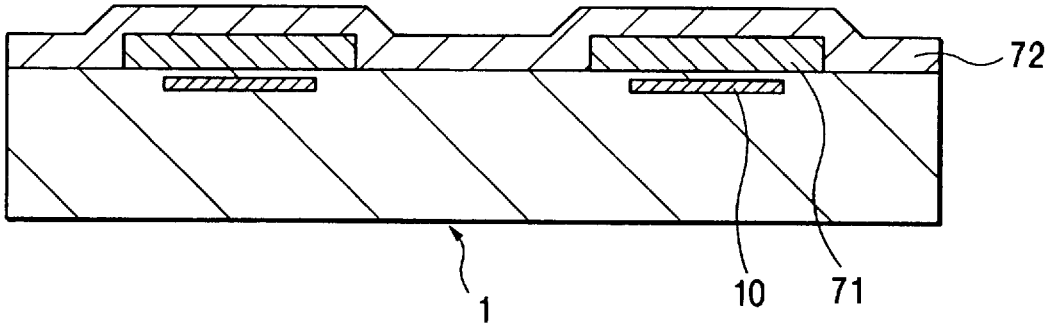

In FIG. 5B, an SiN film 72 approximately 5 $\mu$m thick which is a material film to form the movable member 11 is formed by a plasma CVD method on a surface of the gap reserving member 71 and a surface of the element substrate 1 on a side of the gap reserving member 71.

Figure 5C:
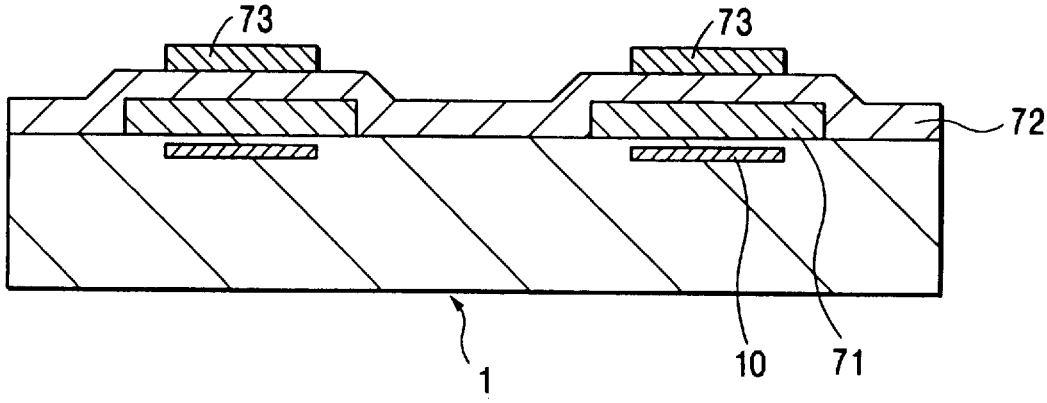

In FIG. 5C, an etching resistant protective film is formed on a surface of the SiN film 72 and then the etching resistant protective film is patterned by the known photolithography process to leave an etching resistant protective film 73 on an area of the surface of the SiN film 72 corresponding to the movable member 11. The etching resistant protective film 73 is used as a protective layer (etching stop layer) at a stage to form the liquid flow path 3*a* by etching.

Figure 6A:
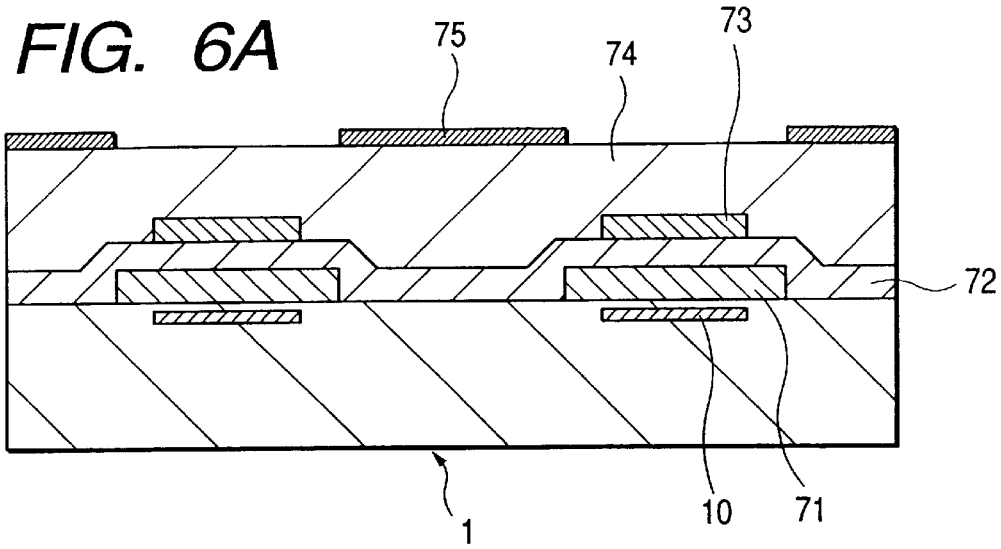

In FIG. 6A, an SiN film 74 approximately 20 $\mu$m thick which is to be used for forming the side wall 7 of the flow path is formed by a microwave CVD method on the surfaces of the SiN film 72 and the etching resistant protective film 73. Monosilane ($SiH_4$), nitrogen ($N_2$ and argon (Ar) are used as gases to form the SiN film 74 by the microwave CVD method. The combination of gases mentioned above may be replaced with a combination of disilane ($Si_2H_6$) and ammonia ($NH_3$) or a mixture gas. The SiN film 74 is formed under a high vacuum pressure of 5 [mTorr] with a microwave having a frequency of 2.45 [GHZ] and a power of 1.5 [kW] while supplying monosilane, nitrogen and argon at rates of 100 [sccm], 100 [sccm] and 40 [sccm] respectively. The SiN film 74 may be formed by a microwave plasma CVD method which uses a different ratio of gas components, the CVD method which uses an RF power source or the like.

After an etching mask layer is formed over an entire surface of the SiN film 74, the etching mask layer is patterned by a known method such as photolithography, thereby leaving an etching mask layer 75 at an area other than that corresponding to the liquid flow path 3*a* on the surface of the SiN film 74.

Figure 6B:
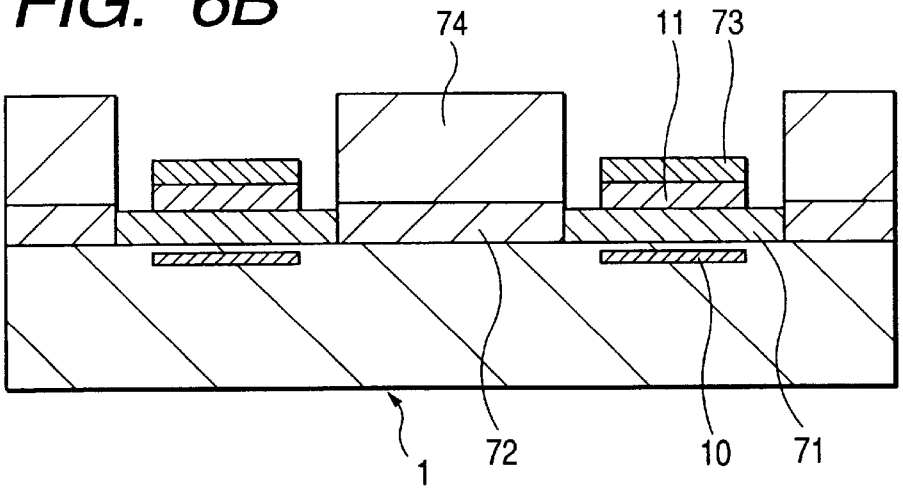

In FIG. 6B, the SiN film 74 and the SiN film 72 are patterned by oxygen plasma etching. In this case, the SiN film 74 and the SiN film 72 are etched so that the SiN film 74 has a trench structure using the etching resistant protective film 73, the etching mask layer 75 and the gap reserving member 71 as the etching stop layers.

Figure 6C:
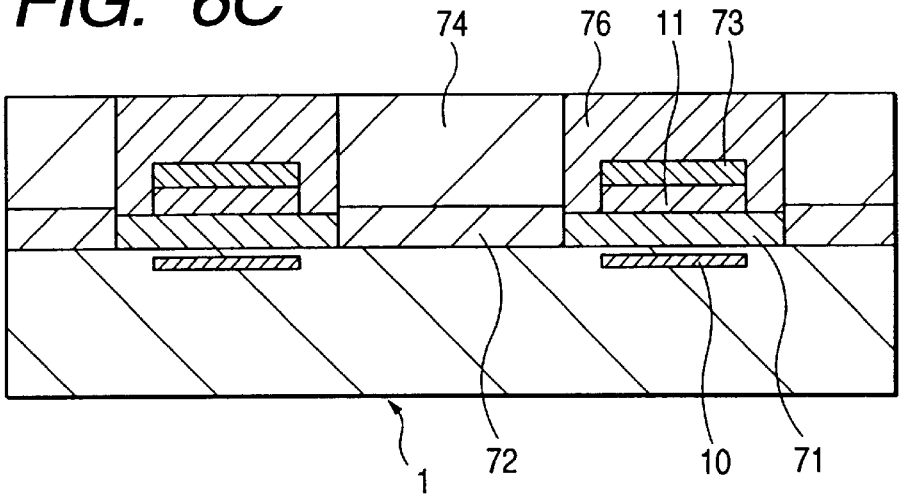

In FIG. 6C, a thick resist is applied to the surfaces of the SiN film 74 and the etching resistant protective film 73, and a surface of the thick resist is flattened by CMP (chemical mechanical polishing) or the like to form a space for displacement of the movable member 11 or fill a space remaining after removing the SiN film 74.

Figure 7A:
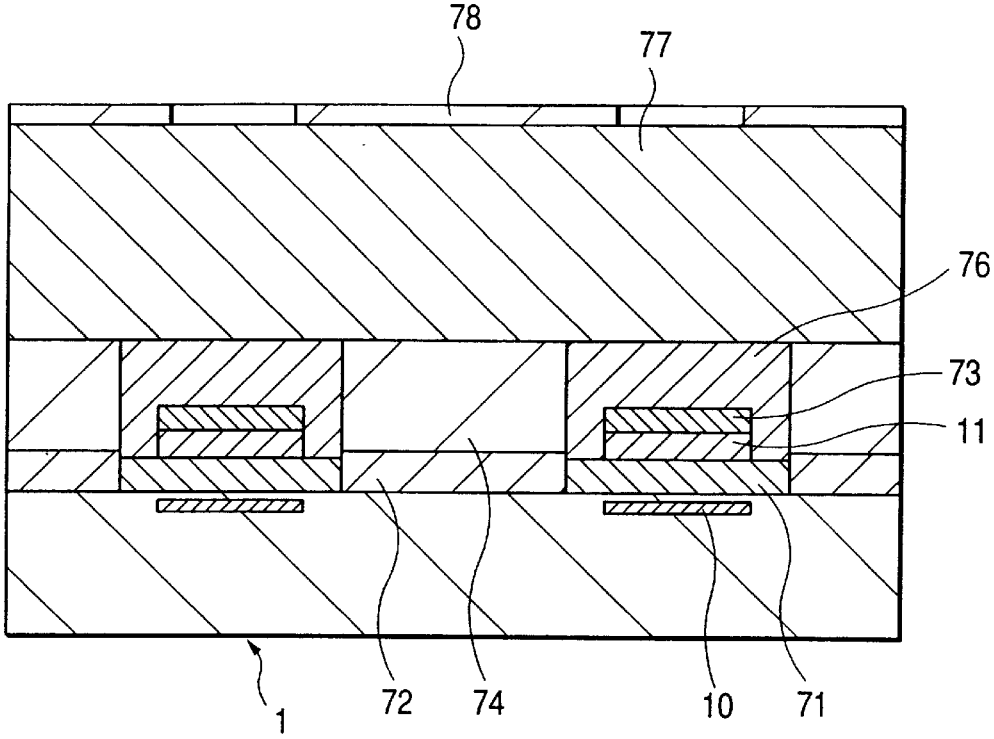

In FIG. 7A, a resin film 77 is coated to a thickness of approximately 30 $\mu$m to form the tip stopper 12*a*, the side stopper 12*b* and the side wall 7 of the flow path. An etching mask 78 is formed on a surface of the resin film 77. The etching mask 78 is configured to remain at areas corresponding to the side wall 7 of the flow path, the tip stopper 12*a* and the side stopper 12*b*.

Figure 7B:
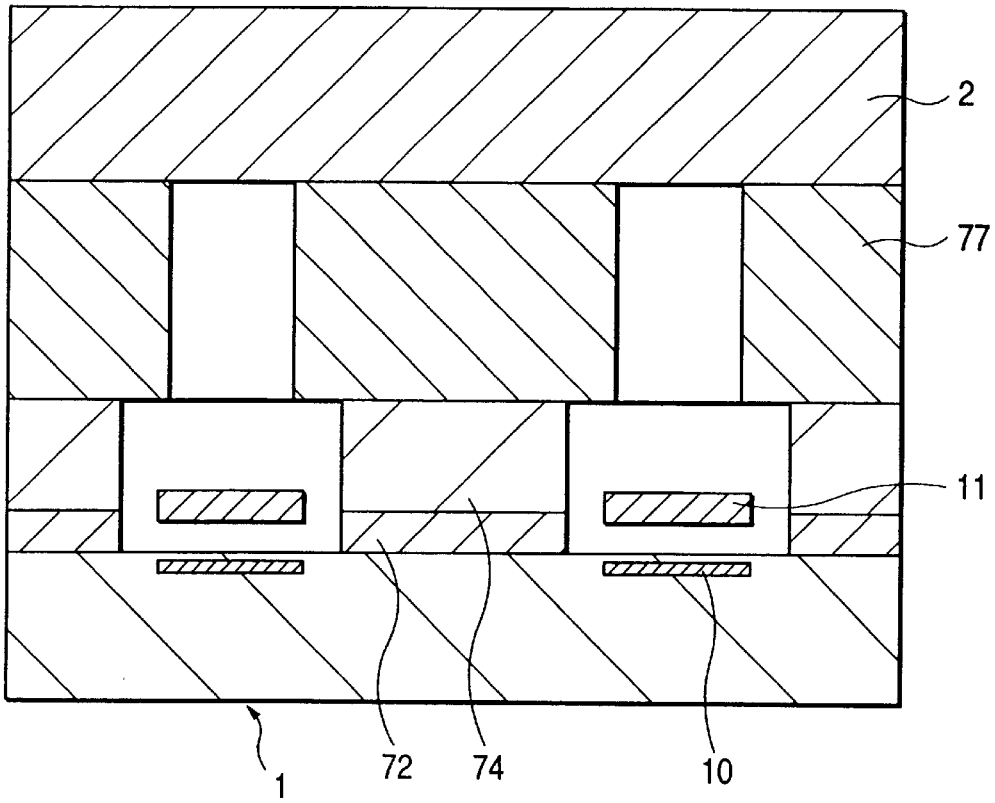

In FIG. 7B, the resin film 77 is etched so that it has a trench structure. Then, an etching mask 78, the etching resistant protective film 73 and the gap reserving member 71 are removed by etching while heating with a mixture of acetic acid, phosphoric acid and nitric acid, thereby forming the movable member 11 and the side wall 7 of the flow path on the element substrate 1. Subsequently, portions of the TiW film formed as the pad protective layer on the element substrate 1 which correspond to the air bubble producing region 10 and the pad are removed using hydrogen peroxide. After the movable member 11, the tip stopper 12*a*, the side stopper 12*b* and the side wall 7 of the flow path have been formed on the element substrate 1 as described above, the ceiling plate 2 is joined to a surface of the element substrate 1 which is located on a side of the side wall 7 of the flow path. The liquid discharging head shown in FIGS. 1A to 1K is manufactured in this way.

The method to manufacture the liquid discharging head preferred as the first embodiment makes it possible to form the tip stopper 12*a* and the side stopper 12*b* with high precision and at a high density, thereby manufacturing a liquid discharging head which is highly precise and reliable.

(Second manufacturing method)

FIGS. 8A to 8F are diagrams illustrating steps descriptive of a second method to manufacture the liquid discharging head according to the present invention.

Figure 8A:
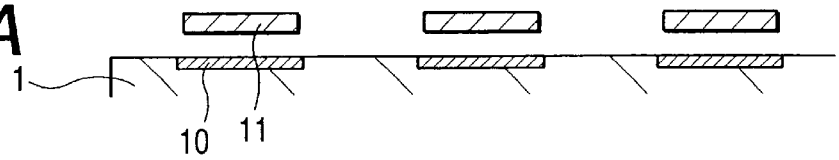
FIGS. 8A, 8B, 8C, 8D, 8E and 8F are diagrams illustrating steps descriptive of a second method to manufacture the liquid discharging head according to the present invention.

First, the movable member 11 is preliminarily formed of silicon nitride or a similar material on the substrate 1 which is equipped with the heat generating element 10 (FIG. 8A).

Figure 8B:
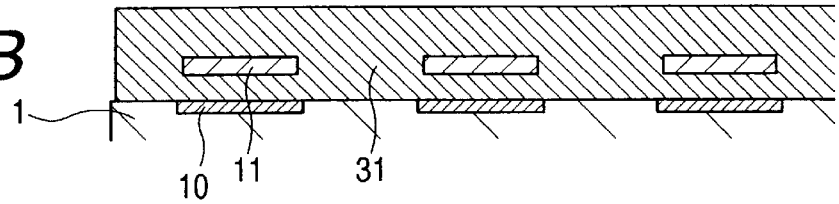

Then, a dissolvable resin layer 31 which is thick enough to cover the movable member 11 is formed on the substrate 1 (FIG. 8B). In the first embodiment, the dissolvable resin layer 31 which is 20 $\mu$m thick is formed of a positive resist.

Figure 8C:
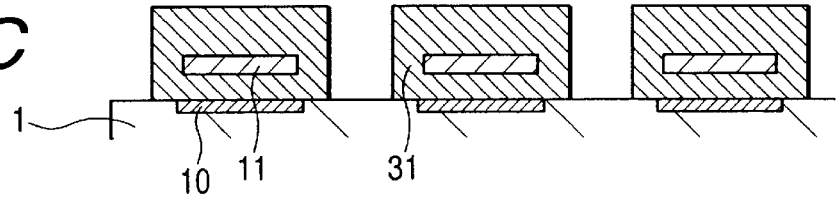

The dissolvable resin layer 31 is patterned by the photolithography so as to leave a portion which forms a liquid flow path (FIG. 8C).

Figure 8D:
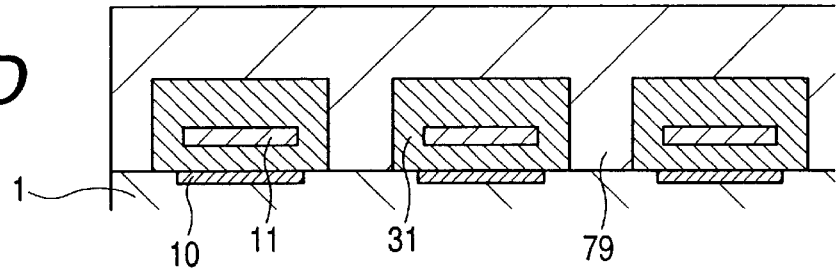

Then, a covering resin layer 79 is formed to cover the dissolvable resin layer 31 (FIG. 8D). In the first embodiment, an epoxy resin containing a cation polymerization initiator which is a negative resist is used to form the covering resin layer.

Figure 8E:
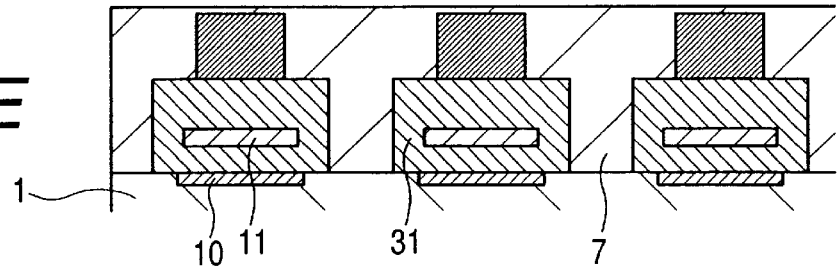

A portion of the covering resin layer 79 which corresponds to the liquid flow path is removed by the photolithography (FIG. 8E). At this stage, the removed portion of the covering resin layer 79 is configured so as to have a width which is narrower than a width of the dissolvable resin layer 31 and narrower than a width of the movable member 11. A step structure which functions as the side stopper 12*b* described above is formed in the liquid flow path 3*a* by configuring the removed portion as described above.

Figure 8F:
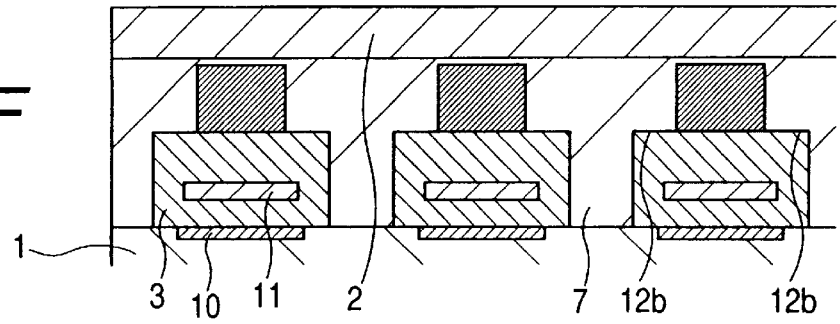

Subsequently, the liquid flow path 3*a* which comprises the movable member 11 is formed by dissolving the dissolvable resin layer 31. Finally, the liquid discharging head which has the movable member 11 and the side stopper 12*b* is completed by joining the opposed plate 2 to a surface of the covering resin layer 79 which has an opening (FIG. 8F).

(Third manufacturing method)

FIGS. 9A to 9E are diagrams showing steps descriptive of the third manufacturing method of the liquid discharging head according to the present invention.

Figure 9A:
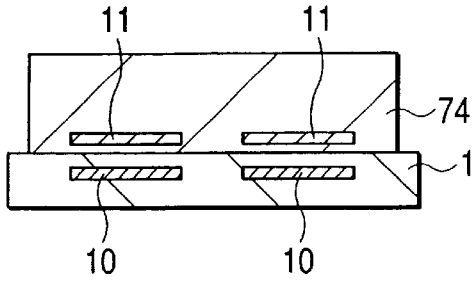
FIGS. 9A, 9B, 9C, 9D and 9E are diagrams illustrating steps descriptive of a third method to manufacture the liquid discharging head according to the present invention.

First, the movable member 11 is made of silicon nitride or the like material on the substrate 1 which is equipped with the heat generating element 10 and a resin layer 74 is formed on the substrate 1 to a thickness covering the movable member 11 (FIG. 9A). In the first embodiment, the resin layer 74 is made of a negative resist to a thickness of 20 $\mu$m.

Figure 9B:
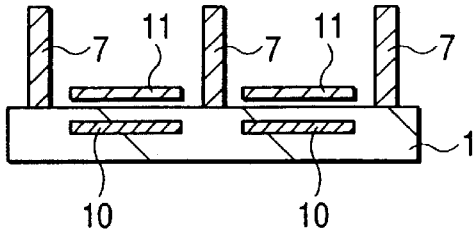

Then, a portion of the resin layer 74 is removed by the photolithography to form a liquid flow path (FIG. 9B).

Figure 9C:
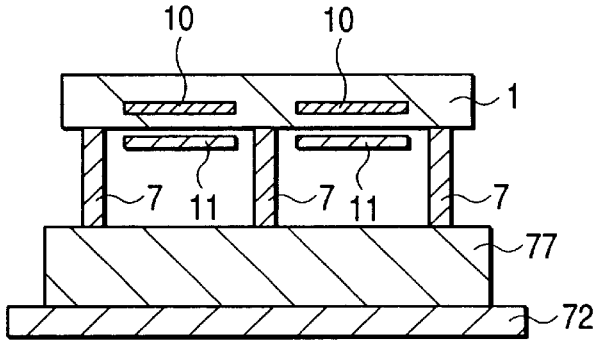

A dry film 77 30 $\mu$m thick is prepared on a separate jig 72 and the substrate 1 is joined with this dry film to bring the resin layer 74 into contact with the dry film (FIG. 9C).

Figure 9D:
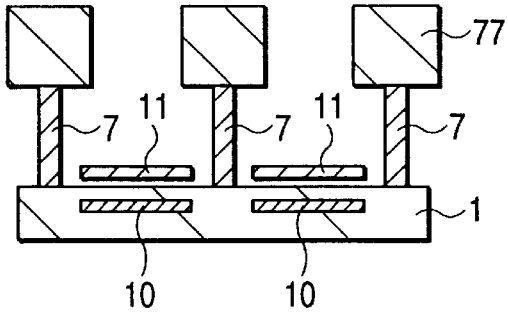
Figure 9E:
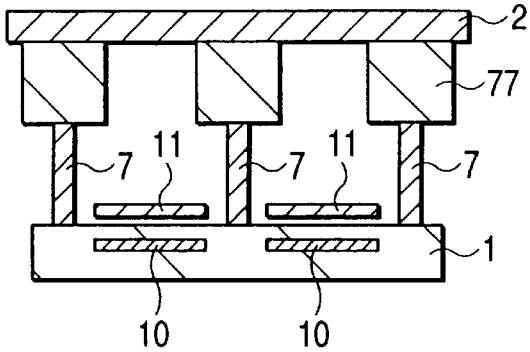

After preliminarily baking the dry film in this condition, an opening which has a width narrower than a width of an opening formed in the resin layer 74 and narrower than a width of the movable member 11 is formed in a portion of the dry film which corresponds to the liquid flow path of the dry film (FIG. 9D). A step structure which functions as the side stopper 12*b* is formed in the liquid flow path 3*a* by forming the opening functioning as the liquid flow path by the photolithography.

Finally, the liquid discharging head which has the movable member 11 and the side stopper 12*b* is completed by joining the opposed plate 2 to a surface of the dry film 77 which has an opening.

(Second embodiment)

FIGS. 2A to 2K are schematic diagrams showing the second embodiment of the present invention. FIGS. 2A to 2K correspond to FIGS. 1A to 1K and members of the second embodiment which are similar to those of the first embodiment will not be described in particular.

Different from the first embodiment, the second embodiment adopts a convexity 11*c* (hereinafter referred to simply as a lower convexity) which is formed on the movable member at a location in the vicinity of the air bubble producing region and protrudes toward the substrate. The lower convexity 11*c* is adopted to suppress rearward (upstream) growth of a bubble produced in the air bubble producing region and thereby allows the air bubble to grow less than that in the first embodiment as shown in FIGS. 2E to 2K. The lower convexity 11*c* serves to enhance a discharging energy by suppressing the rearward growth of the air bubble.

Since the lower convexity 11*c* may be brought into contact with the substrate 1 at a stage where the movable member 11 is displaced toward the substrate, it is desirable to dispose the lower convexity 11*c* at a location at least apart from the step around the heat generating element 10. Speaking more concretely, it is desirable to dispose the lower convexity 11*c* at a location which is apart from an effective air bubble producing region for a distance of 5 $\mu$m or longer. Furthermore, it is desirable to dispose the lower convexity 11*c* at a location which is apart from the effective air bubble producing region for a distance up to half a length of the heat generating element 10 since it cannot exhibit an effect to suppress the rearward growth of the air bubble when it is apart too far from the air bubble producing region. Speaking concretely, the distance is approximately 45 $\mu$m, preferably shorter than 30 $\mu$m preferably 20 $\mu$m or shorter in the second embodiment.

Furthermore, the lower convexity 11*c* has a hight which is equal to or shorter than a distance between the movable member 11 and the element substrate 1 and a slight clearance is reserved between a tip of the lower convexity 11*c* and the element substrate 1 in the second embodiment.

The lower convexity 11*c* prevents the air bubble produced in the air bubble producing region from being elongated upstream between the movable member 11 and the element substrate 1, and reduces upward movement of the liquid, thereby resulting in enhancement of a refilling capability.

Description will be made below of a method to manufacture the movable member having the lower convexity used in the second embodiment.

Figure 10A:
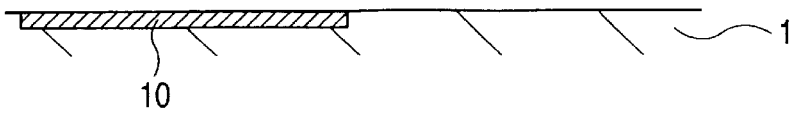
FIGS. 10A, 10B, 10C, 10D, 10E, 10F and 10G are views illustrating a method to manufacture the movable member having the lower convexity used in the second embodiment.

In FIG. 10A first, a TiW film 5000 Å thick is formed by the sputtering method over the entire surface of the element substrate 1 on a side of the heat generating element 10 as a first protective layer for protecting a connecting pad portion which is used for electrical connection to the heat generating element 10.

Figure 10B:
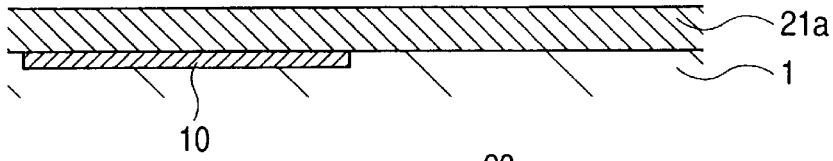

In FIG. 10B, an Al film approximately 4 $\mu$m thick is formed by the sputtering method on a surface of the TiW film to form a gap reserving member 21*a*.

Figure 10C:
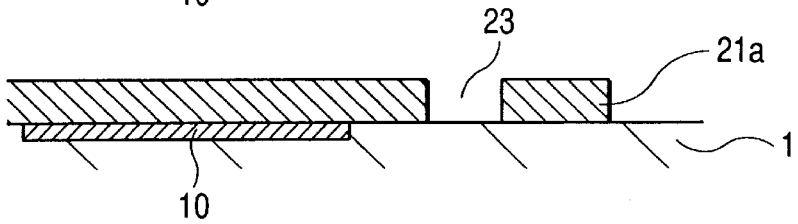

In FIG. 10C, the formed Al film is patterned by the known photolithography process to remove a portion of the Al film which corresponds to the supported or fixed portion of the movable member 11 and another portion 23 which corresponds to the lower convexity of the movable member, thereby forming the gap reserving member 21*a*. The portion 23 which corresponds to the lower convexity of the movable member is removed so as to form an opening of 6 μm.

Figure 10D:
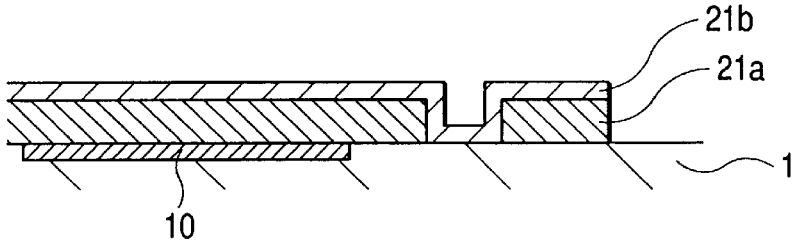

In FIG. 10D, another Al film approximately 1 μm is formed by the sputtering method. A gap reserving member 21*b* is formed over a surface of the TiW film by removing only a portion of this Al film which corresponds to the supporting-fixing portion of the movable member 11. Accordingly, a portion of the surface of the TiW film which corresponds to the supporting-fixing portion of the movable member 11 is exposed. The gap reserving members 21*a* and 21*b* are composed of the Al films for reserving a gap between the element substrate 1 and the movable member 11. These Al films are formed over the entire surface of the TiW film including a location corresponding to the air bubble producing region 10 between the heat generating element 10 and the movable member 11, except for a portion which corresponds to the supporting-fixing portion of the movable member 11. That is, the manufacturing method forms the gap reserving members 21*a* and 21*b* over the surface of the TiW film including a portion which corresponds to the side wall of the flow path.

The gap reserving members 21*a* and 21*b* function as etching stop layers at a stage to form the movable member 11 by the dry etching, as described later. The gap reserving members 21*a* and 21*b* are formed over the element substrate 1 to prevent the TiW layer, a Ta film as a cavitation resistant film on the element substrate 1 and an SiN film as a protective layer on a resistor from being etched by an etching gas used to form the liquid flow path 3. Accordingly, the surface of the TiW film is not exposed at a stage to form the movable member 11 by dry etching the SiN film, and the gap reserving member 21*a* prevents the TiW film and a function element in the element substrate 1 from being damaged by dry etching the SiN film.

Figure 10E:
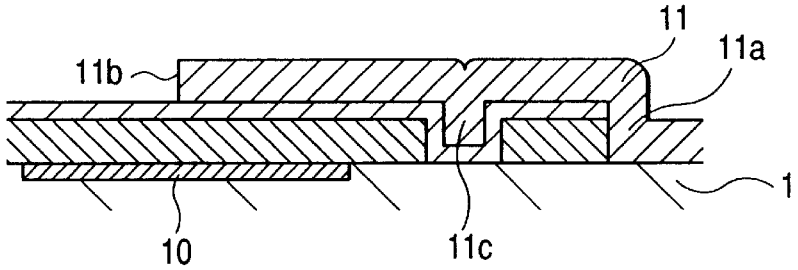

In FIG. 10E, an SiN film 22 approximately 5 μm thick is formed by the plasma CVD method as a material film for forming the movable member 11 over entire surfaces of the gap reserving members 21*a* and 21*b* as well as over an entire exposed surface of the TiW film so as to cover the gap reserving members 21*a* and 21*b*. After forming an Al film approximately 6100 Å thick on a surface of the SiN film 22 by the sputtering method, the Al film is patterned by the known photolithography process to leave an Al film (not shown) as a second protective layer on a portion of the surface of the SiN film 22 which corresponds to the movable member 11. The Al film left as the second protective layer serves as a protective layer (etching stop layer), or a mask, at a dry etching stage of the SiN film 22 to form the movable member 11. Utilizing the second protective layer as a mask, the movable member 11 is composed of the left portion of the SiN film 22 by patterning the SiN film 22 with am etching apparatus which uses dielectric coupling plasma. The etching apparatus uses a mixture gas of $CF_4$ and $O_2$, and at the step of patterning SiN film 22 removes an unnecessary portion of the SiN film 22 so that a supporting-fixing portion of the movable member 11 is fixed directly to the element substrate 1. A material of the supporting fixing portion of the movable member 11 and a portion thereof which is in close contact with the element substrate 1 contains TiW and Ta which are materials of the pad protective layer and the cavitation resistant film of the element substrate 1.

Since the gap reserving members 21*a* and 21*b* have been formed on portions which are exposed by removing the unnecessary portion of the SiN film 22 at the etching step, or region to be etched, as described above, the surface of the TiW film is not exposed and the element substrate 1 is protected securely with the gap reserving members 21*a* and 21*b*.

Figure 10F:
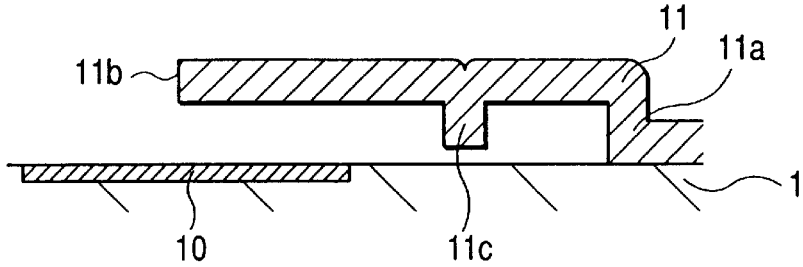

In FIG. 10F, the movable member 11 is shaped on the element substrate 1 by eluting to remove the second protective layer and the gap reserving members 21*a* and 21*b* composed of the Al film formed on the movable member 11 using a mixture acid of acetic acid, phosphoric acid and nitric acid. Then, portions corresponding to the air bubble producing region 10 and the pad of the TiW film formed on the element substrate 1 are removed using hydrogen peroxide.

Figure 10G:
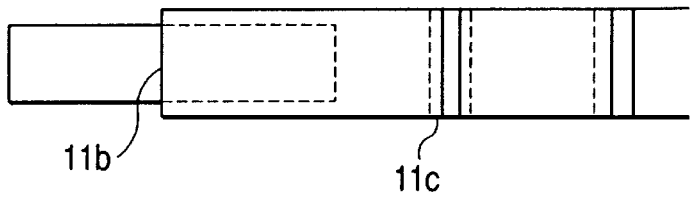

FIG. 10G is a top view of the element substrate shown in FIG. 10F.

Though the manufacturing method described with reference to FIGS. 10A to 10G is configured to remove the portions of the two Al films corresponding to the supporting-fixing portion of the movable member 11 respectively, these portions of the two Al films may be removed at a time after the two Al films have been formed. In such a case, the Al films can be patterned at a time, thereby eliminating a fear that the Al films may be deviated from each other by patterning.

Though the second embodiment comprises both the lower convexity and the side stopper as a preferable configuration, the lower convexity can exhibit a sufficient effect to restrict the rearward growth of the air bubble for favorable liquid discharge even when the side stopper is not used.

(Third embodiment)

FIGS. 3A to 3K are diagrams illustrating the third embodiment of the present invention. Since FIGS. 3A to 3K are shown so as to correspond to FIGS. 1A to 1K, components of the third embodiment which are similar to those of the first embodiment will not be described in particular.

Different from the second embodiment, the third embodiment has a tapered portion 11*d* which is formed at a side end of the movable member 11 and a tapered portion 12*c* which is formed at a contact location of the side stopper 12*b* with the movable member 11 so that the tapered portion 12*c* is brought into close contact with the tapered portion 11*d*.

Like the second embodiment, the third embodiment restricts displacement of movable member 11 with the side stopper 12*b* and, corrects positional deviations of the side stopper 12*b* and the movable member 11 in a lateral direction using the tapered portions 11*d* and 12*c* as guides to bring these members into contact with each other at an optimum location, and brings the tapered portions 11*d* and 12*c* into closer contact with each other, thereby enhancing the liquid movement restricting effect and the refilling characteristic.

(Fourth embodiment)

FIGS. 4A to 4K are diagrams illustrating the fourth embodiment of the present invention. Since FIGS. 4A to 4K are shown so as to correspond to FIGS. 1A to 1K, components of the fourth embodiment which are similar to those of the first embodiment will not be described in particular. In contrast to the first through third embodiments wherein the side stopper 12*b* is continuous from the ceiling plate 2 which is the opposed plate, the fourth embodiment adopts a side stopper 12*b* configured as a portion protruding like a visor from a course of the side wall 7 and having a length which does not extend upstream the liquid flow path 3 and shorter than the liquid flow path 3, but extends from around a middle of the heat generating element 10 to a point about 20 μm to an upstream end of the heat generating element 10.

Accordingly, the side stopper 12*b* exhibits its effect while occupying a space which is minimum in vertical and longitudinal directions or reserving a wide space to be used as a wide flow path, whereby the fourth embodiment is capable of remarkably reducing resistance to a fluid from the common liquid chamber and further enhancing the refilling characteristic. Furthermore, since the lower convexity 11*c* suppresses the rearward growth of the air bubble, the air bubble extends to a region wherein the side stopper 12*b* is not disposed and exhibits its shielding effect.

Figure 11:
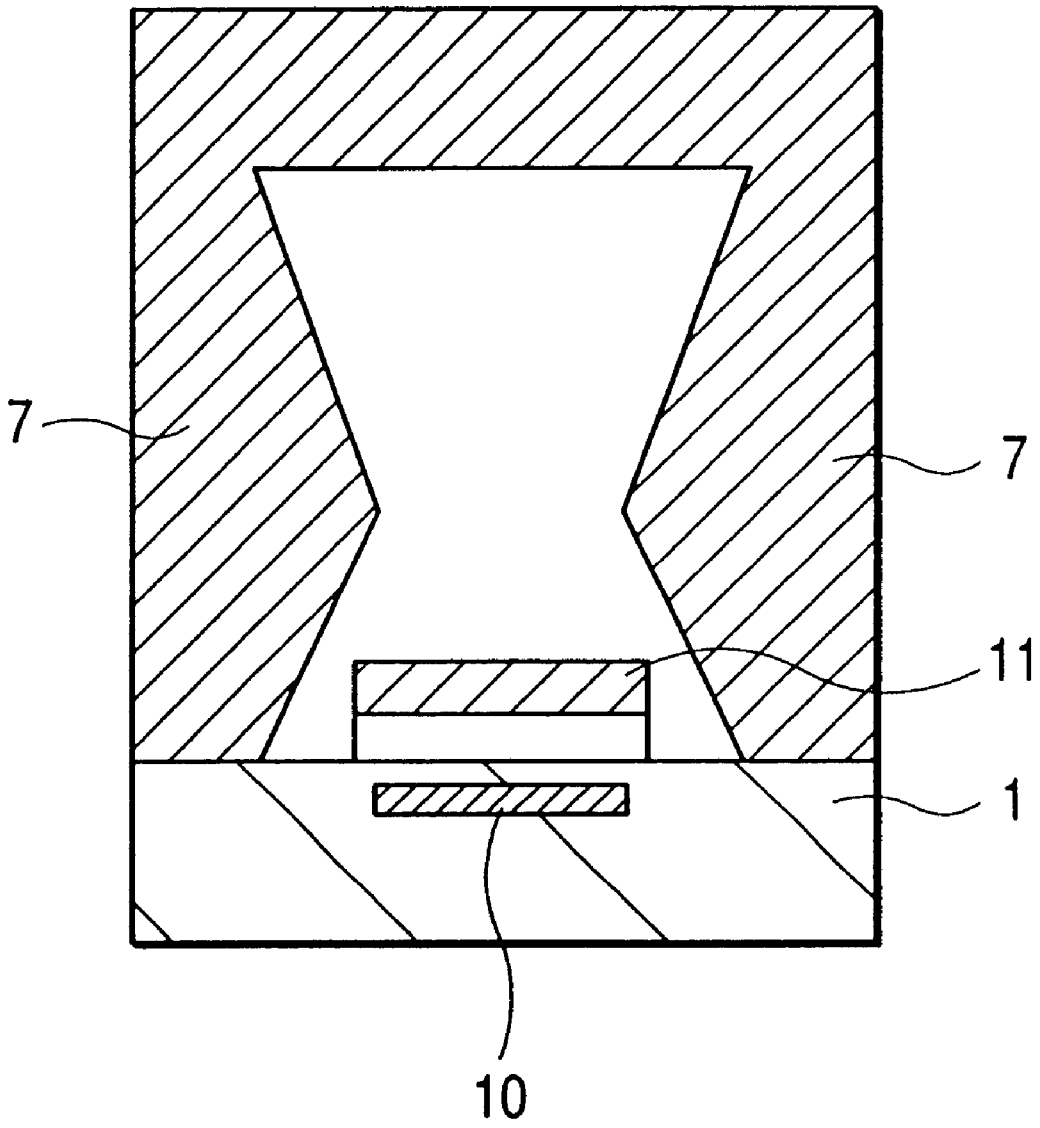
FIG. 11 is a view showing a side wall having a narrow central area.

Though the side stopper 12*b* has the form of the protruding portion of the side wall 7 in the fourth embodiment, a similar effect can be obtained by configuring the side wall 7 itself so as to have a form narrowed in its middle as shown in FIG. 11.

[Fifth embodiment]

Figure 15A:
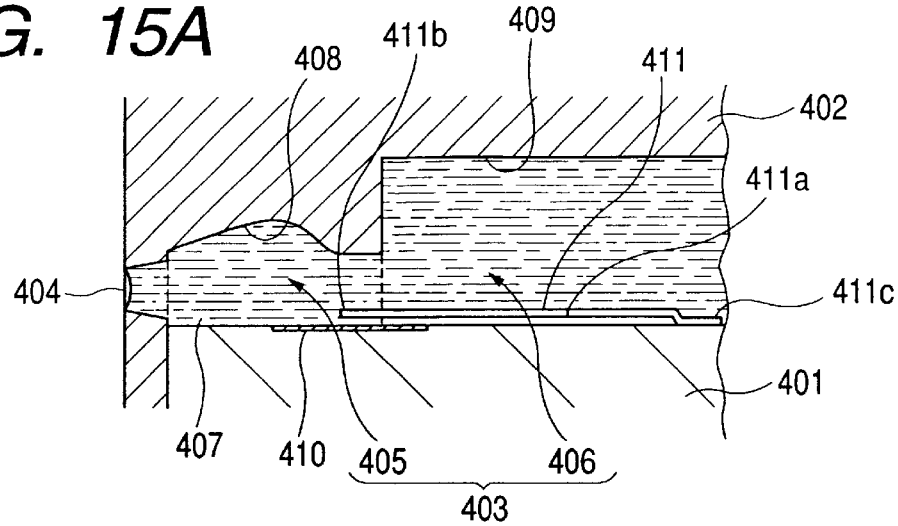
FIGS. 15A, 15B and 15C are schematic diagrams showing main members of a liquid discharging head of a fifth embodiment according to the present invention.
Figure 15B:
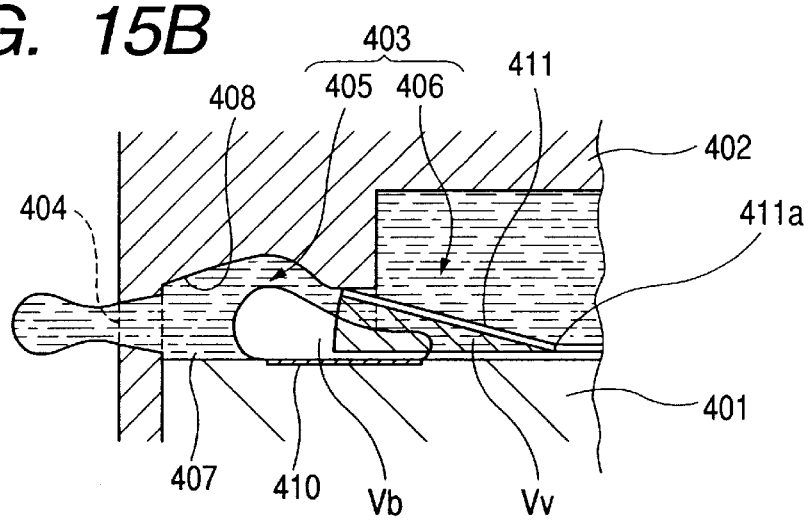
Figure 15C:
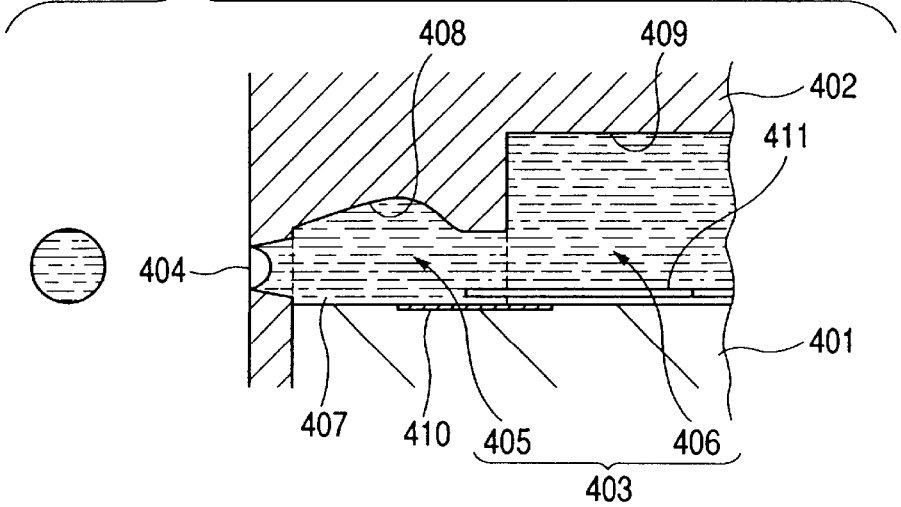

FIGS. 15A to 15C are sectional views illustrating main members of a liquid discharging head preferred as the fifth embodiment of the liquid discharging device according to the present invention. A configuration of this liquid discharging head will be described first.

The liquid discharging head comprises an element substrate 401 and a ceiling plate 402 which are laminated and fixed over and to each other, and a flow path 403 formed between these plates 401 and 402. The flow path 403 includes a nozzle portion 405 on side of a discharging port 404 and a supplying path portion 406. The nozzle portion 405 which is an elongate flow path surrounded by a side wall 407 and a ceiling 408, and is disposed in a large number in a single recording head. A supplying path portion 406 which has a large volume is disposed upstream so as to be communicated simultaneously with the large number of nozzle portions 405. That is, the large number of nozzle portions 405 are in a condition where they are branched from the single supplying path portion 406. A ceiling 409 of the supplying path portion 406 is far higher than the ceiling 408 of the nozzle portion 405. In correspondence to the large number of nozzle portions 405, heat generating elements (air bubble producing means) 410 such as electrothermal converting elements and movable members 411 are attached to the element substrate 401.

The movable member 411 is supported at an end thereof like a cantilever, fixed to the element substrate 401 upstream (right side in FIGS., 15A to 15C) an ink flow and is movable vertically in FIGS. 15A to 15C downstream (left side in FIGS. 15A to 15C) a structural fulcrum 411*c*. A free end 411*b* is located rather downstream a center of the heat generating elements 410. In an initial condition shown in FIG. 15A, the movable member 411 is located in parallel with the element substrate 401 while reserving a slight gap from the element substrate 1.

The fifth embodiment which has the configuration described above charges ink from an ink reservoir (not shown) by way of the supplying path portion 406 into each nozzle portion 405 down to the vicinity of the discharging port 404. A driving circuit (not shown) transmits driving signals selectively to the heat generating elements 410 for the nozzle portions 405 through which the ink is to be discharged in correspondence to an image to be formed. The heat generating elements 410 to which the driving signals are transmitted generate heat to heat the ink in the vicinities of the heat generating elements 410 (air bubble producing regions), thereby producing a bubble as shown in FIG. 15B. A bubble 412 thus produced forms a pressure wave which advances toward the discharging port 404 (leftward in FIG. 15B), thereby extruding the ink through the discharging port 404. The discharged ink adheres to a recording medium such as a recording paper (not shown) for recording. On the other hand, a component of the air bubble which grows toward the supplying path portion 406 (rightward in FIG. 15B) pushes up the movable member 411. The free end 411*b* of the movable member 411 is brought into contact with the ceiling 408 to prevent the pushed movable member 411 from being further deformed. Growth of the air bubble toward the supplying path portion 406 (rightward in FIG. 15B) is suppressed under restriction by the movable member 411. Accordingly, the movable member 411 functions as a valve.

Figure 16A:
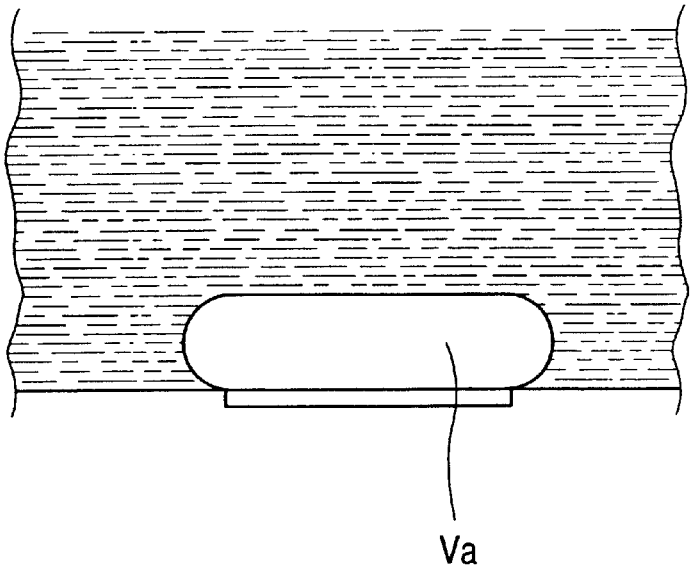
FIG. 16A is a view showing a bubble generated substantially without fluid resistance.

This function will be described in more detail. A bubble has such a form as that shown in FIG. 16A when it is produced in a condition where it is substantially free from surrounding fluid resistance, but if a discharging port is formed, for example on the left side in FIG. 16A, it may be considered that a left side (downstream) half of the air bubble contributes to discharge, whereas a right side (upstream) half of the air bubble influences on refilling and vibrations of a meniscus. Accordingly, restriction of growth of the upstream half of the air bubble serves for suppressing an upstream back wave and an upstream inertia force of the liquid, thereby enhancing a refilling frequency of a nozzle and suppressing the vibrations of the meniscus. When the movable member 411 is disposed in the flow path, the movable member 411 is displaced by a movement of the liquid which is caused by a pressure distribution produced by a pressure wave formed by the production of the air bubble and the growth of the air bubble is dependent on the movement of the liquid. To restrict the growth of the upstream half of the air bubble as described above, it is therefore sufficient to configure the movable member 411 so as to lessen an upstream movement of the liquid from the air bubble producing region. Since the liquid displaces upstream, as the movable member 411 displaces, in an amount which is nearly equal to a volume of the movable member 411 within a range which allows the displacement of the movable member, it is possible to restrict the upstream growth of the air bubble and discharge the liquid efficiently by reducing the volume of the movable member 411 within the range which allows the displacement of the movable member. Speaking concretely, it is sufficient to suppress the upstream growth of the air bubble, or the displacement of the liquid together with the displacement of the movable member 411, to half a maximum volume of the air bubble which is produced in the condition where it is substantially free from the surrounding fluid resistance, but taking into consideration a fact that the clearance is reserved between the movable member 411 and the heat generating element 410 (substrate 401) and the air bubble penetrates into the clearance, the movable member 411 is disposed so that the free end 411*b* is located a little downstream the center of the heat generating element 410, and the volume which allows the displacement of the movable member 411 (an amount of the liquid which is extruded upstream referred to herein as "a volume Vv of a displacement region of the movable member 411") is not larger than half a maximum volume Vb of a produced air bubble. Accordingly, downstream growth of the air bubble is not equal to upstream growth of the air bubble, but the upstream growth of the air bubble is much smaller, thereby restricting upstream movement of the liquid. The restriction of the upstream movement of the liquid reduces retreat of the meniscus after discharge, thereby shortening protruding length of the meniscus from an orifice surface at a refilling stage. The volume Vv of the displacement region of the movable member 411 can be approximated by taking a length of the movable member as measured from the free end to the fulcrum times a width W of the movable member times a maximum displacement height of the movable member divided by two, but it is to be noted here that the fulcrum 411*a* of the movable member is different from a structural fulcrum (fixing point) 411*c* of the movable member. Speaking concretely, the substantial fulcrum 411*a* is usually located downstream the structural fulcrum 411*c* when the movable member 411 has a predetermined length. The "length of the movable member as measured from the free end to the fulcrum" mentioned above is to be determined using the substantial fulcrum 411*a*.

The fifth embodiment which has the configuration described above suppresses the vibrations of the meniscus which are reciprocal movements, thereby discharging the liquid stably at all driving frequencies ranging from a low frequency to a high frequency.

Speaking of a concrete example wherein a bubble which is grown to a maximum has a height of 45 $\mu$m and a heat generating surface of the heat generating element 410 has an area Sh in a bubble-jet type liquid discharging head, a maximum volume Vb of the air bubble is Sh×45 [$\mu m^3$]. When an area of the movable member 411 is represented by Sv and a maximum displacement height of the movable member 411 (a height in a condition where the movable member 411 is restricted by the ceiling 408 as shown in FIG. 15A and cannot be further deformed) is designated by Hv, the volume Vv of the displacement region of the movable member 411 can be approximated by Sv×Hv÷2 [$\mu m^3$].

Figure 16B:
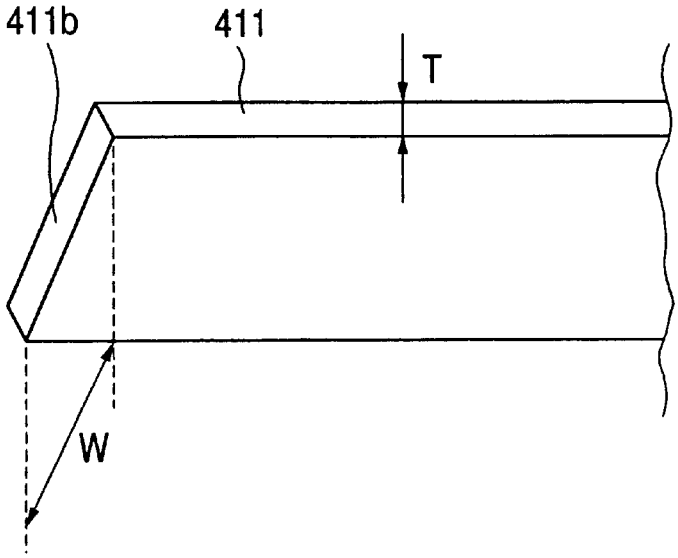
FIG. 16B is a perspective view showing a movable member.

When the area Sh of the heat generating surface of the heat generating element 410 is 40×115 [$\mu$m], the area Sv of the movable member 411 is 40×175 [$\mu$m], a height of the ceiling 408 of the nozzle portion 405 is 35 [$\mu$m] and the maximum displacement height of the movable member is 25 [$\mu$m], for example, the maximum volume Vb of the air bubble is 40×115×45=207000 [$\mu m^3$] and half the maximum volume Vb is 103500 [$\mu m^3$]. On the other hand, the volume Vv of the displacement region of the movable member 411 is 40×175×25÷2=87500 [$\mu m^3$]. When the movable member 411 and the ceiling 408 of the nozzle portion 405 are configured so that the volume Vv of the displacement region of the movable member 411 is smaller than the half the maximum volume Vb of the air bubble as described above, the fifth embodiment is capable of efficiently discharging ink at a refilling frequency higher than that of the conventional liquid discharging head even when it uses a heat generating elements which remain unchanged in dimensions and a driving power. FIG. 16B is a perspective view of the movable member.

[Sixth embodiment]

Figure 17A:
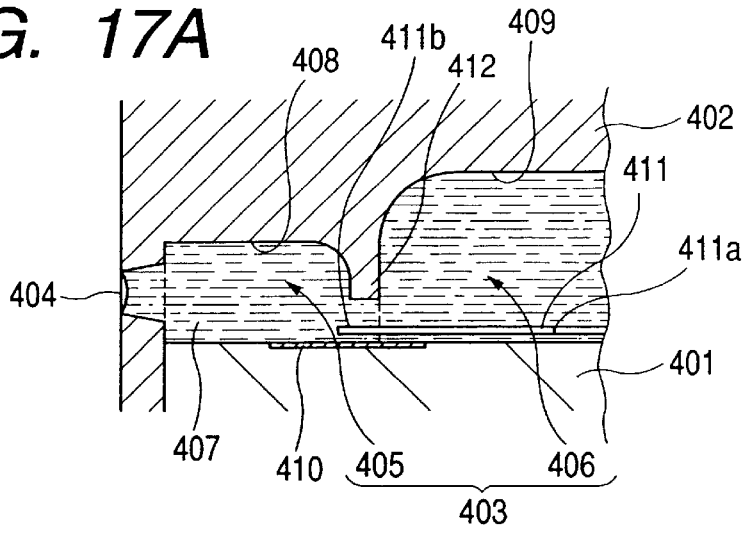
FIGS. 17A, 17B and 17C are schematic diagrams showing main members of a liquid discharging head of a sixth embodiment according to the present invention.
Figure 17B:
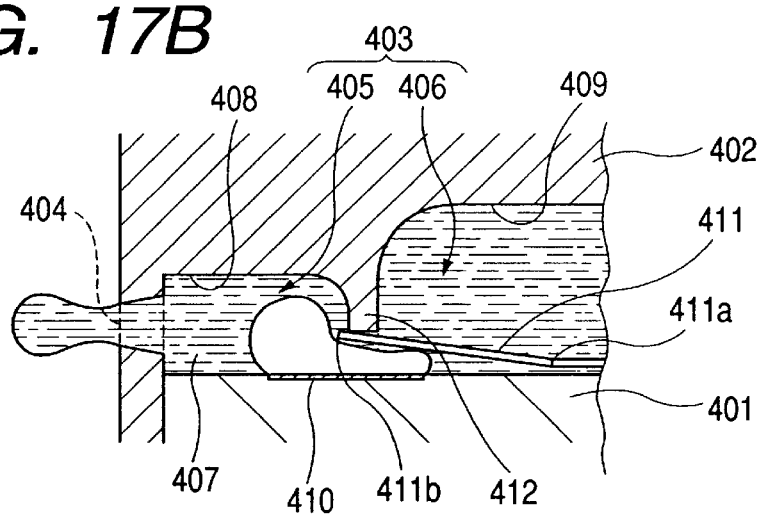
Figure 17C:
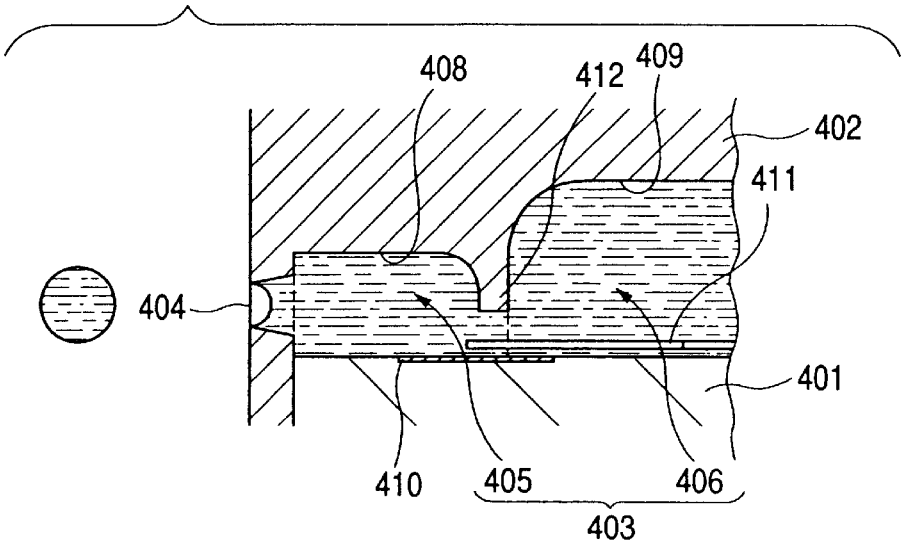

FIGS. 17A to 17C are side sectional views illustrating main members of the sixth embodiment of the present invention. Components which are similar to those of the fifth embodiment will be represented by the same reference numerals and not be described in particular.

In the sixth embodiment, a stopper 412 which protrudes downward from a ceiling 408 of a nozzle portion 405 is formed integrally with the ceiling 408. As described in the fifth embodiment, a distance as measured from a tip of the stopper to the element substrate 401 is set at 25 [$\mu$m] in the sixth embodiment to enhance a refilling frequency and obtain an effect to restrict vibrations of a meniscus by suppressing an upstream inertia force of the liquid with a movable member 411. Furthermore, a strong discharging force can be obtained by leading an energy which grows a bubble downstream from a heat generating element 410 and contributed to discharge int, efficiently to a side of a discharging port 404. In the sixth embodiment, a nozzle portion 405 downstream is configured to have a larger sectional area than a location at which the stopper 412 is disposed to lower resistance of a downstream flow path, thereby enhancing an efficiency. Out of two methods to lower the resistance of the downstream flow path; one which enlarges a sectional area of a nozzle and the other which shortens a distance as measured from a heater to an orifice, the former is adopted for the sixth embodiment since the latter lowers a refilling frequency. As a result, the sixth embodiment enhances both a discharging rate and a discharging speed, thereby permitting discharging ink at a high efficiency.

Speaking more concretely of the sixth embodiment illustrated in FIGS. 17A to 17C, a heat generating element 410 has an area Sh of 40×115 [$\mu$m], a movable member 411 has an area Sv of 40×175 [$\mu$m], a distance as measured from a tip of the stopper to an element substrate 401 is 25 [$\mu$m], the movable member 411 has a maximum displacement height Hv of 15 [$\mu$m] and half a maximum volume of a bubble is 40×115×45÷2=103500 [$\mu m^3$], whereas a displacement region of the movable member 411 has a volume Vv of 40×175×15÷2=52500 [$\mu m^3$]. Since the displacement region of the movable member 411 has the volume Vv which is smaller than the half the maximum volume Vb of the air bubble as described above, the sixth embodiment has a refilling frequency which is higher than that of the liquid discharging head preferred as the fifth embodiment not to speak of the conventional liquid discharging head using the heat generating element 410 which is unchanged in its dimensions and driving power.

Furthermore, the sixth embodiment restricts an upstream liquid flow like the fifth embodiment, thereby reducing a retreat amount of a meniscus and shortening a protruding length of the meniscus from an orifice at a refilling stage. Accordingly, the sixth embodiment suppresses meniscus vibrations which are reciprocal movements, thereby stably discharging the liquid at all driving frequencies ranging from a low frequency to a high frequency.

The flow path has a height preferably of 10 [$\mu$m] or larger, more preferably of 15 [$\mu$m] or larger, except a thickness of the movable member 411 at a location where the stopper 412 is disposed since the resistance of the flow path is increased at a stage to charge the ink into the nozzle portion 405 as the stopper is lowered and an a refilling frequency is lowered when an influence due to the increase of the resistance of the flow path is larger than the effect to suppress the rearward inertia force of the liquid.

[Seventh embodiment]

Figure 18A:
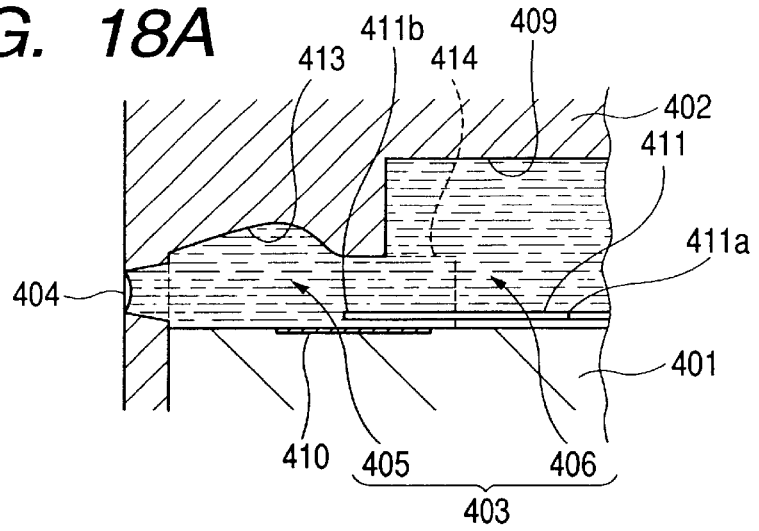
FIGS. 18A, 18B and 18C are schematic diagrams showing main members of a liquid discharging head of a seventh embodiment according to the present invention.
Figure 18B:
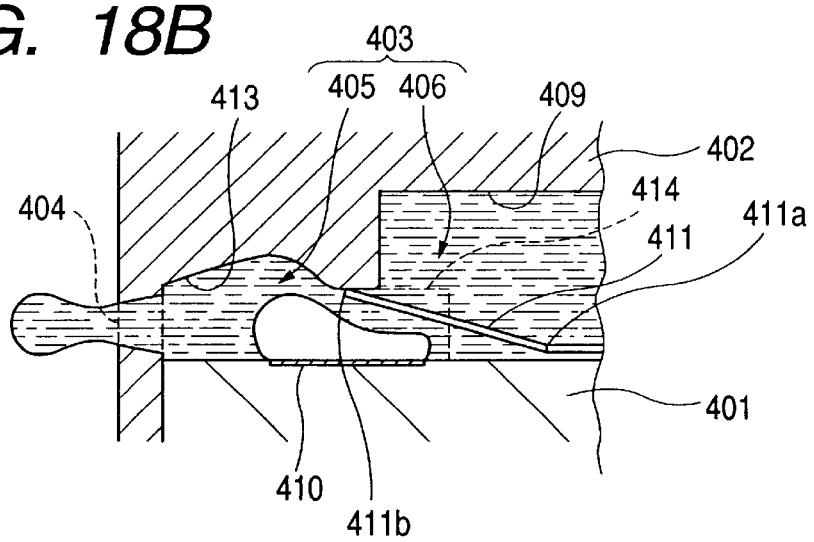
Figure 18C:
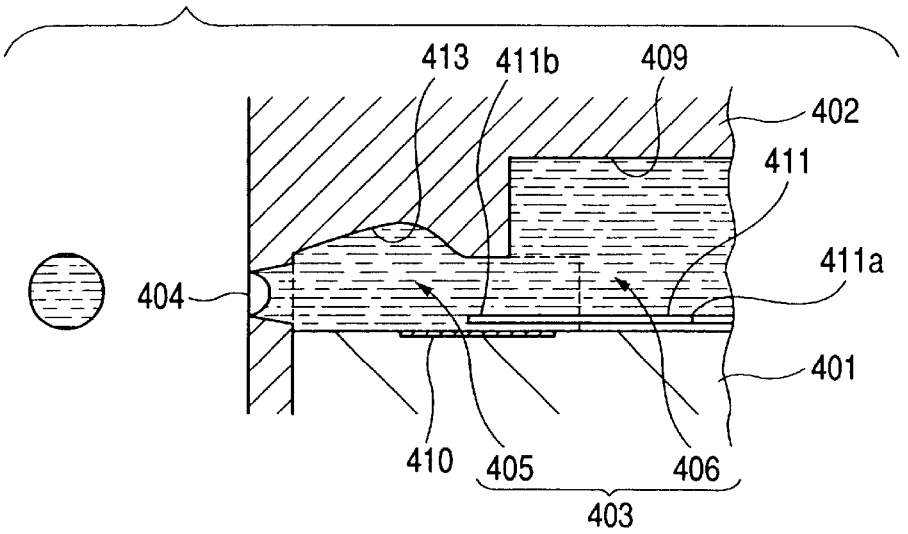

FIGS. 18A to 18C are side sectional views illustrating main members of the seventh embodiment of the present invention. Members of the seventh embodiment which are similar to those of the fifth embodiment are represented by the same reference numerals and not described in particular.

In the seventh embodiment, a ceiling 413 of a nozzle portion 405 is partially removed to facilitate to refill ink into a nozzle portion 405 while suppressing crosstalk to an adjacent nozzle portion 405 with a movable member 411 and a side wall 414 of the nozzle portion 405. Speaking concretely, an end of the nozzle portion 405 on a side of a supplying path portion 406 (upstream) is not covered with a low ceiling like that used in the fifth embodiment, but configured as a flow path broadened to a high ceiling 409 of the suppling path portion 406.

The seventh embodiment charges ink into the nozzle portion 405 more speedily at a refilling stage, even when a heat generating element 410, a movable member 411, a maximum displacement height of the movable member 411 and a bubble producing behavior are substantially the same as those in the fifth embodiment. Accordingly, the seventh embodiment can provide a driving frequency which is higher than that of the fifth embodiment.

A shorter side wall 414 enhances a refilling frequency but increases crosstalk. Examinations made by the inventor clarified that a crosstalk suppressing effect can be obtained when the side wall 414 extends 10 $\mu$m or more beyond an upstream end of the heat generating element 410.

[Eighth embodiment]

Figure 19A:
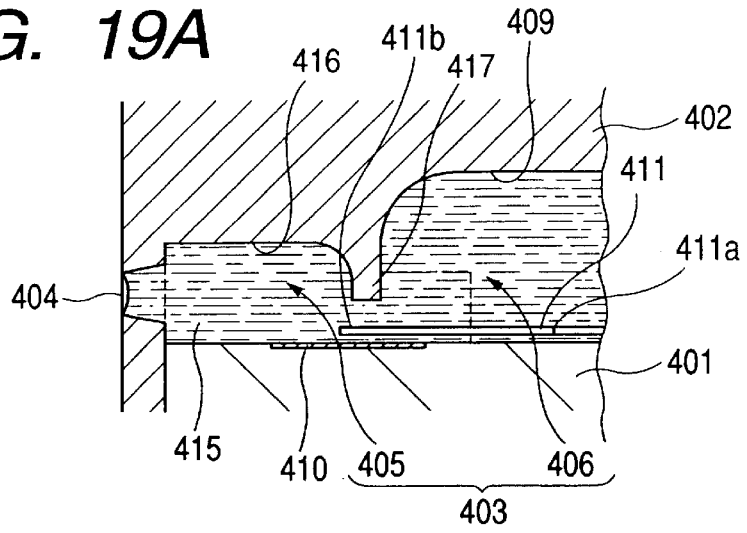
FIGS. 19A, 19B and 19C are schematic diagrams showing main members of a liquid discharging head of a eighth embodiment according to the present invention.
Figure 19B:
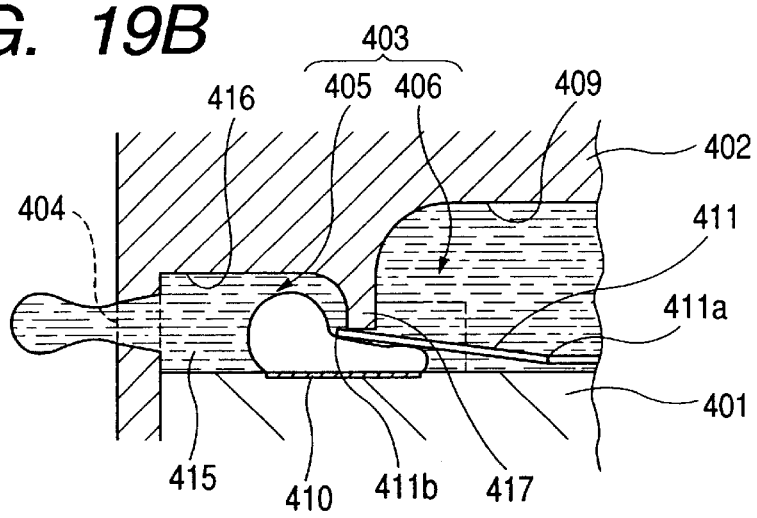
Figure 19C:
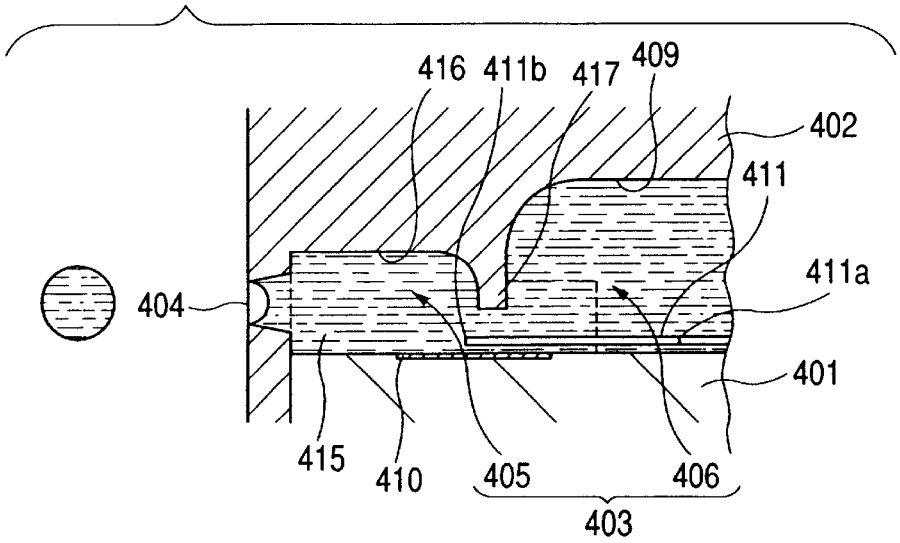

FIGS. 19A to 19C are side sectional views illustrating main members of the eighth embodiment of the present invention. Members of the eighth embodiment which are similar to those of the fifth embodiment are represented by the same reference numerals and not described in particular.

In the eighth embodiment, a ceiling 416 of a nozzle portion 405 is partially removed, as in the seventh embodiment, to facilitate to refill ink into the nozzle portion 405 while suppressing crosstalk to an adjacent nozzle portion 405 with a movable member 411 and a side wall 415 of the nozzle portion 405. Speaking concretely, an end of the nozzle portion 405 on a side of a supplying path portion 406 (upstream) is not covered with a low ceiling like that used in the fifth embodiment, but configured as a flow path which is broadened to a high ceiling 409 of the supplying path portion 406. Furthermore, a stopper 417 like that used in the sixth embodiment is formed integrally with the ceiling 416. And a sectional area of the nozzle portion 405 is enlarged downstream a location at which a stopper 417 is disposed, thereby lowering resistance of a downstream flow path to enhance an efficiency.

[Ninth embodiment]

Figure 20A:
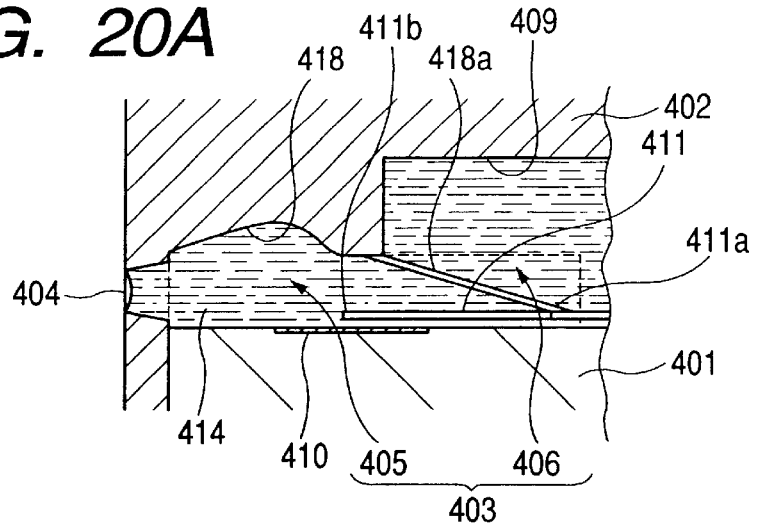
FIGS. 20A, 20B and 20C are schematic diagrams showing main members of a liquid discharging head of a ninth embodiment according to the present invention.
Figure 20B:
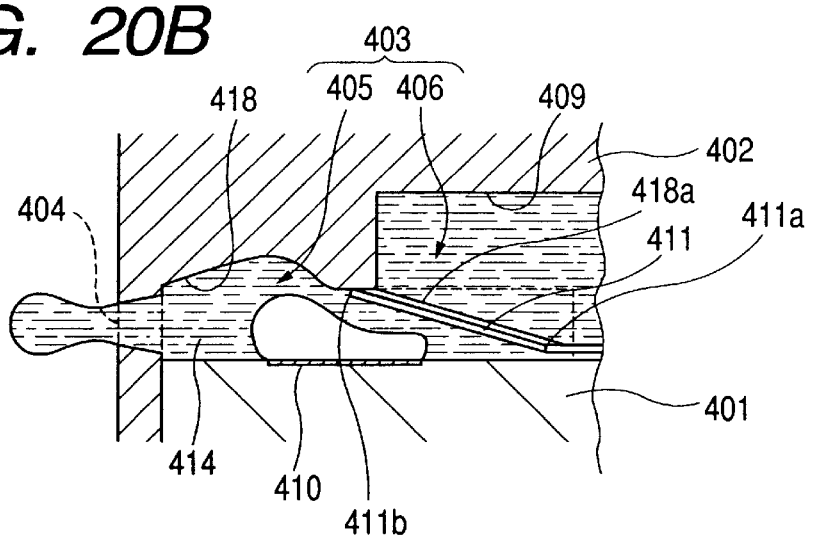
Figure 20C:
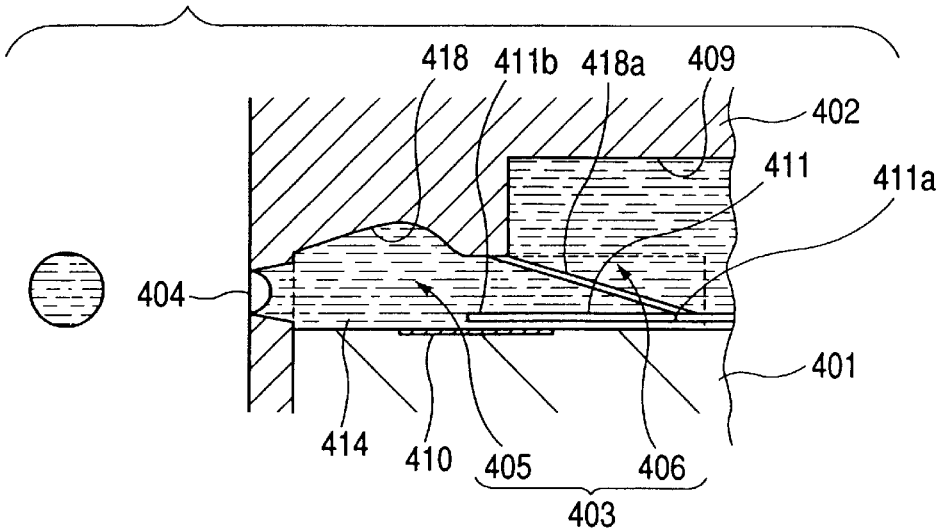

FIGS. 20A to 20C are side sectional views illustrating main members of the ninth embodiment of the present invention. Members which are similar to those of the fifth embodiment are represented by the same reference numerals and not described in particular.

In the ninth embodiment, a slant member 418*a* is disposed at an end of a ceiling 418 of a nozzle portion 405 on a side of a supplying path portion 406 (upstream). This slant member 418*a* intercepts an ink flow when a movable member 411 rises. Accordingly, an upstream ink flow is further reduced and a meniscus vibration suppressing effect is enhanced.

<Side chuter type>

Figure 12A:
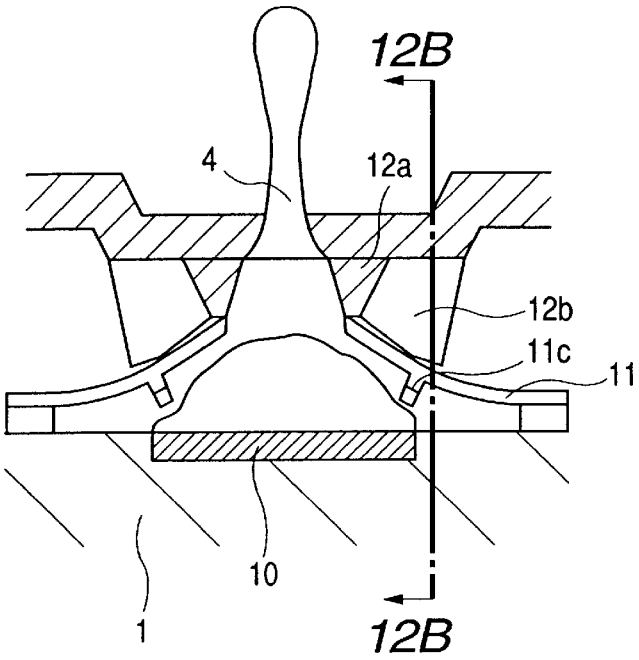
FIGS. 12A, 12B and 12C are views showing a side-shooter type head.
Figure 12B:
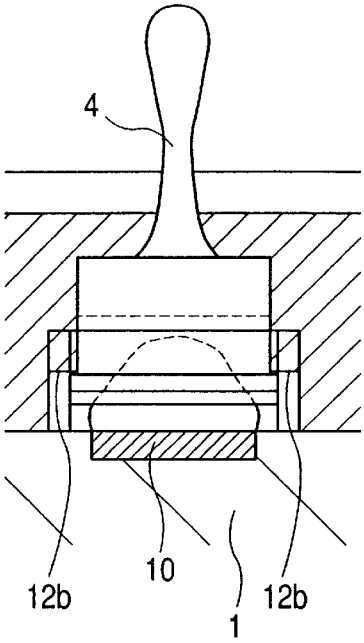
Figure 12C:
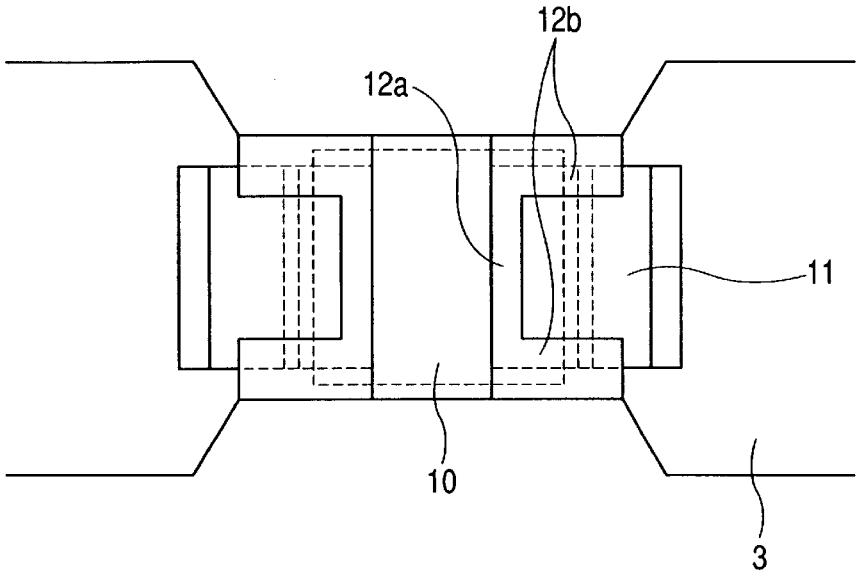

Description will be made here of an application of the liquid discharging principle described with reference to FIGS. 1A to 1K, 2A to 2K, 3A to 3K, and 4A to 4K to a side chuter type head in which a heat generating element and a discharging port are opposed to each other on planar surfaces in parallel with each other. FIGS. 12A to 12C are diagrams descriptive of the side chuter type head.

In FIGS. 12A to 12C, a heat generating element 10 disposed on an element substrate 1 is arranged so as to oppose to a discharging port 4 formed in a ceiling plate 2. The discharging port 4 is communicated with a liquid flow path 3 which passes over the heat generating element 10. A bubble producing region exists in the vicinity of a surface on which the heat generating element 10 is in contact with a liquid. Two movable members 11 are supported on the element substrate 1 so that they are symmetrical with regard to a plane passing a center of the heat generating element and free ends of the movable members 11 are opposed to each other on the heat generating element 10. Furthermore, the movable members 11 have equal projection areas onto the heat generating element 10 and the free ends of the movable members 11 are apart from each other for a desired distance. Assuming that the movable members are divided by the plane passing the center of the heat generating element, the movable members are arranged so that the free ends the divided movable members are located in the vicinities of the center of the heat generating element.

Disposed on the ceiling plate 2 is a stopper 64 which restricts displacement of each movable member 11 within a certain range. In a liquid flow from a common liquid chamber 13 to the discharging port 4, a flow path region having resistance which is low relative to that of a liquid flow path 3 is disposed upstream the stopper 64. This flow path region has a sectional area which is larger than that of the liquid flow path 3 so that the flow path region has low resistance to the liquid flow.

Figure 13A:
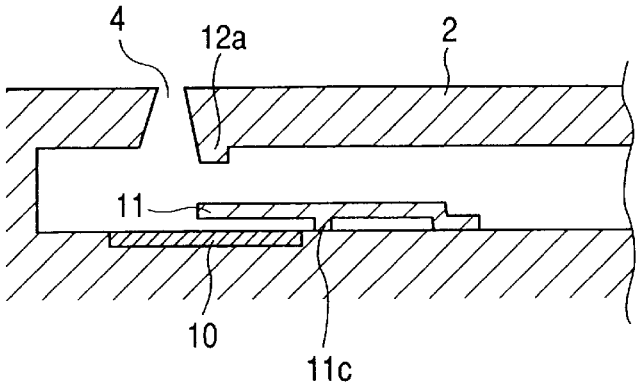
FIGS. 13A, 13B, 13C and 13D are views showing the generation, grouth and disappearance of a bubble in a side-shooter type head.
Figure 13B:
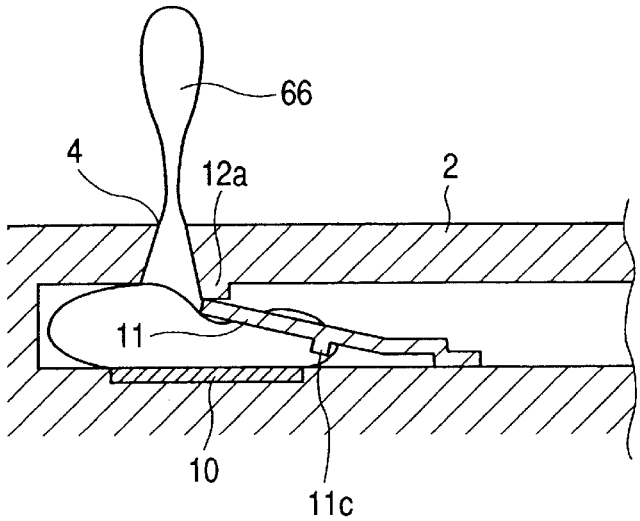
Figure 13C:
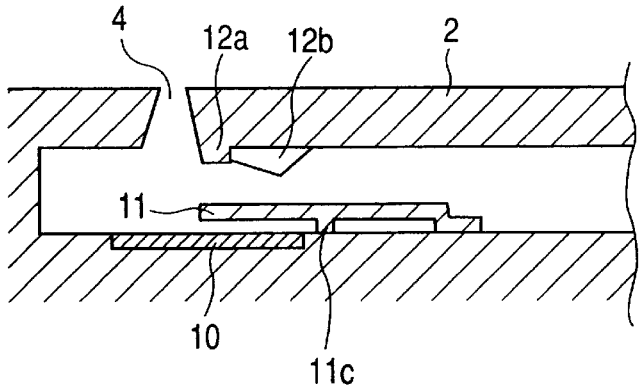
Figure 13D:
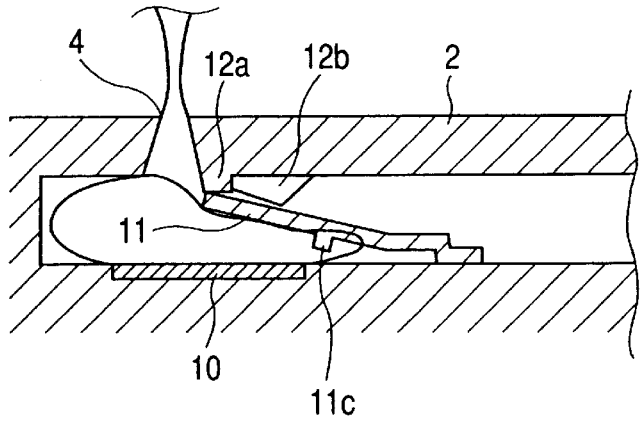
Figure 14C:
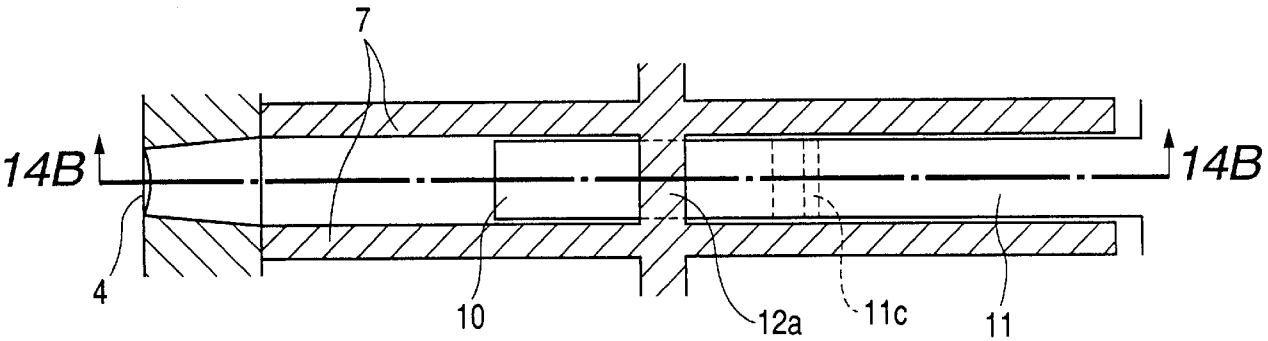
Figure 14B:
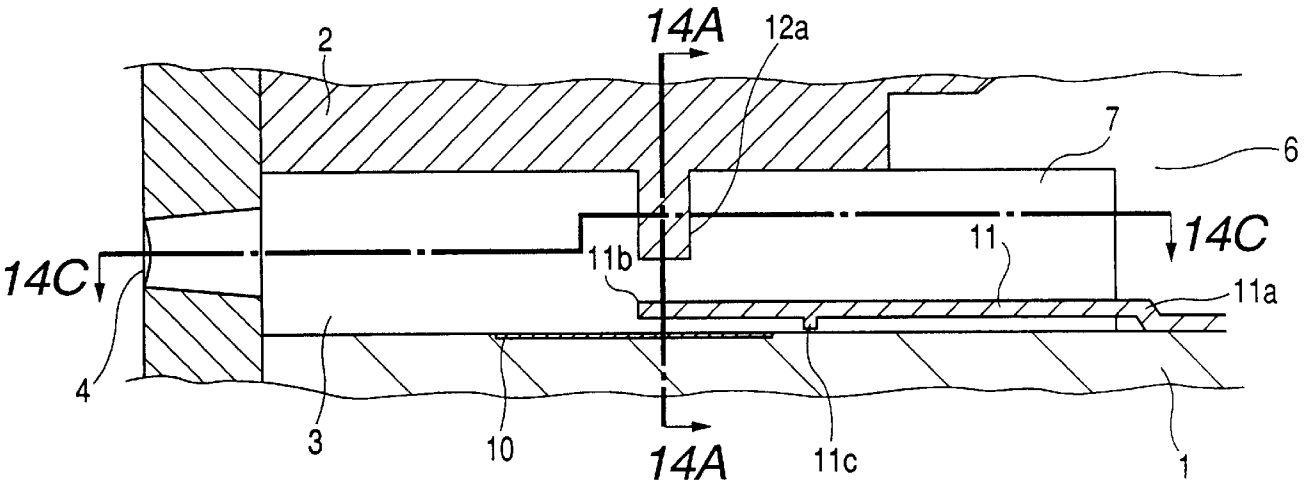
Figure 14A:
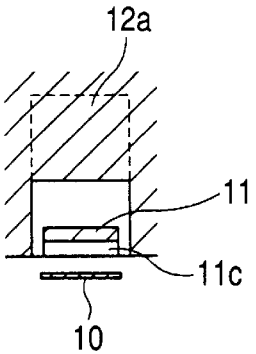
Figure 14E:
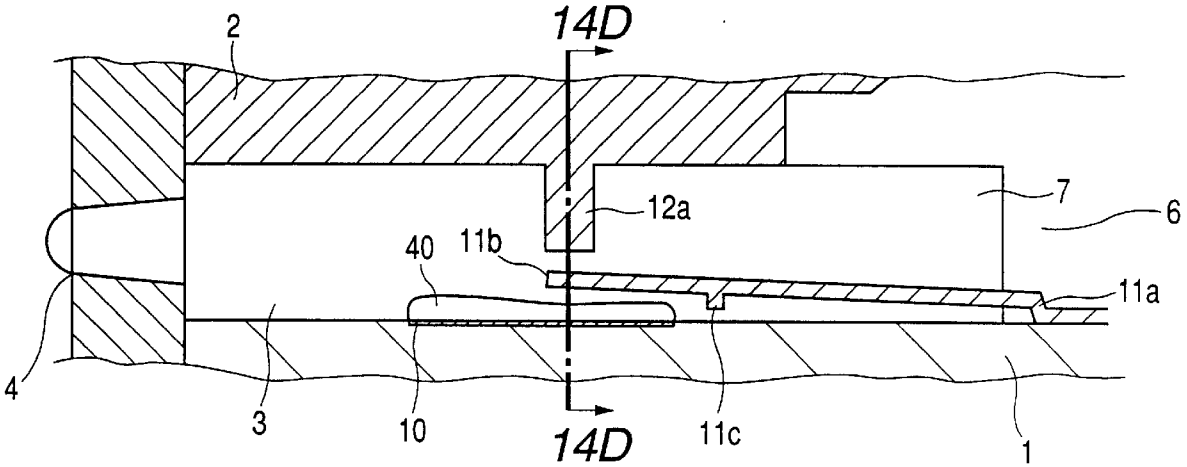
Figure 14D:
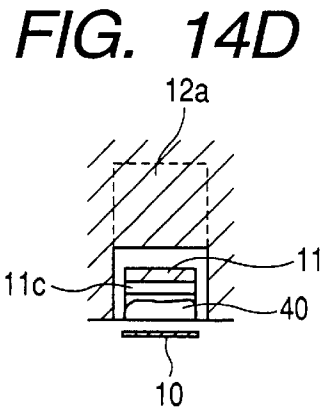
Figure 14G:
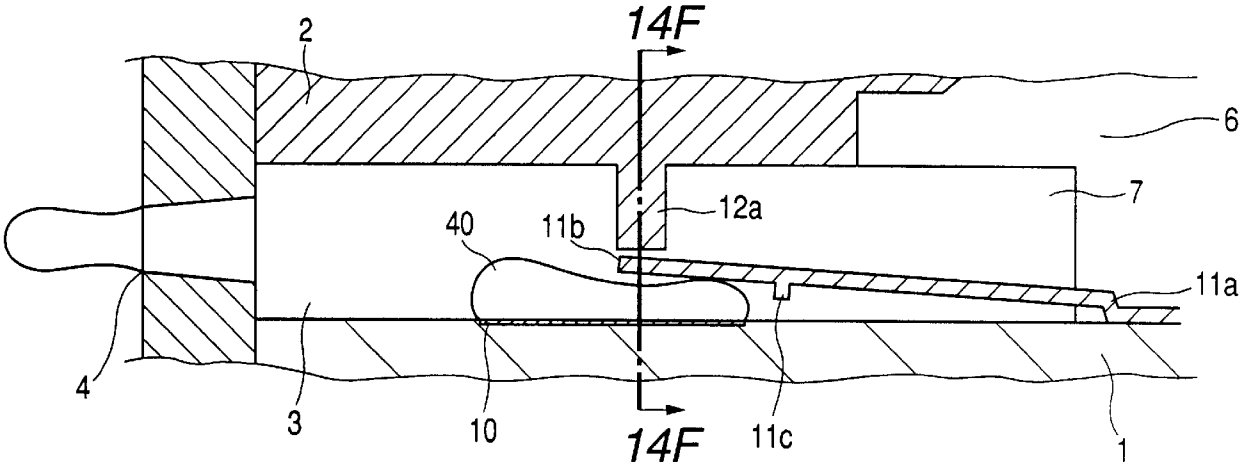
Figure 14F:
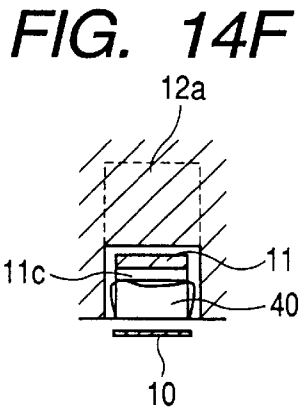
Figures 14H, 14I, 14J, 14K:
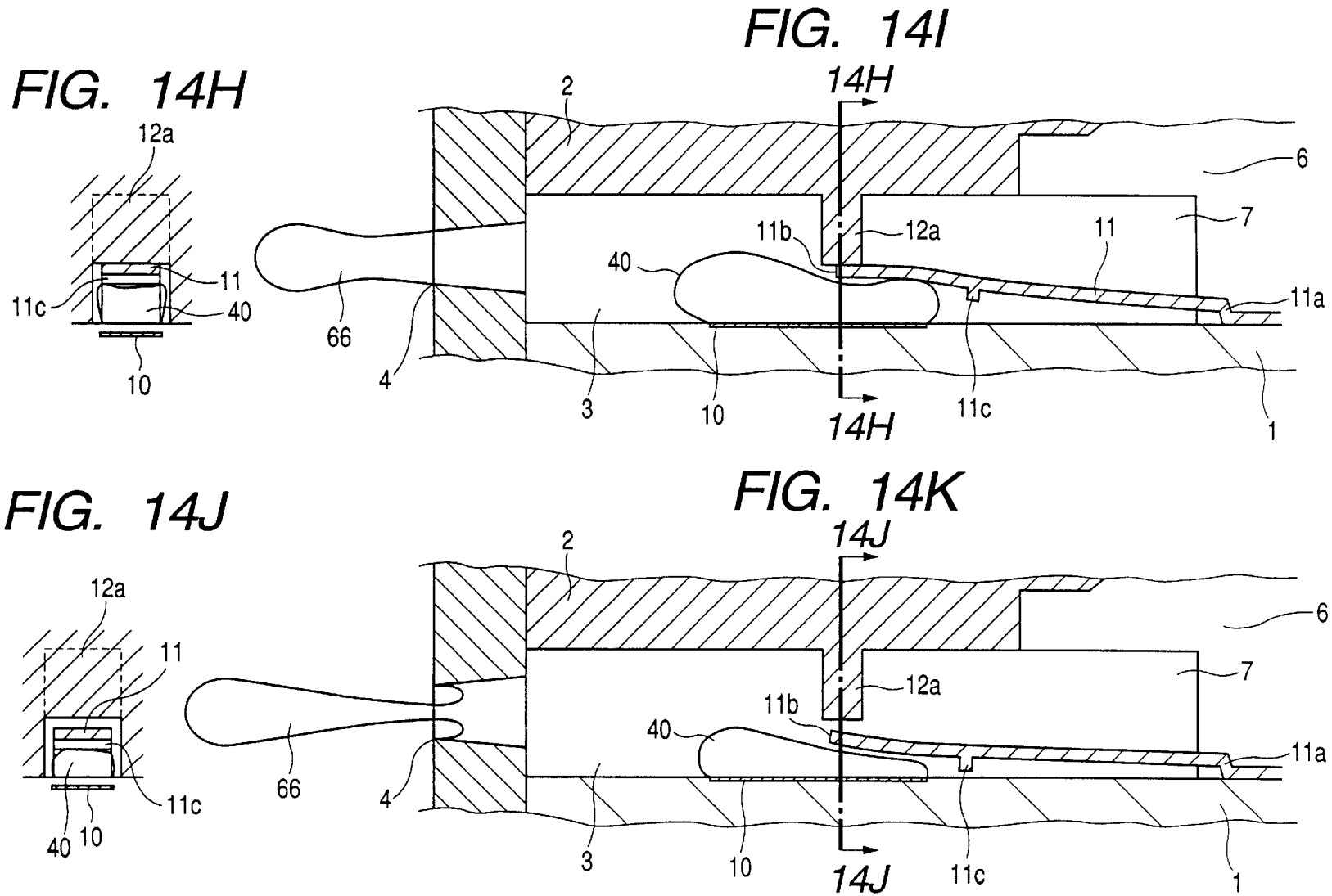

FIGS. 13A to 13D show configurations each using a single movable member for a single heat generating element: FIGS. 13C and 13D showing a configuration wherein a side stopper 12*b* is disposed in addition to a tip stopper 12*a*. In the side chuter type discharging port, a member 12*d* which is slanted in a such a direction as to apart downstream from the substrate is disposed on a surface of the side stopper 12*b* which is to be brought into contact with the movable member to enhance an effect to suppress an upstream inertia force of the liquid. This slant member 12*d* serves to ensure a more favorable contact condition between the movable member 11 and the stopper when the movable member rises. Accordingly, an upstream ink flow is reduced at a bubble producing stage, thereby enhancing the meniscus vibration suppressing effect.

Now, characteristic functions and effects of the liquid discharging head which has the configuration described above will be explained with reference to FIGS. 13A to 13D.

Each of FIGS. 13B and 13D shows a condition where a liquid filled in the air bubble producing region 11 is heated partially by the heat generating element 10 and a bubble 40 produced by film boiling has grown maximum. In this condition, the liquid in the liquid flow path 3 moves toward the discharging port 4 due to a pressure produced by production of the air bubble 40, the movable member 11 displaces as the air bubble 40 grows and a discharged liquid drop 66 is going to spring out of the discharging port 4. The flow path region having low resistance forms a large flow from the liquid moving upstream, but the movable member 11 remarkably restricts the upstream liquid movement since its displacement is restricted when it displaces close to the stopper 12 or comes into contact with the stopper. Simultaneously, the movable member 11 restricts upstream growth of the air bubble 40. In the condition shown in FIG. 13B wherein the liquid is moved upstream by a strong force, however, a portion of the air bubble 40 whose growth is limited by the movable member 11 passes through a gap between the side wall composing the liquid flow path 3 and the movable member 11, and is swollen above a top surface of the movable member 11. That is, a swollen air bubble 41 is formed. In the condition shown in FIG. 13D, on the other hand, a swollen air bubble is not formed since the side stopper 12*b* shields the clearance between the movable member 11 and the side wall 7 of the flow path.

Immediately after the air bubble 40 starts contracting after the film boiling, the force to move the liquid upstream is still rather strong at this time and the movable member 11 is kept in the condition where it is kept in contact with the stopper 12*a*, whereby the contraction of the air bubble 40 remarkably serves to move the liquid upstream from the discharging port 4. Accordingly, a meniscus is sucked remarkably from the discharging port 4 into the liquid flow path 3 at this time, thereby cutting off a liquid column linked to the discharged liquid drop 66 with a strong force. As a result, the liquid discharging head reduces liquid drops remaining outside the discharging port 4, or satellites.

When a bubble breaking step is nearly completed, a repulsive force (restoring force) of the movable member 11 overcomes the force to move the liquid upstream in the flow path region having low resistance, whereby the movable member 11 starts downward displacement and the liquid starts flowing downstream in the flow path region having low resistance. Simultaneously, due to the low resistance in the flow path the liquid rapidly forms a large flow and goes into the liquid flow path 3 by way of the stopper 12*a*.

The side chuter type liquid discharging head is configured to use the flow path region having low resistance which supplies the liquid to be discharged, thereby enhancing a refilling speed. In addition, the common liquid chamber which is disposed adjacent to the flow path region having low resistance further reduces the resistance in the flow path to enhance the refilling speed.

Furthermore, breakage of the air bubble is completed speedily owing to a combination of the clearance between the side stopper 12*b* and the movable member 11 which accelerates a liquid flow into the air bubble producing region 11 at a stage to break the air bubble 40 and the speedy liquid supply along the surface of the movable member 11 which is formed when the movable member 11 is apart from the stopper 12*a*.

<Movable member>

Silicon nitride which is used to form the movable member 5 μm thick in the embodiments described above is not limitative and any material may be used to compose the movable member so far as it is resistant to a liquid to be discharged and elastic enough to allow the movable member to operate favorably.

Preferable as material for the movable member are metals such as highly durable silver, nickel, gold, iron, titanium, aluminium, platinum, tantalum, stainless steel, phosphor bronze and alloys thereof, or resins having a nitrile group such as acrylonitrile, butadiene and styrene, resins having an amide group such as polyamide, resins having a carboxyl group such as polycarbonate, resins having an aldehyde group such as polyacetal, resins having a sulfone group such as polysulfone, other resins such as liquid crystal polymers and compounds thereof, metals highly resistant to ink such a gold, tungsten, tantalum, nickel, stainless steel, titanium and alloys thereof, materials coated with these metals as for resistance to ink, resins having a amide group such as polyamide, resins having an aldehyde group such as polyacetal, resins having a ketone group such as polyether ketone, resins having an imide group such as polyimide, resins having a hydroxyl group such as phenol resin, resins having a ethyl group such as polyethylene, resins having an alkyl group such as polypropylene, resins having an epoxy group such as epoxy resin, resins having an amino group such as melamine, resins having a methylol group such bas xylene resin and compounds thereof, and ceramics such as silicon dioxide, silicon nitride and compounds thereof. A Film which has a thickness on the order of micrometers is usable as the movable member for the liquid discharging head according to the present invention.

Description will be made of positional relationship between the heat generating element and the movable member. The heat generating element and the movable member which are arranged at optimum locations make it possible to effectively utilize a liquid by adequately controlling its flow caused by producing a bubble with the heat generating element.

Figure 21:
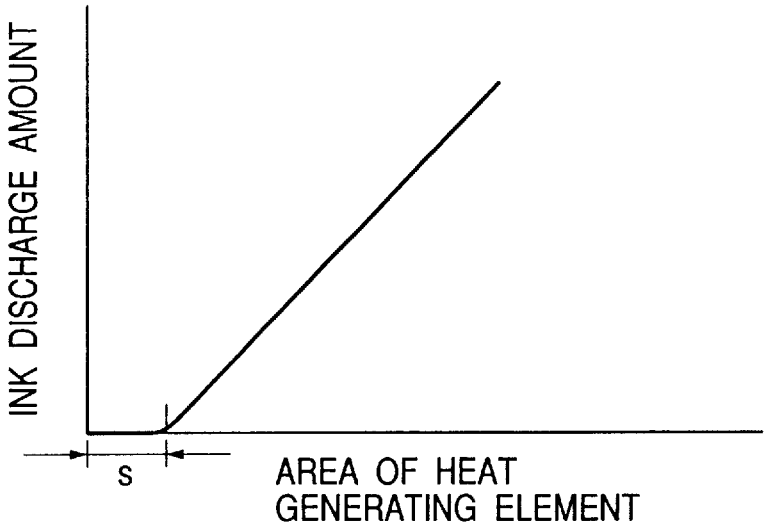
FIG. 21 is a graph showing the relation between the area of the heat generating element and the ink discharge amount.

It is known that an ink discharge amount is proportional to an area of the heat generating element as shown in FIG. 21 but an ineffective air bubble producing region S which does not serve to ink discharge exists in the liquid discharging head using the conventional ink-jet recording method, or the so-called bubble-jet recording method, which causes a status change accompanied by an abrupt volumetric change (production of a bubble), discharges ink from a discharging port utilizing a force generated by the status change and allows the ink to adhere to a recording medium, thereby forming an image. It is known from a scorched condition of the heat generating element that the ineffective air bubble producing regions exists around the heat generating element. From these results, it is considered that a circumference about 4 μm wide of the heat generating element does not serve to the production of the air bubble.

Accordingly, it can be said that a region located right over an effective air bubble producing region which is approximately 4 μm or more inside the circumference of the heat generating element is a region which exerts an effective function for the movable member, and paying attention to a fact that the liquid discharging head according to the present invention allows, at a stage, a bubble to function independently on liquid flows in the flow path upstream and downstream a nearly middle region of the air bubble producing region (actually located within a range of about ±10 μm from a center in a directions of the liquid flows), and allows, at another stage, the air bubble to function collectively on the liquid flows, it is extremely important to dispose the movable member so that only a portion of the air bubble producing region upstream the nearly middle region is opposed to the movable member. Though the effective air bubble producing region is defined above as approximately 4 μm or more inside the circumference of the heat generating element, this definition may be modified dependently on kinds and forming methods of heat generating elements.

For favorable formation of the substantially closed space described above, it is preferable to reserve a distance of 10 μm or shorter between the movable member and the heat generating element in a standby condition.

<Element substrate>

Description will be made in detail of a configuration of the element substrate 1 on which the heat generating element 10 is disposed to impart heat to a liquid.

Figure 22A:
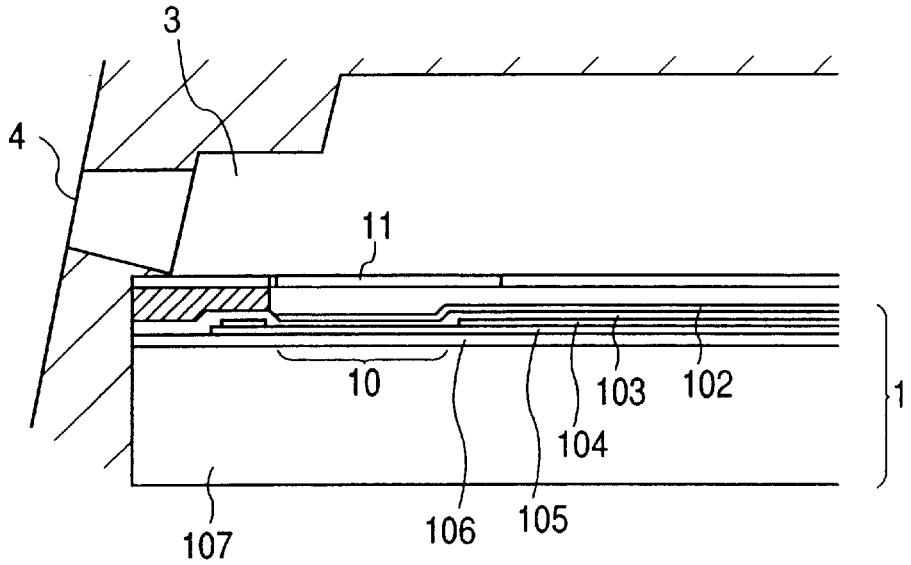
FIGS. 22A and 22B are schematic diagrams showing main members of a liquid discharging apparatus according to the present invention.
Figure 22B:
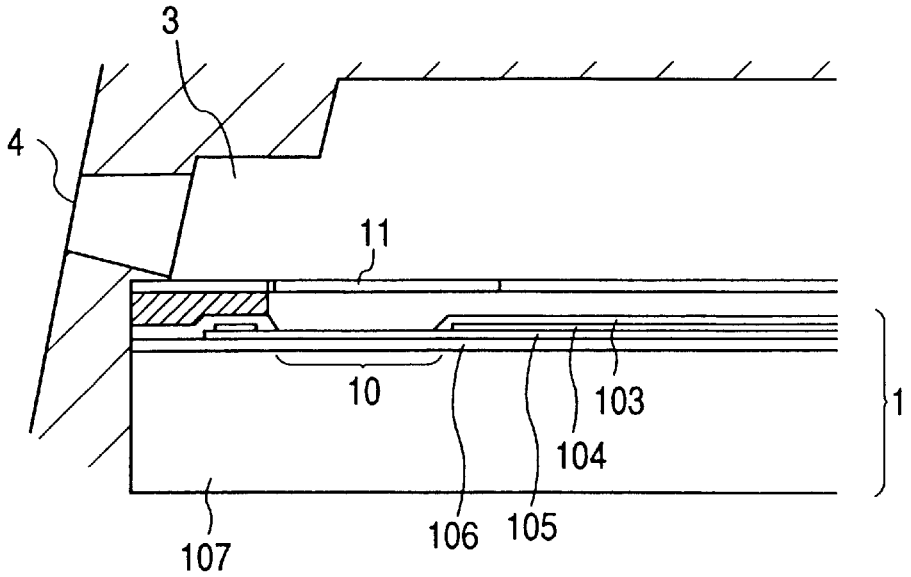

FIGS. 22A and 22B are side sectional views illustrating main members of the liquid discharge device according to the present invention: FIG. 22A showing a liquid discharging device which has a protective film described later and FIG. 22B showing a liquid discharging device which has no protective film.

Disposed on the element substrate 1 is a grooved ceiling plate 2 which has a groove formed to compose a flow path 3.

The element substrate 1 is composed by forming a silicon oxide film or a silicon nitride film 106 on the base 107 such as silicon for insulation and accumulation of heat, patterning an electrical resistor layer 105 (0.01 to 0.2 μm thick) made of a material such as hafnium boride ($HfB_2$), tantalum nitride (TaN) or tantalum aluminium (TaAl) and wiring electrodes 104 (0.2 to 1.0 μm thick), which compose a heat generating element on the film 106 as shown in FIG. 22A. Heat is generated by applying a voltage from the wiring electrode 104 to the resistor layer 105, thereby supplying a current through the resistor layer 105. A protective film 103 which is 0.1 to 2.0 μm thick made of silicon oxide or silicon nitride is formed on the resistor layer 105 between the wiring electrodes 104 and a cavitation resistant layer 102 (0.1 to 0.6

μm thick) made of a material such as tantalum is formed on the protective film 103 to protect the resistor layer 105 from various kinds of liquids such as ink.

Since pressures and shock waves which are produced by producing and breaking a bubble are strong enough to remarkably lower durability of the oxide films, a metallic material such as tantalum (Ta) is used as a material for the cavitation resistance layer 102.

Dependently on a combination of a liquid, a flow path structure and a resistor material, it is possible to adopt a configuration which does not require disposing the protective film 103 on the resistor layer 105 as shown in FIG. 10B. An iridium-tantalum-aluminium alloy or the like can be mentioned as a material for the resistor layer 105 which does not require the protective film 103.

The heat generating element 10 used in the embodiments described above may be composed only of the resistor layer 105 (heat generating portion) between the electrodes 104 or may comprise the protective film 103 which protects the resistor layer 105.

Though the heat generating element 10 composed of the resistor layer 105 which generates heat in correspondence to electric signals is used in each of the embodiments, this heat generating element is not limitative and an element is usable as the heat generating portion so far as it can produce a bubble in a liquid which is capable of discharging a liquid. It is possible to use, for example, a photothemal converting element which generates heat by receiving light such as laser or a heat generating element having a heat generating portion which generates heat by receiving a high-frequency wave.

The element substrate 1 described above may comprise, in addition to the heat generating portion element 10 composed of the resistor layer 105 which composes the heat generating portion and the wiring electrodes 104 which supply electric signals to the resistor layer 105, functional elements such as a transistor, a diode, a latch and a shift register which are integrated at a semiconductor manufacturing step for selectively driving the heat generating element 10 (electrothermal converting element).

Figure 23:
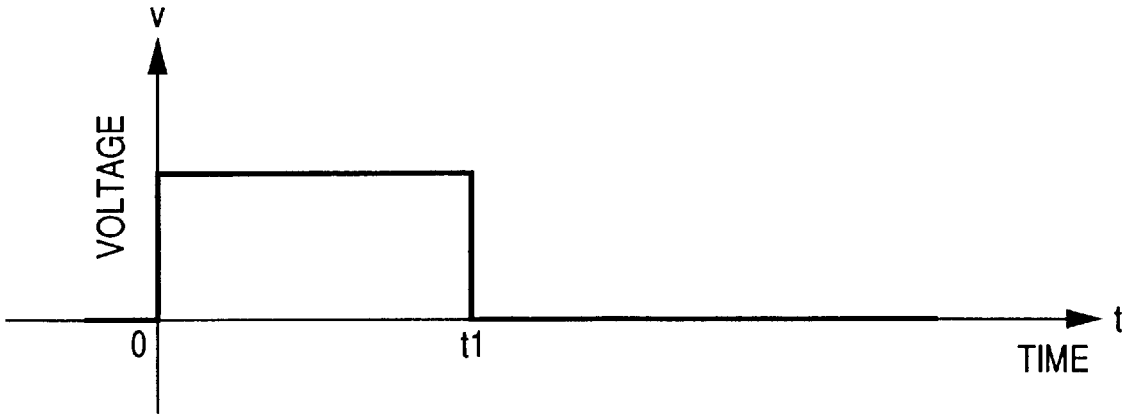
FIG. 23 is a graph showing a rectangular pulse applied to the resistance layer.

To drive the heat generating portion of the heat generating element 10 disposed on the element substrate 1 for discharging a liquid, a rectangular pulse such as that shown in FIG. 23 is applied to the resistor layer 105 described above by way of the wiring electrodes 104, thereby allowing the resistor layer 105 between the wiring electrodes 104 to abruptly generate heat. In the head described in each embodiment, the heat generating element is driven by applying electric signals which have a voltage of 24 V, a pulse width of 7 μsec and a current of 150 mA at 6 kHz and ink is discharged from the discharging port 4 as a liquid by the operations described above. However, the conditions of driving signals are not limitative and any driving signals may be used so far as they can produce an adequate air bubble in a liquid.

<Recorder>

Figure 24:
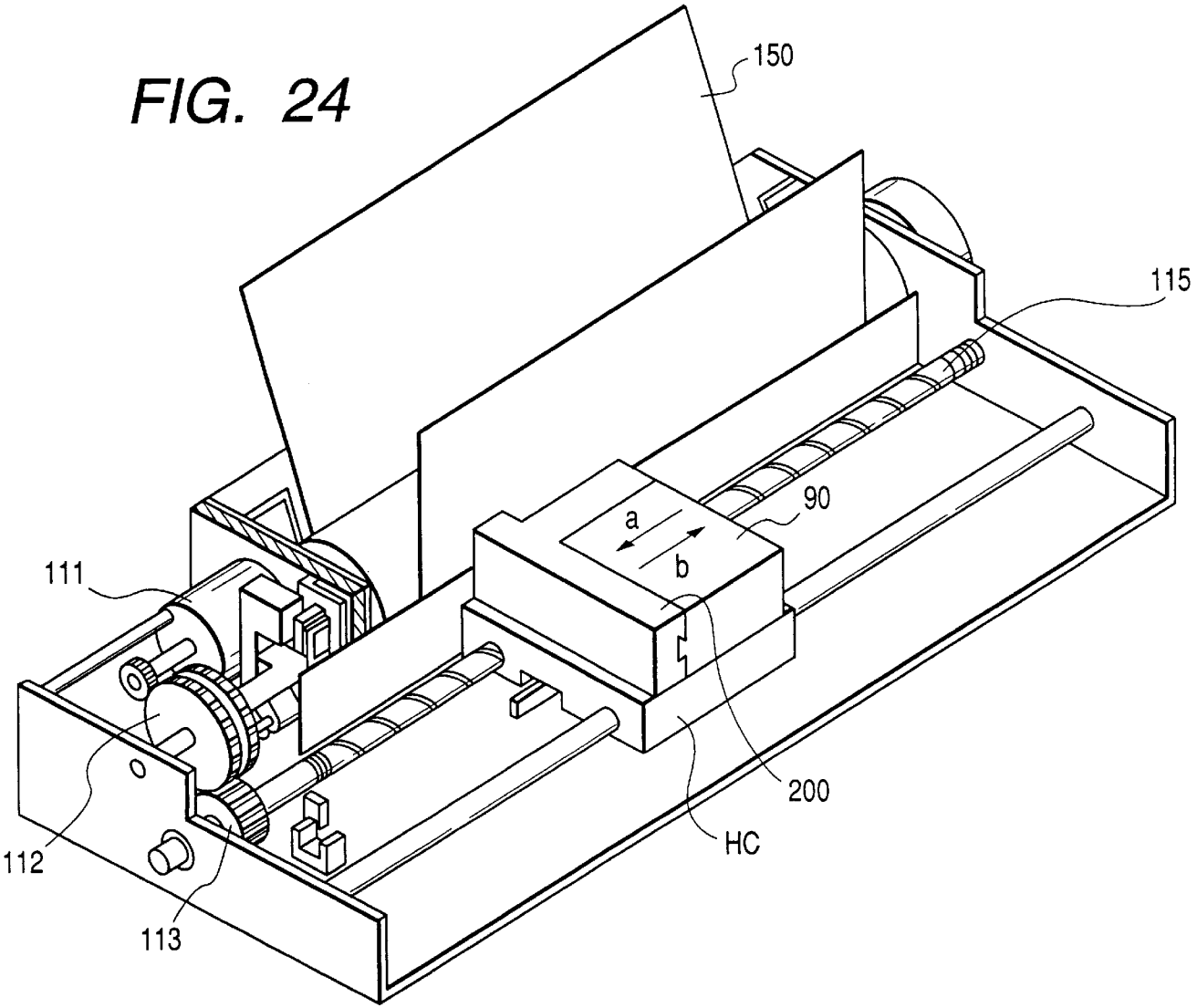
FIG. 24 is a view showing an ink jet recording apparatus incorporated with the liquid discharge apparatus according to the present invention.

FIG. 24 shows an ink-jet recorder in which the liquid discharging device is built and ink is used as a liquid to be discharged. A carriage HC supports a head cartridge composed of a liquid tank 90 accommodating the ink and a recording head 200 as a liquid discharging device which are detachable from each other, and reciprocally moves in a lateral direction of a recording medium 150 such as a recording paper fed by recording medium carrying means.

When a driving signal is supplied from driving signal supply means (not shown) to liquid discharging means on the carriage HC, the ink (recording liquid) is discharged from the recording head to the recording medium in correspondence to this signal.

A recorder adopted in the embodiment of the present invention has a motor 111 functioning as a driving source to drive the recording medium carrying means and the carriage, gears 112 and 113 to transmit a power from the driving source to the carriage, a carriage shaft 115 and so on. This recorder is capable of favorably recording images by discharging liquids to various kinds of recording media by the liquid discharging method according to the present invention.

Figure 25:
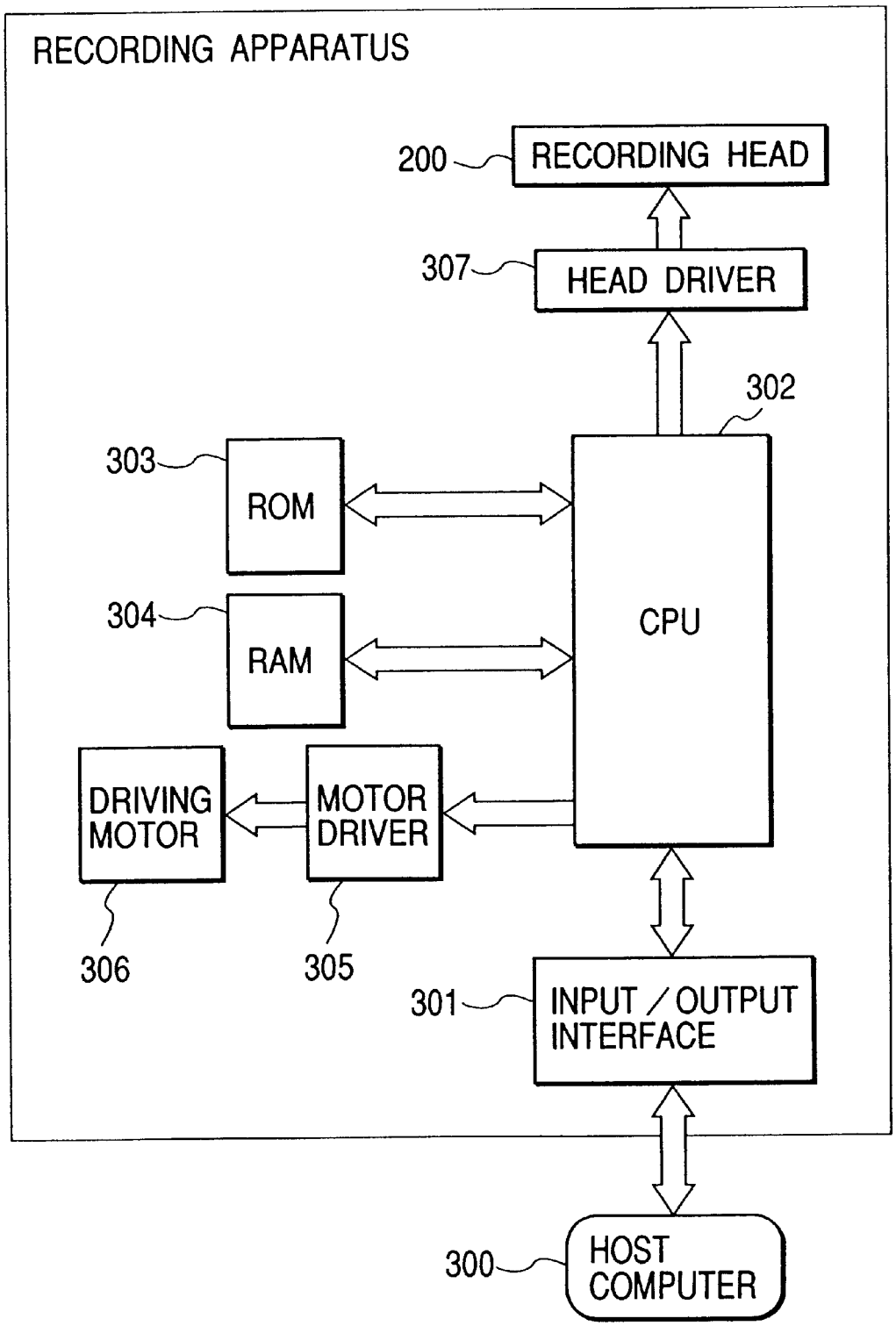
FIG. 25 is a block diagram showing an entire recording apparatus for performing ink jet recording by the liquid discharge apparatus according to the present invention.

FIG. 25 is a block diagram illustrating an ink-jet recording system as a whole which records images with the liquid discharging device according to the present invention.

The recording system receives print data as control signals from a host computer 300. The print data is stored temporally in an input interface 301 disposed in a printer, simultaneously converted into a processable data in the recording system and input into a CPU (central processor unit) 302. On the basis of a control program stored in a ROM (read only memory) 303, the CPU 302 processes the input data using peripheral units such as a RAM (random access memory) 304, thereby converting the processed data into data to be printed out (image data).

To record the image data at an adequate location on the recording paper, the CPU 302 generates driving data used to drive a driving motor 306 which moves the carriage HC supporting the recording paper and the recording head in synchronization with the image data. The image data and the motor driving data are transmitted to the recording head 200 and a driving motor 306 by way of a head driver 307 and a motor driver 305 respectively, driven at controlled timings respectively and used to form images.

Usable as the recording medium 150 to which liquids such as ink are imparted in this recording system are various kinds of papers, OHP sheets, plastic materials which are used as compact discs or decorative sheets, cloth, metallic materials such as aluminium and copper, leather materials such as cow skin, pig skin and artificial skins, wooden materials such as wooden sheets and plywoods, bamboo materials, ceramic materials such as tiles, and three-dimensional structures such as sponge.

The recording system may comprise a printer which records images on various kinds of papers and OHP sheets, a recorder which records images on plastic materials such as compact discs, a recorder which records images on metallic sheets, a recorder which records images on leather materials, a recorder which records images on wooden materials, a recorder which records images on ceramic materials, a recorder which records images on three-dimensional materials such as sponge or a printers which prints images on cloth.

Any liquids which are matched with recording media or recording conditions may be used as liquids to be discharged with the liquid discharging device.

What is claimed is:

1. A liquid discharging head for discharging a liquid through a discharging port with an energy generated by producing a bubble, the liquid discharging head comprising:

a heat generating element which generates heat energy for producing the bubble in the liquid, the discharging port that discharges the liquid, a liquid flow path that communicates with the discharging port and has a bubble producing region for producing the bubble in the liquid, the liquid flow path being formed by a substrate that is equipped with the heat generating element and is substantially planar, an opposing plate that is opposed to the substrate, and two side walls located between the substrate and the opposing plate, a movable plate that is disposed in the bubble producing region opposed to the substrate and displaced as the bubble grows, the movable plate having a fixed end, two side edges that are adjacent to and opposing the side walls, and a free end at an end of the movable plate opposite the fixed end that has a width larger than that of the heat generating element, the free end being opposed to a middle of the bubble producing region with respect to a liquid flow direction, and a restricting member that restricts displacement of the movable plate within a desired range, the restricting member having a tip restricting portion configured to make substantial contact with the free end of the displaced movable plate and a side restricting portion that is located beside the bubble producing region on a side of the movable plate opposite to the substrate, the side restricting portion being configured to make substantial contact at least partially with both of the side edges of the displaced movable plate so as to keep open the middle of the liquid flow path, wherein the side restriction portion restricts displacement of the side edges so that the bubble produced in the bubble producing region is restricted by the contact between the movable plate and the side restricting portion.

2. The liquid discharging head according to claim 1, wherein said movable plate is disposed close to the bubble producing region and has a convex portion protruding from the movable plate toward the substrate.

3. The liquid discharging head according to claim 1, wherein the tip restricting portion and the free end of the movable plate are located on a plane which is perpendicular to the substrate.

4. The liquid discharging head according to claim 3, wherein the tip restricting portion, the free end of the movable plate and a center of the heat generating element are located on a plane which is perpendicular to the substrate.

5. The liquid discharging head according to claim 1, wherein the liquid flow path has a sectional area which is enlarged downward from the tip restricting portion.

6. The liquid discharging head according to claim 1, wherein the opposing plate has a surface which rises relative to the substrate upstream from the restricting member.

7. The liquid discharging head according to claim 1, wherein the tip restricting portion is continuous to the side restricting portion.

8. The liquid discharging head according to claim 1, wherein the side edges of the movable plate have a tapered shape which spreads toward the substrate and the side restricting portion has a tapered shape which is narrowed toward a middle of the liquid flow path.

9. The liquid discharging head according to claim 1, wherein the side restricting portion has a form which is slanted so that in a downstream direction of the liquid flow path a distance between the side restricting portion and the substrate increases.

10. The liquid discharging head according to claim 1, wherein the side restricting portion is disposed on the opposing plate.

11. The liquid discharging head according to claim 1, wherein the side restricting portion is disposed on the side walls.

12. The liquid discharging head according to claim 11, wherein the side restricting portion protrudes from the middle of the liquid flow path into the liquid flow path.

13. The liquid discharging head according to claim 11, wherein said liquid flow path has a width at a location of the side walls which is larger than a width of the liquid flow path at the side restricting portion.

14. The liquid discharging head according to claim 1, wherein the heat generating element communicates linearly with the discharging port.

15. The liquid discharging head according to claim 1, wherein the discharging port is disposed above the heat generating element.

16. The liquid discharging head according to claim 15, wherein the movable plate is one of a plurality of movable plates for a single heat generating element and the movable plates are arranged symmetrically with regard to a bubble producing center of the heat generating element.

17. The liquid discharging head according to claim 1, wherein the heat generating element discharges the liquid by utilizing film boiling.

18. The liquid discharging head according to claim 1, wherein a volume Vv of a displacement region of the movable plate and a maximum volume Vb of the air bubble are in the following relationship: $Vv<Vb/2$.

19. The liquid discharging head according to claim 1, wherein the heat generating element discharges the liquid by utilizing film boiling.

20. A liquid discharging head for discharging a liquid through a discharging port with energy generated by producing a bubble, the liquid discharge head comprising:

a liquid flow path having a heat generating element for generating heat for producing the bubble in the liquid, the discharging port which discharges the liquid, the liquid flow path communicating with the discharging port and having a bubble producing region for producing the bubble in the liquid, the liquid flow path being formed by a substrate that is equipped with the heat generating element and is substantially planar, an opposing plate that is opposed to the substrate, and two side walls located between the substrate and the opposing plate, a movable plate that is disposed in the bubble producing region and displaced as the air bubble grows, the movable plate having a convex portion that is close to the bubble producing region and protrudes from the movable plate toward the substrate and the movable plate having a fixed end, two side edges that are adjacent to and opposing the side walls, and a free end at an end of the movable plate opposite the fixed end that has a width larger than that of the heat generating element, the free end being opposed to a middle of the bubble producing region with respect to a liquid flow direction, and a restricting member that restricts displacement of the movable plate within a desired range, the restricting member having a tip restricting portion configured to make substantial contact with the free end of the displaced movable plate and a side restricting portion that is located beside the bubble producing region on a side of the movable plate opposite to the substrate, the side restricting portion being configured to make substantial contact at least partially with both of the side edges of the displaced movable plate so as to keep open the middle of the liquid flow path, and the restricting member being disposed in opposition to the bubble producing region and forming a space that is substantially closed, except for the discharging port, when the displaced movable plate is brought into substantial contact with the restricting member.

21. The liquid discharging head according to claim 20, wherein the heat generating element communicates linearly with the discharging port.

22. The liquid discharging head according to claim 20, wherein the discharging port is disposed above the heat generating element.

23. The liquid discharging head according to claim 22, wherein the movable plate is one of a plurality of movable plates for a single heat generating element and the movable plates are arranged symmetrically with regard to a bubble producing center of the heat generating element.

24. A liquid discharging head for discharging a liquid through a discharging port in communication with a flow path by producing a bubble in the liquid in the flow path, the liquid discharging head comprising:

a movable member that is supported at an end thereof like a cantilever and has a free end on an opposite end near the discharging port, wherein a volume Vv of a displacement region of the movable member, which may be approximated by taking a length of the movable member, as measured from the free end to an effective fulcrum, times a width of the movable member time a maximum displacement height of the movable member divided by two, and a maximum volume Vb of the bubble are in the following relationship: $Vv<Vb/2$.

25. A method to discharge a liquid through a discharging port of a liquid discharging head with energy generated by producing a bubble, the liquid discharging head having a heat generating element that generates heat for producing the bubble in the liquid, the discharging port for discharging the liquid, and a liquid flow path that communicates with the discharging port and has a bubble producing region for producing the bubble, the liquid flow path being formed by a substrate that is equipped with the heat generating element and is substantially planar, an opposing plate that is opposed to the substrate, and two side walls located between the substrate and the opposing plate, the method comprising the steps of:

providing a movable plate that is disposed in the bubble producing region opposed to the substrate and displaced as the bubble grows, the movable plate having a fixed end, two side edges that are adjacent to and opposing the side walls, and a free end at an end of the movable plate opposite the fixed end that has a width larger than that of the heat generating element, the free end being opposed to a middle of the bubble producing region with respect to a liquid flow direction, providing a restricting member that restricts displacement of the movable plate within a desired range, the restricting member having a tip restricting portion configured to make substantial contact with the free end of the displaced movable plate and a side restricting portion that is located beside the bubble producing region on a side of the movable plate opposite to the substrate, the side restricting portion being configured to make substantial contact at least partially with both of the side edges of the displaced movable plate so as to keep open the middle of the liquid flow path, bringing the movable plate into contact with the restricting member before maximum growth of the bubble, and bringing the side restricting portion into contact with the movable plate to restrict the bubble produced in the bubble producing region so as to form a space in the bubble producing region of the liquid flow path that is substantially closed except for the discharging port.

26. A method to discharge a liquid through a discharging port of a liquid discharging head with energy generated by producing a bubble, the liquid discharging head having a heat generating element that generates heat for producing the bubble in the liquid, the discharging port for discharging the liquid, a liquid flow path that communicates with the discharging port and has a bubble producing region for producing the bubble, the liquid flow path being formed by a substrate that is equipped with the heat generating element and is substantially planar, an opposing plate that is opposed to the substrate, and two side walls located between the substrate and the opposing plate, the method comprising the steps of:

providing a movable plate that is disposed in the bubble producing region opposed to the substrate and displaced as the bubble grows, the movable plate having a fixed end, two side edges that are adjacent to and opposing the side walls, and a free end at an end of the movable plate opposite the fixed end that has a width larger than that of the heat generating element, the free end being opposed to a middle of the bubble producing region with respect to a liquid flow direction, providing a restricting member that restricts displacement of the movable plate within a desired range, the restricting member having a tip restricting portion configured to make substantial contact with the free end of the displaced movable plate and a side restricting portion that is located beside the bubble producing region on a side of the movable plate opposite to the substrate, the side restricting portion being configured to make substantial contact at least partially with both of the side edges of the displaced movable plate so as to keep open the middle of the liquid flow path, and making a distance between the movable plate and the side restricting portion shorter than a gap between the movable plate and the side walls as the movable plate comes nearer the side restricting portion after allowing the liquid to flow around the movable plate which is displaced as the bubble grows, thereby restricting advance of the bubble toward the movable plate.

27. The method to discharge a liquid according to claim 26, further comprising the steps of:

allowing the liquid to turn beside the movable plate and flow into the bubble producing region after a section upstream from the bubble producing region is substantially shielded by the movable plate which comes into contact with the side restricting portion, and allowing a liquid flowing along a surface of the movable plate to join with a liquid flowing from a side of the movable plate.

* * * * *